United States Patent [19]

Koya et al.

[11] Patent Number: 4,994,363

[45] Date of Patent: Feb. 19, 1991

[54] SILVER HALIDE LIGHT-SENSITIVE MATERIAL CONTAINING A COMPOUND RELEASING A PHOTOGRAPHICALLY USEFUL GROUP

[75] Inventors: Keizo Koya; Koki Nakamura; Hiroyuki Watanabe; Yasuhiro Yoshioka, all of Kanagawa, Japan

[73] Assignee: Fuji Photo Film Co., Ltd., Kanagawa, Japan

[21] Appl. No.: 286,562

[22] Filed: Dec. 19, 1988

[30] Foreign Application Priority Data

Dec. 17, 1987 [JP] Japan ..... 62-319989

[51] Int. Cl.[5] ..... G03C 1/08

[52] U.S. Cl. ..... 430/564; 430/223; 430/544; 430/559; 430/598; 430/955; 430/956; 430/957; 430/958; 430/959

[58] Field of Search ..... 430/955, 956, 957, 958, 430/959, 223, 564, 544, 559, 598

[56] References Cited

U.S. PATENT DOCUMENTS 4,186,012 1/1980 Odenwalder ..... 430/544

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A novel silver halide light-sensitive material is provided, comprising a compound represented by the general formula (I):

(I)

wherein EAG represents an aromatic group which receives electrons from a reducing substance; $R^1$ represents hydrogen atom or a substituent; $R^2$ represents an electrophilic group, with the proviso that $R^1$ and $R^2$ may be in the position of cis or trans to each other; $R^3$ and $R^4$ each represents hydrogen atom or a hydrocarbon group; ETG represents a group capable of transferring electrons; e represents an integer 0 or 1; Time represents a group which undergoes reaction triggered by the cleavage from the carbon carrying $R^3$ and $R^4$ to release PUG; t represents an integer 0 or 1; and PUG represents a photographically useful group.

In a preferred embodiment, $R^1$ represents an aromatic group, heterocyclic group or group represented by $—Y^1—R^5$ in which $Y^1$ represents a hetero atom or hetero atomic group and $R^5$ represents hydrogen atom, an aliphatic group, an aromatic group or a heterocyclic group. $R^2$ represents an acyl group, carbamoyl group, alkoxycarbonyl group, cyano group, sulfonyl group or nitro group. $R^1$ is a group represented by $—Y^1—Y^2—R^6$ in which $Y^1$ and $Y^2$ each represents a hetero atom or hetero atomic group and may be the same or different and $R^6$ represents hydrogen atom, an aliphatic group, an aromatic group or a heterocyclic group.

2 Claims, No Drawings

SILVER HALIDE LIGHT-SENSITIVE MATERIAL CONTAINING A COMPOUND RELEASING A PHOTOGRAPHICALLY USEFUL GROUP

FIELD OF THE INVENTION

The present invention relates to a silver halide photographic material. More particularly, the present invention relates to a silver halide photographic material comprising a novel compound which undergoes reduction to release a photographically useful group.

BACKGROUND OF THE INVENTION

A compound which releases a photographically useful group counter-imagewise, i.e., positive acting compound can be expected to exhibit various functions unprecedented for the prior art precursors in a silver halide photographic material, has been intensively studied.

Proposed examples of positive acting compounds include the passive compounds described in U.S. Pat. Nos. 4,199,354 and 3,980,479.

Such a compound can undergo an intramolecular nucleophilic reaction in the presence of an alkali in a reduced state to release a photographic reagent. Such a compound also undergoes oxidation via a redox reaction in a light sensitive material. This redox reaction serves to lower the rate at which the photographic reagent is released. By utilizing such a property, a photographically useful group can be imagewise released. However, since oxidation and alkaline hydrolysis compete with each other, such a compound is disadvantageous in that a shift in the timing between the two reactions causes a generation of fog or deterioration in discrimination. Furthermore, such a compound is unstable Thus, positive acting compounds have many disadvantages.

In order to eliminate the above disadvantages a positive acting compound in the form of an oxidation product which can undergo a redox reaction with a reducing agent to release a photographically useful group has been proposed. A great number of positive acting compounds have been developed.

Examples of these positive acting compounds include positive acting compounds which undergo intramolecular displacement reactions after being reduced to release a photographic reagent. Such compounds are disclosed in U.S. Pat. Nos. 4,139,389, 4,139,379, and 4,564,577, JP-A-59-185333, and JP-A-57-84453 (the term "JP-A" as used herein means an "unexamined published Japanese patent application"). Positive acting compounds which undergo intramolecular electron transfer reactions after being reduced to eliminate a photographic reagent include those disclosed in U.S. Pat. No. 4,232,107, JP-A-59-101649, JP-A-61-88257, and *Research Disclosure,* No. 24,025, IV, 1984.

Furthermore, positive acting compounds which undergo bond cleavage by reduction to release a photographic reagent have been studied.

Examples of positive acting compounds utilizing such a reaction include compounds utilizing nitrogen-sulfur bond reduction cleavage as disclosed in German Patent No. 3,008,588, compounds utilizing nitrogen-nitrogen bond cleavage as disclosed in U.S. Pat. No. 4,619,884 and $\alpha$-nitro compounds which undergo carbon-hetero atom single bond cleavage after receiving electrons to release a photographic reagent as disclosed in German Patent No. 3,207,583. Other examples of such compounds include compounds utilizing carbon-hetero atom bond reduction cleavage such as geminar dinitro compounds which undergo nitrogen-nitrogen (nitro group) bond reduction cleavage which results in the $\beta$-elimination of a photographic reagent as described in U.S. Pat. No. 4,609,610. Further examples of compounds utilizing carbon-hetero atom single bond reduction cleavage include nitrobenzyl compounds disclosed in U.S. Pat. No. 4,343,893.

In recent years, a compound as described in European Patent No. 2,220,746A2 and Koaki Giho 87-6,199 has been developed as a positive acting compound which exhibits better stability and higher activity during processing and also exhibits a higher degree of freedom of design and tolerance in the preparation of a photographic element.

Compounds having such functions have many advantages. It is preferable that the properties and capabilities of the positive acting compound be improved so as to further increase the degree of freedom of design and tolerance in the preparation of a photographic element (material). It is further preferable that the photographic element be provided with a compound having a higher stability before and after processing. It is also preferred that a better means be provided to control the release of the photographically useful component.

SUMMARY OF THE INVENTION

It is therefore an object of the present invention to provide a novel compound having a great degree of freedom of molecular design which is stable to acid, alkali, nucleophilic agents, heat or the like in common photographic processing conditions and which releases a photographically useful group at a photographically appropriate rate in combination with a reducing agent commonly used in the art.

It is another object of the present invention to provide a photographic material comprising such a novel compound.

These and other objects of the present invention will become more apparent from the following description and examples.

The Inventors studied a novel compound which is stable to acid, alkali, nucleophilic agents and heat, and undergoes reduction to release a photographically useful group.

Particularly, the position at which electrons can be received from a reducing substance and the chemical bond required for the mechanism in which these electrons cause a photographically useful group to be released were intensively studied. As a result, the inventors found it possible to use a compound known as a photographic reducing agent to release a photographically useful group by engineering a molecular design in which the electron receiving portion as described later is conjugated with a double bond having electrons with a great degree of freedom of electron transfer and a proper substituent is incorporated therein so that the polarization of carbon-carbon double bond can be controlled.

These objects of the present invention are accomplished by a silver halide light-sensitive material, comprising a novel compound represented by the general formula (I):

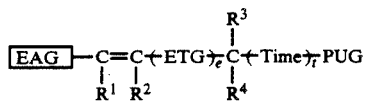

(I)

wherein EAG represents an aromatic group which receives electrons from a reducing substance; $R^1$ represents hydrogen atom or a substituent; $R^2$ represents an electrophilic group, with the proviso that $R^1$ and $R^2$ may be in the position of cis or trans to each other; $R^3$ and $R^4$ each represents hydrogen atom or a hydrocarbon group; ETG represents a group capable of transferring electrons; e represents an integer 0 or 1; Time represents a group which undergoes a reaction triggered by the cleavage from the carbon carrying $R^3$ and $R^4$ to release PUG; t represents an integer 0 or 1; and PUG represents a photographically useful group.

The details of the mechanism of the reaction in which the compound of the general formula (I) reacts with a reducing substance to release a photographically useful group is unknown at present. The inventors suggest the following reaction mechanism.

Particularly, when the present compound receives an electron at its electron receiving portion (EAG) from a reducing substance, it becomes an anion radical. The carbon-carbon double bond conjugated with the electron receiving portion (EAG) then develops a high polarization. Thus, the electrons are localized at the carbon atom carrying $R^2$. Therefore, the present compound is put in the form of a carboanion.

This electron transfer causes PUG to be released irreversibly.

DETAILED DESCRIPTION OF THE INVENTION

The compound represented by the general formula (I) is described in detail below.

EAG will be first described.

EAG represents an aromatic group which receives electrons from a reducing substance. EAG is bonded to a carbon atom. The aromatic group represented by EAG may preferably be a group represented by the general formula (A):

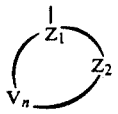

(A)

wherein $Z_1$ represents

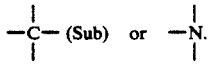

$V_n$ represents an atomic group which forms a 3-to 8-membered aromatic group. The suffix n represents an integer of 3 to 8.

$V_3$, $V_4$, $V_5$, $V_6$, $V_7$ and $V_8$ represent $—Z_3—$, $—Z_3—Z_4—$, $—Z_3—Z_4—Z_5—$, $—Z_3—Z_4—Z_5—Z_6—$, $—Z_3—Z_4—Z_5—Z_6—Z_7—$, and $—Z_3—Z_4—Z_5—Z_6—Z_7—Z_8—$, respectively.

$Z_2$ to $Z_8$ each represents

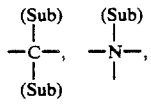

—O—, —S—, or $—SO_2—$ (Sub) each represents a mere bond ($\pi$ bond), hydrogen atom or the undermentioned substituent. These (Sub)'s may be the same or different. These (Sub)'s may be connected to each other to form a 3- to 8-membered saturated or unsaturated carbon ring or heterocyclic ring. In general formula (A), (Sub) may be selected such that the sum of the sigma para of Hammett's substituent constants of substituents is +0.50 or more, preferably +0.70 or more, particularly +0.85 or more.

Examples of substituents represented by (Sub) include nitro group, nitroso group, cyano group carboxyl group, sulfo group, sulfino group, sulfeno group, mercapto group, isocyano group, thiocyanate group, hydroxyl group, halogen atoms (e.g., fluorine atom, chlorine atom, bromine atom, iodine atom), iodosyl group, iodyl group, diazo group, azido group, alkyl or aralkyl groups (e.g., alkyl groups or aralkyl groups which may be substituted, such as methyl group, trifluoromethyl group, benzyl group, chloromethyl group, dimethylaminomethyl group, ethoxycarbonylmethyl group, aminomethyl group, acetylaminomethyl group, ethyl group, 2-(4-dodecanoylaminophenyl)ethyl group, carboxyethyl group, allyl group, 3,3,3-trichloropropyl group, n-propyl group, isopropyl group, n-butyl group, isobutyl group, sec-butyl group, t-butyl group, n-benzyl group, sec-pentyl group, t-pentyl group, cyclopentyl group, n-hexyl group, sec-hexyl group, t-hexyl group, cyclohexyl group, n-octyl group, sec-octyl group, t-octyl group, n-decyl group, n-undecyl group, n-dodecyl group, n-tetradecyl group, n-pentadecyl group, n-hexadecyl group, sec-hexadecyl group, t-hexadecyl group, n-octadecyl group, t-octadecyl group), alkenyl groups (e.g., alkenyl groups which may be substituted, such as vinyl group, 2-chlorovinyl group, 1-methylvinyl group, 2-cyanovinyl group, cyclohexen-1-yl group), alkynyl groups (e.g, alkynyl groups which may be substituted, such as ethynyl group, 1-propynyl group, 2-ethoxycarbonylethynyl group), aryl groups (e.g., aryl groups which may be substituted, such as phenyl group, naphthyl group, 3-hydroxyphenyl group, 3-chlorophenyl group, 4-acetylaminophenyl group, 4-hexadecanesulfonylaminophenyl group, 2-methanesulfonyl-4-nitrophenyl group, 3-nitrophenyl group, 4-methoxyphenyl group, 4-acetylaminophenyl group, 4-methanesulfonylphenyl group, 2,4-dimethylphenyl group, 5-tetradecyloxyphenyl group), heterocyclic groups (e.g., heterocyclic groups which may be substituted, such as 1-imidazolyl group, 2-furyl group, 2-pyridyl group, 5-nitro-2-pyridyl group, 3-pyridyl group, 3,5-dicycano-2-pyridyl group, 5-tetrazolyl group, 5-phenyl-1-tetrazolyl group, 2-benzthiazolyl group, 2-benzimidazolyl group, 2-benzoxazolyl group, 2-oxazolin-2-yl group, morpholino group), acyl groups (e.g., acyl groups which may be substituted, such as acetyl group, propionyl group, butyloyl group, isobutyloyl group, 2,2-dimethylpropionyl group, benzoyl group, 3,4-dichlorobenzoyl group, 3-acetylamino-4-methoxybenzoyl group, 4-methylbenzoyl group, 4 methoxy-3-sulfobenzoyl group), sulfonyl groups (e.g., sulfonyl groups which may be substituted, such as methanesulfonyl group, ethanesulfonyl group, chloromethanesulfonyl group, propanesulfonyl group, butanesulfonyl group, n-octanesulfonyl group, n-dodecanesulfonyl group, n-hexadecanesulfonyl group, benzenesulfonyl group, 4-toluenesulfonyl group, 4-n-dodecyloxybenzenesulfonyl group), amino groups (e.g., amino groups which may be substituted, such as amino group, methylamino group, dimethylamino group, ethylamino group, ethyl-3-carboxypropylamino group, ethyl-2-sulfoethylamino group, phenylamino group, methylphenylamino group, methyloctylamino group, methylhexadecylamino group), alkoxy groups (e.g., alkoxy groups which may be substituted such as methoxy group, ethoxy group, n-propyloxy group, isopropyloxy group, cyclohexylmethoxy group), aryloxy or heterocyclic oxy groups (e.g., aryloxy groups or heterocyclic oxy groups which may be substituted, such as phenoxy group, naphthyloxy group, 4-acetylaminophenoxy group, pyrimidin-2-yloxy group, 2-pyridyloxy group), alkylthio groups (e.g., alkylthio groups which may be substituted, such as methylthio group, ethylthio group, n-butylthio group, n-octylthio group, t-octylthio group, n-dodecylthio group, n-hexadecylthio group, ethoxycarbonylmethylthio group, benzylthio group, 2-hydroxyethylthio group), arylthio or heterocyclic thio groups (e.g., arylthio groups or heterocyclic thio groups which may be substituted, such as phenylthio group, 4-chlorophenyl group, 2-n-butoxy-5-t-octylphenylthio group, 4-nitrophenylthio group, 2-nitrophenylthio group, 4-acetylaminophenylthio group, 1-phenyl-5-tetrazolylthio group, 5-methanesulfonylbenzothiazol-2-ylthio group), ammonio groups (e.g., ammonio groups which may be substituted, such as ammonio group, trimethylammonio group, phenyldimethylammonio group, dimethylbenzylammonio group, tri-n-butylammonio group), carbamoyl groups e.g., carbamoyl groups which may be substituted, such as carbamoyl group, methylcarbamoyl group, dimethylcarbamoyl group, bis(2-methoxyethyl)carbamoyl group, diethylcarbamoyl group, cyclohexylcarbamoyl group, di-n-octylcarbamoyl group, 3-dodecyloxypropylcarbamoyl group, hexadecylcarbamoyl group, 3-(2,4-di-t-pentylphenoxy)propylcarbamoyl group, 3-octanesulfonylaminophenylcarbamoyl group, di-p-octadecylcarbamoyl group), sulfamoyl groups (e.g., sulfamoyl groups which may be substituted, such as sulfamoyl group, methylsulfamoyl group, dimethylsulfamoyl group, diethylsulfamoyl group, bis-(2-methoxyethyl)-sulfamoyl group, di-n-butylsulfamoyl group, methyl-n-octylsulfamoyl group, n-hexadecylmethylsulfamoyl group, 3-ethoxypropylmethylsulfamoyl group, N-phenyl-N-methylsulfamoyl group, 4-decyloxyphenylsulfamoyl group, methyloctadecylsulfamoyl group), acylamino groups (e.g., acylamino groups which may be substituted, such as acetylamino group, 2-carboxybenzoylamino group, 3-nitrobenzoylamino group, 3-diethylaminopropanoylamino group, acryloylamino group), acyloxy groups (e.g., acyloxy groups which may be substituted, such as acetoxy group, benzoyloxy group, 2-butenoyloxy group, 2-methylpropanoyloxy group, 3-(chloro-4-tetradecyloxy)benzoyloxy group), sulfonylamino groups (e.g., sulfonylamino groups which may be substituted, such as methanesulfonylamino group, benzenesulfonylamino group, 2-methoxy-5-n-methylbenzenesulfonylamino group, 2-chloro-5-dodecanoylaminobenzenesulfonylamino group), alkoxycarbonylamino groups (e.g., alkoxycarbonylamino groups which may be substituted, such as methoxycarbonylamino group, ethoxycarbonylamino group, 2-methoxyethoxycarbonylamino group, isobutoxycarbonylamino group, benzyloxycarbonylamino group, t-butoxycarbonylamino group, 2-cyanoethoxycarbonylamino group), aryloxycarbonylamino groups (e.g., aryloxycarbonylamino groups which may be substituted, such as phenoxycarbonylamino group, 2,4-dimethylphenoxycarbonylamino group, 4-nitrophenoxycarbonylamino group, 4-t-butoxyphenoxycarbonylamino group), alkoxycarbonyloxy groups (e.g., alkoxycarbonyloxy groups which may be substituted, such as methoxycarbonyloxy group, t-butoxycarbonyloxy group, 2 -benzenesulfonylethoxycarbonyloxy group, n-decyloxycarbonyloxy group, benzyloxycarbonyloxy group), aryloxycarbonyloxy groups (e.g., aryloxycarbonyloxy groups which may be substituted, such as phenoxycarbonyloxy group, 3-cyanophenoxycarbonyloxy group, 4-acetoxyphenoxycarbonyloxy group, 4-t-butoxycarbonxylaminophenoxycarbonyloxy group, 4-hydroxy-3-benzensulfonylaminophenoxycarbonyloxy group), aminocarbonylamino groups (e.g., aminocarbonylamino groups which may be substituted, such as methylaminocarbonylamino group, morpholinocarbonylamino group, diethylaminocarbonylamino group, N-ethyl-N-phenylaminocarbonylamino group, 4-cyanophenylaminocarbonylamino group, 4-methanesulfonylphenylaminocarbonylamino group), aminocarbonyloxy groups (e.g., aminocarbonyloxy groups which may be substituted, such as dimethylaminocarbonyloxy group, pyrrolidinocarboxy group), 4-dipropylaminophenylaminocarbonyloxy group), and aminosulfonylamino groups (e.g., aminosulfonylamino groups which may be substituted, such as diethylaminosulfonylamino group, di-n-butylaminosulfonylamino group, phenylaminosulfonylamino group). Preferably these groups each contains from 0 to 40 carbon atoms.

EAG is preferably an aryl group or an aromatic heterocyclic group substituted by at least one electrophilic group. The substituent which is bonded to the aryl group or heterocyclic group is EAG can be used to adjust the properties of the entire component. Examples of the properties of the entire component include capability of receiving electrons, water solubility, oil solubility, diffusibility, sublimability, melting point, dispersibility in a binder such as gelatin, reactivity to nucleophilic groups, and reactivity to electrophilic groups.

Specific examples of EAG will be described hereinafter.

Examples of aryl groups substituted by at least one electrophilic group include 4-nitrophenyl group, 2-nitrophenyl group, 2-nitro-4-N-methyl-N-n-butylsulfamoylphenyl group, 2-nitro-4-N-methyl-N-n-octylsulfamoylphenyl group, 2-nitro-4-N-methyl-N-n-dodecylsulfamoylphenyl group, 2-nitro-4-N-methyl-N-n-hexadecylsulfamoylphenyl group, 2-nitro-4-N-methyl-N-n-octadecylsulfamoylphenyl group, 2-nitro-4-N-methyl-N-(3-carboxypropyl)sulfamoylphenyl group, 2-nitro-4-N-ethyl-N-(2-sulfoethyl)sulfamoylphenyl group, 2-nitro-4-N-n-hexadecyl-N-(3-sulfopropyl)sulfamoylphenyl group, 2-nitro-4-N-(2-cyanoethyl)-N-(2-hydroxylethoxy)ethyl)sulfamoylphenyl group, 2-nitro-4-diethylsulfamoylphenyl group, 2-nitro-4-di-n-butylsulfamoylphenyl group, 2-nitro-4-di-n-octylsulfamoylphenyl group, 2-nitro-4-di-n-octadecylsulfamoylphenyl group, 2-nitro-4-methylsulfamoylphenyl group, 2-nitro-4-n-hexadecylsulfamoylphenyl group, 2-nitro-4-N-methyl- N-(4-dodecylsulfonylphenyl)sulfamoylphenyl group, 2-nitro-4-(3-methylsulfamoylphenyl)sulfamoylphenyl group, 4-nitro-2-N-methyl-N-n-butylsulfamoylphenyl group, 4-nitro-2-N-methyl-N-n-octylsulfamoylphenyl group, 4-nitro-2-N-methyl-N-n-dodecylsulfamoylphenyl group, 4-nitro-2-N-methyl-N-n-hexadecylsulfamoyphenyl group, 4-nitro-2-N-methyl-N-n-octadecylsulfamoylphenyl group, 4-nitro-2-N-methyl-N-(3-carboxypropyl)sulfamoylphenyl group, 4-nitro-2-N-ethyl-N-(2-sulfoethyl)sulfamoylphenyl group, 4-nitro-2-N-n-hexadecyl-N-(3-sulfopropyl)sulfamoylphenyl group, 4nitro-2-N-(2-cyanoethyl)-N-((2-hydroxyethoxyethyl)sulfamoylphenyl group, 4-nitro-2-diethylsulfamoylphenyl group, 4-nitro-2-di-n-butylsulfamoylphenyl group, 4-nitro-2-di-n-octadecylsulfamoylphenyl group, 4-nitro-2-methylsulfamoylphenyl group, 4-nitro-2-n-hexadecylsulfamoylphenyl group, 4-nitro-2-N-methyl-N-(4-dodecylsulfonylphenyl)sulfamoylphenyl group, 4-nitro-2-(3methylsulfamoylphenyl)sulfamoylphenyl group, 4-nitro-2-chlorophenyl group, 2-nitro-4-chlorophenyl group, 2-nitro-4-N-methyl-N-n-butylcarbamoylphenyl group, 2-nitro-4-N-methyl-N-n-octylcarbamoylphenyl group, 2-nitro-4-N-methyl-N-n-dodecylcarbamoylphenyl group, 2-nitro-4-N-methyl-N-n-hexadecylcarbamoylphenyl group, 2-nitro-4-N-methyl-N-n-octadecylcarbamoylphenyl group, 2-nitro-4-N-methyl-N-(3-carboxypropyl)carbamoylphenyl group, 2-nitro-4-N-ethyl-N-(2-sulfoethyl)carbamoylphenyl group, 2-nitro-4-N-n-hexadecyl-N-(3-sulfopropyl)carbamoylphenyl group, 2-nitro-4-N-(2-cyanoethyl)-N-((2-hydroxyethoxy)ethyl)carbamoylphenyl group, 2nitro-4-diethylcarbamoylphenyl group, 2-nitro-4-di-n-butylcarbamoylphenyl group, 2-nitro-4-di-n-octylcarbomoylphenyl group, 2-nitro-4-n-octadecylcarbomoylphenyl group, 2-nitro-4-methylcarbamoylphenyl group, 2-nitro-4-n-hexadecylcarbamoylphenyl group, 2-nitro-4-N-methyl-(b 4-dodecylsulfonylphenyl)carbamoylphenyl group, 2nitro-4-(3-methylsulfamoylphenyl)carbamoylphenyl group, 4-nitro-2-N-methyl-N-n-butylcarbamoylphenyl group, 4-nitro-2-N-methyl-N-n-octylcarbamoylphenyl group, 4-nitro-2-N-methyl-N-n-dodecylcarbamoylphenyl group, 4-nitro-2-N-methyl-N-n-hexadecyclcarbamoylphenyl group, 4-nitro-2-N-methyl-N-n-octadecylcarbamoylphenyl group, 4-nitro-2-N-methyl-N-(3-carboxypropyl)carbamoylphenyl group, 4-nitro-2-N-ethyl-N-(2-sulfoethyl)carbamoylphenyl group, 4-nitro-2-N-n-hexadecyl-N-(3-sulfopropyl)carbamoylphenyl group, 4-nitro-2-N-(2-cyanoethyl)-N-((2-hydroxyethyoxy)ethyl)carbamoylphenyl group, 4nitro-2-diethylcarbamoylphenyl group, 4-nitro-2-di-n-butylcarbamoylphenyl group, 4-nitro-2-di-n-octylcarbamoylphenyl group, 4-nitro-2-di-n-octadecylcarbamoylphenyl group, 4-nitro-2-methylcarbamoylphenyl group, 4-nitro-2-n-hexadecylcarbamoylphenyl group, 4-nitro-2-N-methyl-N-(4-dodecylsulfonylphenyl)carbamoylphenyl group, 4-nitro-2-(3-methylsulfamoylphenyl)carbamoylphenyl group, 2,4-dimethanesulfonylphenyl group, 2-methanesulfonyl-4benzenesulfylphenyl group, 2-n-octanesulfonyl-4-methanesulfonylphenyl group, 2-n-tetradecanesulfonyl-4-methanesulfonylphenyl group, 2-n-hexadecanesulfonyl-4-methanesulfonylphenyl group, 2,4-didodecanesulfonylphenyl group, 2,4-didodecanesulfonyl-5-trifluoromethylphenyl group, 2-n-decanesulfonyl-4-cyano-5-trifluoromethylphenyl group, 2-cyano-4-methanesulfonylphenyl group, 2,4,6-tricyanophenyl group, 2,4-dicyanophenyl group, 2-nitro-4-methanesulfonylphenyl group, 2-nitro-4-n-dodecylsulfonylphenyl group, 2-nitro-4-(2-sulfoethylsulfonyl)phenyl group, 2-nitro-4-carboxymethylsulfonylphenyl group, 2-nitro-4-carboxyphenyl group, 2-nitro-4-ethoxycarbonyl-5-butoxyphenyl group, 2-nitro-4-ethoxycarbonyl-5-n-hexadecyloxyphenyl group, 2-nitro-4-di-ethylcarbamoyl-5-n-hexadecyloxyphenyl group, 2-nitro-4-cyano-5-n-dodecylphenyl group, 2,4-dinitrophenyl group, 2-nitro-4-n-decylthiophenyl group, 3,5-dinitrophenyl group, 2-nitro-3,5-dimethyl-4-n-hexadecanesulfonylphenyl group, 4-methanesulfonyl-2-benzenesulfonylphenyl group, 4-n-octanesulfonyl-2-methanesulfonylphenyl group, 4-n-tetradecanesulfonyl-2methanesulfonylphenyl group, 4-n-hexadecanesulfonyl-2-methanesulfonylphenyl group, 2,5-didodecanesulfonyl-4-trifluoromethylphenyl group, 4-n-decanesulfonyl-2-cyano-5-trifluoromethylphenyl group, 4-cyano-2-methanesulfonylphenyl group, 4-nitro-2-methanesulfonylphenyl group, 4-nitro-2-n-dodecanesulfonylphenyl group, 4-nitro-2-(2-sulfoethylsulfonyl)phenyl group, 4-nitro-2-carboxymethylsulfonylphenyl group, 4-nitro-2-carboxyphenyl group, 4-nitro-2-ethoxycarbonyl-5-n-butoxyphenyl group, 4-nitro-2-ethoxycarbonyl-5-n-hexadecyloxyphenyl group, 4-nitro-2-diethylcarbamoyl-5-n-hexadecyloxyphenyl group, 4-nitro-2-cyano-5-n-dodecylphenyl group, 4-nitro-2-n-decylthiophenyl group, 4-nitro-3,5-dimethyl-2-n-hexadecanesulfonylphenyl group, 4-nitronaphthyl group, 2,4-dinitronaphthyl group, 4-nitro-2-n-octadecylcarbamoylnaphthyl group, 4-nitro-2-dioctylcarbamoyl-5-(3-sulfobenzenesulfonylamino)naphthyl group, 2,3,4,5,6-pentafluorophenyl group, 2nitro-4-benzoylphenyl group, 2,4-diacetylphenyl group, 2-nitro-4-trifluoromethylphenyl group, 4-nitro-2-trifluoromethylphenyl group, 4-nitro-3-trifluoromethylphenyl group, 2,4,5-tricyanophenyl group, 3,4-dicyanophenyl group, 2-chloro-4,5-dicyanophenyl group, 2-bromo-4,5di-cyanophenyl group, 4-methanesulfonylphenyl group, 4-n-hexadecanesulfonylphenyl group, 2-decanesulfonyl-5-trifluoromethylphenyl group, 2-nitro-5-methylphenyl group, 2-nitro-5-n-octadecyloxyphenyl group, and 2-nitro-4-N-(vinylsulfonylethyl)-N-methylsulfamoylphenyl group.

Examples of aromatic heterocyclic groups represented by EAG include 2-pyridyl group, 3-pyridyl group, 4-pyridyl group, 5-nitro-2-pyridyl group, 5-nitro-N-hexadecylcarbamoyl-2-pyridyl group, 3,5-dicyano-2-pyridyl group, 5-dodecanesulfonyl-2-pyridyl group, 5-cyano-2-pyrazyl group, 4-nitrothiophen-2-yl group,5-nitro-1,2-dimethylimidazol-4-yl group, 3,5-diacetyl-2-pyridyl group, 1-dodecyl-5-carbamoylpyridinium-2-yl group, 5-nitro-2-furyl group, 5-nitrobenzthiazol-2-yl group, and 2-methyl-6-nitrobenzoxazol-5-yl group.

$R^1$ and $R^2$ in the general formula (I) will be described hereinafter.

$R^1$ represents hydrogen atom or a substituent. Such a substituent is not specifically limited and may be selected from many substituents. To further improve the properties of the compound of the general formula (I) as a positive acting compound, $R^1$ is preferably an aromatic group, heterocyclic group or $—Y^1—R^5$ in which $Y^1$ represents a hetero atom (preferably an atom having a lone pair) or hetero atomic group, and $R^5$ represents hydrogen atom or an aliphatic group, aromatic group or heterocyclic group.

Examples of aliphatic groups, aromatic groups and heterocyclic groups represented by $R^5$ include alkyl groups, aralkyl groups, alkenyl groups, alkynyl groups, aryl groups, and heterocyclic groups as described with reference to the substituent (Sub) for EAG.

In order to expediate the release of a photographically useful group, $R^1$ is preferably a group represented by $-Y^1-Y^2-R^6$.

$Y^1$ and $Y^2$ each represents a hetero atom or hetero atomic group. $R^6$ represents hydrogen atom or an aliphatic group, aromatic group or heterocyclic group. Specific examples of groups represented by $R^6$ include those described with reference to $R^5$.

$Y^1$ and $Y^2$ may be the same or different. Examples of combinations of $Y^1$ and $Y^2$ include

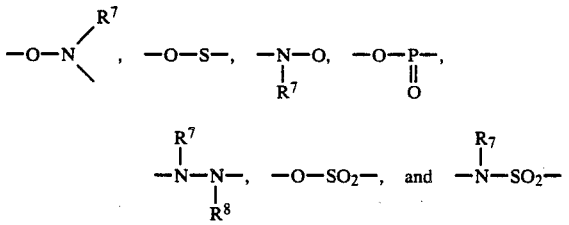

wherein $R^7$ and $R^8$ each represents hydrogen atom or an aliphatic group, aromatic group or heterocyclic group. Specific examples of these groups include those described with reference to $R^5$.

The reason why the compound of the present invention releases a photographically useful group more slowly when $R^1$ is a substituent as described above is not specifically known. It appears that when the electron receiving portion receives an electron from an electron donor, $Y^1$–$Y^2$ bond irreversibly cleaves, accelerating the release of a photographically useful group.

Specific examples of $R^1$ include hydrogen atom, aromatic groups or heterocyclic groups (e.g., aromatic or heterocyclic groups which may be substituted, such as phenyl group, naphthyl group, 3-hydroxyphenyl group, 3-chlorophenyl group, 4-acetylaminophenyl group, 4-hexadecanesulfonylaminophenyl group, 2-methanesulfonyl-4-nitrophenyl group, 3-nitrophenyl group, 4-methanesulfonylphenyl group, 2,4-dimethylphenyl group, 4tetradecyloxyphenyl group, 2-furyl group, 2-pyridyl group, 5-nitro-2-pyridyl group, 3-pyridyl group, 3,5-dicyano-2-pyridyl group), amino groups (e.g., amino groups which may be substituted, such as amino group, methylamino group, dimethylamino group, ethylamino group, ethyl-3-carboxypropylamino group, ethyl-2-sulfoethylamino group, phenylamino group, methylphenylamino group, methyloctylamino group, methylhexadecylamino group), alkoxy groups (e.g., alkoxy groups which may be substituted, such as methoxy group, ethoxy group, n-propyloxy group, isopropyloxy group, cyclohexylmethoxy group), aryloxy groups or heterocyclic oxy groups (e.g., aryloxy or heterocyclic oxy groups which may be substituted, such as phenoxy group, naphthyloxy group, 4-acetylaminophenoxy group, pyrimidin-2-yloxy group, 2-pyridyloxy group), alkylthio groups (e.g., alkylthio groups which may be substituted, such as methylthio group, ethylthio group, n-butylthio group, n-octylthio group, t-octylthio group, n-dodecylthio group, n-hexadecylthio group, ethoxycarbonylmethylthio group, benxylthio group, 2-hydroxyethylthio group), arylthio groups or heterocyclic thio groups (e.g., arylthio or heterocyclic thio groups which may be substituted, such as phenylthio group, 4-chlorophenylthio group, 2-n-butoxy-5-t-octylphenylthio group, 4-nitrophenylthio group, 2-nitrophenylthio group, 4-acetylaminophenylthio group, 1-phenyl-5-tetrazolylthio group, 5-methanesulfonylbenzothiazol-2-ylthio group), acylamino groups (e.g., acylamino groups which may be substituted, such as acetylamino group, 2-carboxylbenzoylamino group, 3-nitrobenzoylamino group, 3-diethylaminopropylamino group, acryloylamino group), acyloxy groups (e.g., acyloxy groups which may be substituted, such as acetoxy group, benzyloxy group, 2-butenoyloxy group, 2-methylpropanoyloxy group, 3-chloro-4-tetradecyloxybenzoyloxy group), sulfoxylamino groups (e.g., sulfonylamino groups which may be substituted, such as methanesulfonylamino group, benzenesulfonylamino group, 2-methoxy-5-n-methylbenzenesulfonylamino group, 2-chloro-5-dodecanoylaminobenzenesulfonylamino group), alkoxycarbonylamino groups (e.g., alkoxycarbonylamino groups which may be substituted, such as methoxycarbonylamino group, ethoxycarbonylamino group, 2-methoxyethoxycarbonylamino group, isobutoxycarbonylamino group, benzyloxycarbonylamino group, t-butoxycarbonylamino group, 2-cyanoethoxycarbonylamino group), aryloxycarbonylamino groups (e.g., aryloxycarbonylamino groups which may be substituted, such as phenoxycarbonylamino group, 2,4-dimethylphenoxycarbonylamino group, 4-nitrophenoxycarbonylamino group, 4-t-butoxyphenyloxycarbonylamino group), alkoxycarbonyloxy groups (e.g., alkoxycarbonyloxy groups which may be substituted, such as methoxycarbonyloxy group, t-butoxycarbonyloxy group, 2-benzenesulfonylethoxycarbonyloxy group, n-decyloxycarbonyloxy group, benzyloxycarbonyloxy group), aryloxycarbonyloxy groups (e.g., aryloxycarbonyloxy groups which may be substituted, such as phenoxycarbonyloxy group, 3-cyanophenoxycarbonyloxy group, 4-acetoxyphenoxycarbonyloxy group, 4-t-butoxycarbonylaminophenoxycarbonyloxy group, 4-hydroxy-3-benzenesulfonylaminophenoxycarbonyloxy group), aminocarbonylamino groups (e.g., aminocarbonylamino groups which may be substituted, such as methylaminocarbonylamino group, morpholinocarbonylamino group, diethylaminocarbonylamino group, N-ethyl-N-phenylaminocarbonylamino group, 4-cyanaophenylaminocarbonylamino group, 4-methanesulfonylphenylaminocarbonylamino group), aminocarbonyloxy groups (e.g., aminocarbonyloxy groups which may be substituted, such as dimethylaminocarbonyloxy group, pyrrolidinocarbonyloxy group, 4-dipropylaminophenylaminocarbonyloxy group), aminosulfonylamino groups (e.g., aminosulfonylamino groups which may be substituted, such as diethylaminosulfonylamino group, di-n-butylaminosulfonylamino group, phenylaminosulfonylamino group), and halogen atoms (e.g., fluorine, chlorine).

$R^2$ will be further described hereinafter.

$R^2$ represents an electrophilic group.

Specific examples of electrophilic groups represented by $R^2$ include sulfamoyl groups (e.g., sulfamoyl groups which may be substituted, such as sulfamoyl group, methylsulfamoyl group, dimethylsulfamoyl group, diethylsulfamoyl group, bis(2-methoxyethyl)sulfamoyl group, di-n-butylsulfamoyl group, methyl-n-octylsulfamoyl group, n-hexadecylmethylsulfamoyl group, 3-ethoxypropylmethylsulfamoyl group, N-phenyl-N-methylsulfamoyl group, 4-decyloxyphenylsulfamoyl group, methyloctadecylsulfamoyl group), cyano group, nitro group, carboxy group, carbamoyl groups (e.g., carbamoyl groups which may be substituted, such as carbamoyl group, methylcarbamoyl group, dimethylcarbamoyl group, bis(2-methoxyethyl)carbamoyl group, di-n-octylcarbamoyl group, 3-dodecyloxypropylcarbamoyl group, hexadecylcarbamoyl group, 3-(2,4-di-t-pentylphenyloxy)propylcarbamoyl group, 3-octanesulfonylaminophenylcarbamoyl group, di-n-octadecylcarbamoyl group), acyl groups (e.g., acyl groups which may be substituted, such as acetyl group, propionyl group, butyloyl group, isobutyloyl group, 2,2-dimethylpropionyl group, benzoyl group, 3,4-dichlorobenzoyl group, 3-acetylamino-4-methoxybenzyl group, 4-methylbenzoyl group, 4-methoxy-3-sulfobenzoyl group), sulfonyl groups (e.g., sulfonyl groups which may be substituted, such as methanesulfonyl group, ethanesulfonyl group, butanesulfonyl group, n-hexadecanesulfonyl group, benzenesulfonyl group, 4-toluenesulfonyl group, 4-n-dodecyloxybenzenesulfonyl group), sulfinyl groups (e.g., sulfinyl groups which may be substituted, such as methanesulfinyl group, ethanesulfinyl group, butanesulfinyl group, n-hexadecanesulfinyl group, benzenesulfinyl group, 4-toluenesulfinyl group, 4-n-dodecyloxybenzenesulfinyl group), alkoxycarbonyl groups or aryloxycarbonyl groups which may be substituted, such as methoxycarbonyl group, ethoxycarbonyl group, benzyloxycarbonyl group, propoxycarbonyl group, butoxycarbonyl group, pentyloxycarbonyl group, 2-methoxyethoxycarbonyl group, 2-chlorophenoxycarbonyl group), alkoxysulfonyl groups or aryloxysulfonyl groups (e.g., alkoxysulfonyl or aryloxysulfonyl groups which may be substituted, such as methoxysulfonyl group, ethoxysulfonyl group, propoxysulfonyl group, butoxysulfonyl group, benzyloxysulfonyl group, phenoxysulfonyl group, 4-methoxyphenoxysulfonyl group), carboxyl group (including carboxylate), and aryl groups or heterocyclic groups (e.g., aryl or heterocyclic groups which may be substituted, such as phenyl group, naphthyl group, 3-hydroxyphenyl group, 3-chlorophenyl group, 4-acetylaminophenyl group, 4-hexadecanesulfonylaminophenyl group, 2-methanesulfonyl-4-nitrophenyl group, 3-nitrophenyl group, 4-methoxyphenyl group, 4-acetylaminophenyl group, 4-methanesulfonylphenyl group, 2,4-dimethylphenyl group, 4-tetradecylphenyl group, 2-furyl group, 2-pyridyl group, 5-nitro-2-pyridyl group, 3-pyridyl group, 3,5-dicyano-2-pyridyl group, aryl groups as described with reference to EAG).

In order to control polarization of the carbon-carbon double bond in these electrophilic substituents so as to effect the release of a photographically useful group represented by PUG at a proper rate, $R^2$ is preferably an acyl group, carbamoyl group, cyano group, sulfonyl group or nitro group.

ETG will be further described hereinafter.

ETG represents a group capable of transferring electrons. ETG connects the olefin carbon atoms carrying $R^2$ to the carbon atom carrying $R^3$ and $R^4$.

A group capable of transferring electrons is a group having a bond containing $\pi$ electron having a large degree of freedom of electron transfer and capable of being conjugated with a carbon-carbon double bond as illustrated in general formula (I).

Therefore, many conjugated systems may be used as ETG. Specific examples of preferred conjugated systems will be shown with reference to their general formulas. The marks (*) and (*)(*) represent the position at which the ETG is connected to the olefin carbon atom carrying $R^2$ and to the carbon atom carrying $R^3$ and $R^4$ in the general formula (I), respectively.

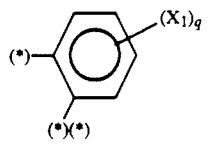

(E-1)

wherein $X_1$ represents hydrogen atom or an aliphatic group, aromatic group, heterocyclic group, —O—$R^9$, —S$R^9$,

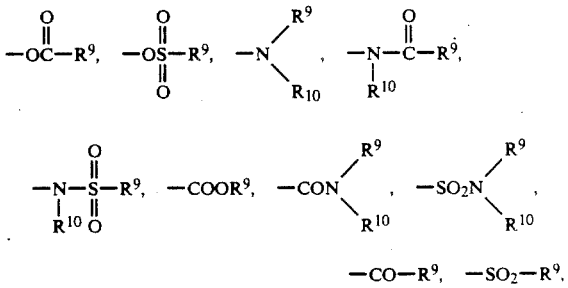

cyano group, halogen atom (e.g., fluorine, chlorine, bromine, iodine), or nitro group. $R^9$ and $R^{10}$ may be the same or different and each represents hydrogen atom or an aliphatic group, aromatic group or heterocyclic group.

The suffix q represents an integer 1 to 4. If q is an integer of 2 or more, the substituents represented by $X_1$ may be the same or different and may be connected to each other to form a ring.

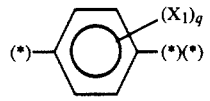

(E-2)

wherein $X_1$ and q are as defined in the general formula (E-1).

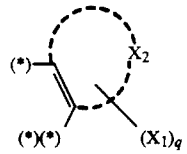

(E-3)

wherein $X_2$ represents an atomic group consisting of a combination of at least one or more atoms selected from the group consisting of carbon, nitrogen, oxygen and sulfur required to form a 5- to 7-membered heterocyclic ring which may be further condensed to benzene rings or 5- or 7-membered heterocyclic rings. Examples of preferred heterocyclic groups include pyrrole, pyrazole, imidazole, triazole, furan, oxazole, thiophene, thiazole, pyridine, pyridazine, pyrimidine, pyrazine, azepine, oxepine, indole, benzofurane, and quinoline.

In the general formula (E-3) $X_1$ and q are as defined in the general formula (E-1).

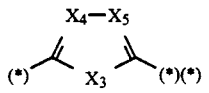

(E-4)

wherein $X_3$ represents an atomic group consisting of a combination of at least one or more atoms selected from the group consisting of carbon, nitrogen, oxygen, and sulfur required to form a 5- to 7-membered heterocyclic ring. $X_4$ and $X_5$ each represents

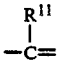

or —N= in which $R^{11}$ represents hydrogen atom or an aliphatic group or aromatic group. The heterocyclic ring may be further condensed with benzene rings or 5- to 7-membered heterocyclic ring.

Examples of preferred heterocyclic rings include pyrrole, imidazole, triazole, furan, oxazole, oxadiazole, thiophene, thiazole, thiadiazole, pyridine, pyridazine, pyrimidine, pyrazine, azepine, oxepine, and isoquinoline.

In the general formula (I), $R^3$ and $R^4$ each represents hydrogen atom or a hydrocarbon group. $R^3$ and $R^4$ may be the same or different. Such a hydrocarbon group may be substituted. Examples of hydrocarbon groups include alkyl groups, aralkyl groups, alkenyl groups, alkynyl groups, and aryl groups. Such a hydrocarbon group may preferably contain 1 to 20 carbon atoms.

The group $-(\text{Time})_t\text{PUG}$ will be further described hereinafter.

The group Time represents a group which releases PUG via a reaction triggered by its cleavage from the carbon atom carrying $R^3$ and $R^4$ in the general formula (I). The suffix t represents an integer 0 or 1.

As the group represented by Time there may be used any known group as described in JP-A-61-147244 (pp. 5–6), and JP-A-61-236549 (pp. 8–14), and JP-A-62-215270 (pp. 36–44). Suitable groups represented by Time include the group described in JP-A-62-215270 (pp. 25–45).

PUG represents a photographically useful group.

Examples of PUG include development inhibitors, development accelerators, nucleating agents, couplers, diffusible or nondiffusible dyes, desilvering accelerators, desilvering inhibitors, halides, silver halide solvents, redox competitive compounds, developing agents, auxiliary developing agents, fixing accelerators, fixing inhibitors, silver image stabilizers, toners, processing dependency improvers, dot improvers, color image stabilizers, photographic dyes, surface active agents, film hardeners, desensitizers, contrast developers, chelating agents, fluorescent brightening agents, ultraviolet absorbers, nucleating accelerators, film thickness improvers, and precursors thereof.

Since these photographically useful groups are often duplicative in usefulness, typical examples will be further described hereinafter.

Examples of suitable development inhibitors include halogens (e.g., bromine, iodine), compounds containing mercapto groups bonded to a heterocycle such as substituted or unsubstituted mercaptoazoles (e.g., 1-phenyl-5-mercaptotetrazole, 1-(4-carboxyphenyl)-5-mercaptotetrazole, 1-(3-hydroxyphenyl)-5-mercaptotetrazole, 1-(4-sulfophenyl)-5-mercaptotetrazole, 1-(3-sulfophenyl)5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadiazole, 3-methyl-4-phenyl-5-mercapto-1,2,4triazole, 2-(2-dimethylaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-{'-(3-methylureido)phenyl}-5-mercaptotetrazole, 1-(4-nitrophenyl)-5-mercaptotetrazole, 5-(2-ethylhexanoylamino)-2-mercaptoimidazole), substituted or unsubstituted mercaptoazaindenes (e.g., 6-methyl-4-mercapto-1,3,3a,7-tetrazaindene, 6-methyl-2-benzyl-4-mercapto- 1,3,3a,7-tetrazaindene, 6-phenyl-4-mercaptotetrazaindene, 4,6-dimethyl-2-mercapto-1,3,3a,7-tetrazaindene), substituted or unsubstituted mercaptopyrimidines (e.g., 2-mercaptopyrimidine, 2-mercapto-4-methyl-6-hydroxypyrimidine, 2-mercapto-4-propylpyrimidine), heterocyclic compounds capable of producing imino silver such as substituted or unsubstituted benzotrizoles (e.g., benzotrizole, 5-nitrobenzotriazole, 5-methylbenzotriazole, 5,6-dichlorobenzotriazole, 5-bromobenzotriazole, 5-methoxybenzotriazole, 5-acetylaminobenzotraizole, 5-n-butylbenzotriazole, 5-nitro-6-chlorobenzotriazole, 5,6-dimethylbenzotriazole, 4,5,6,7-tetrachlorobenzotriazole), substituted or unsubstituted indazoles (e.g., 5-nitrobenzimidazole, 3-nitroindazole, 5-chloro-5-nitroindazole, 3-cyanoindazole, 3-n-butylcarbamoylindazole, 5-nitro-3-methanesulfonylindazole), and substituted or unsubstituted benzimidazole (e.g., 5-nitrobenzimidazole, 4-nitrobenzimidazole, 5,6-dichlorobenzimidazole, 5-cyano-6-chlorobenzimidazole, 5-trifluoromethyl-6-chlorobenzimidazole). Such a development inhibitor may be a compound which becomes a development inhibiting compound after being released from a redox nucleus in the general formula (I) upon relation following the redox reaction in the development. Such as development inhibiting compound may be further converted to a compound which exhibits substantially no or remarkably reduced development inhibiting effect.

If PUG is a diffusible or nondiffusible dye, examples of such dyes include azo dyes, azomethine dyes, azopyrazolone dyes, indoaniline dyes, indophenol dyes, anthraquinone dyes, triarylmethane, dyes, alizarin dyes, nitro dyes, quinoline dyes, indigo dyes, and phthalocyanine dyes. Other examples of such dyes include leuco compounds of these dyes, dyes whose absorption wavelength has been temporarily shifted, and dye precursors such as tetrazolium salts. These dyes may further form chelate dyes with proper metals.

Particularly preferred among these dyes are cyan, magenta and yellow dyes.

Examples of such yellow dyes include those described in U.S. Pat. Nos. 3,597,200, 3,309,199, 4,013,633, 4,245,038, 4,156,609, 4,139,383, 4,195,992, 4,148,641, 4,148,643, and 4,336,322 JP-A-51-114930, JP-A-56-71072, and *Research Disclosure,* Nos. 17,630 (1978), and 16,745 (1977).

Examples of such magenta dyes include those described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, JP-A-52-

106727, JP-A-53-23628, JP-A-55-36804, JP-A-56-73057, JP-A-56-71060, and JP-A-55-134.

Examples of such cyan dyes includes those described in U.S. Pat. Nos. 3,482,972, 3,929,760, 4,013,635, 4,268,625, 4,171,220, 4,242,435, 4,142,891, 4,195,994, 4,147,544, and 4,148,642, British Patent No. 1,551,138, JP-A-54-99431, JP-A-52-8827, JP-A-53-47823, JP-A-53-143323, JP-A-54-99431, JP-A-56-71061, European Patent Nos. 53,037 and 53,040, and *Research Disclosure*, Nos. 17,630 (1978) and 16,475 (1977).

Specific examples of a dye whose light absorption has been temporarily shifted in a light-sensitive element are described in U.S. Pat. Nos. 4,310,612, 3,336,287, 3,579,334, and 3,982,946, U.S. Def. Pub. No. 999,003, British Patent No. 1,467,317, and JP-A-57-158638.

Examples of silver halide solvents represented by PUG include mesoion compounds as described in JP-A-60-163042 and U.S. Pat. Nos. 4,003,910 and 4,378,424, and mercaptoazoles or azolethiones containing amino group as substituent as described in JP-A-57-202531. Specific examples of such compounds include those described in JP-A-61-230135.

Examples of nucleating agents represented by PUG include split-off groups released from couplers as described in JP-A-59-170840.

Other examples of PUG include those described in JP-A-61-230135, JP-A-62-215272 and U.S. Pat. No. 4,248,962.

Specific examples of compounds of the present invention will be shown hereinafter, but the present invention should not be construed as being limited thereto.

1.

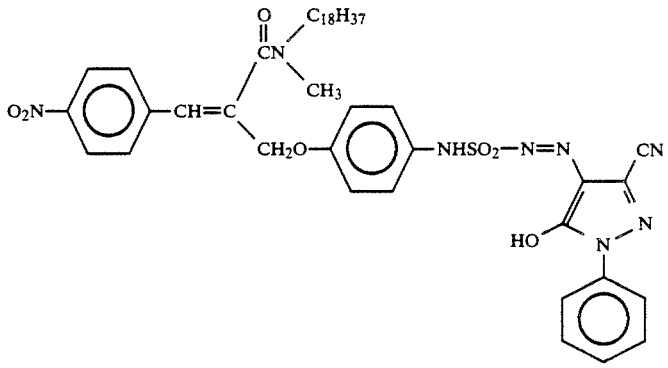

2.

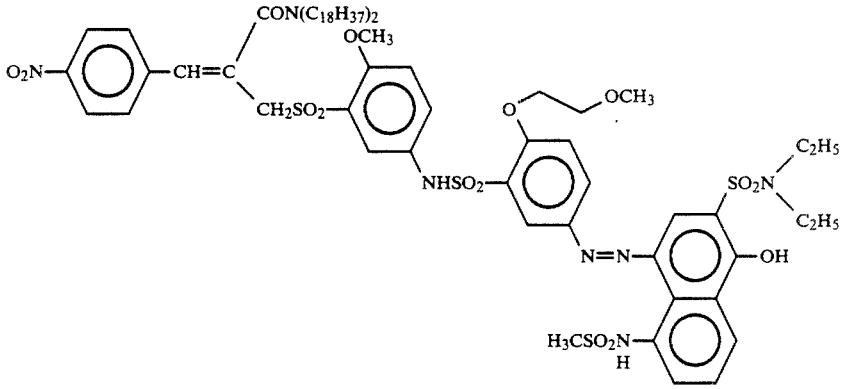

3.

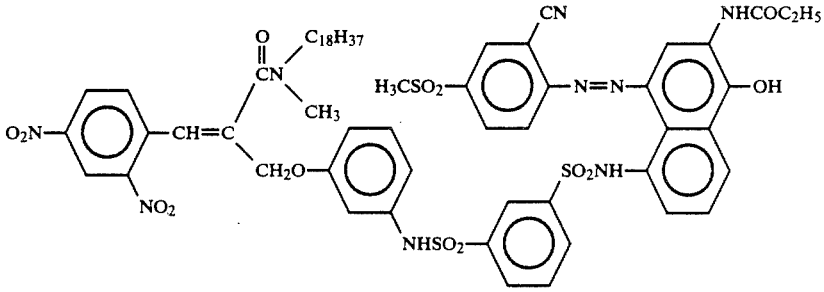

-continued
4.
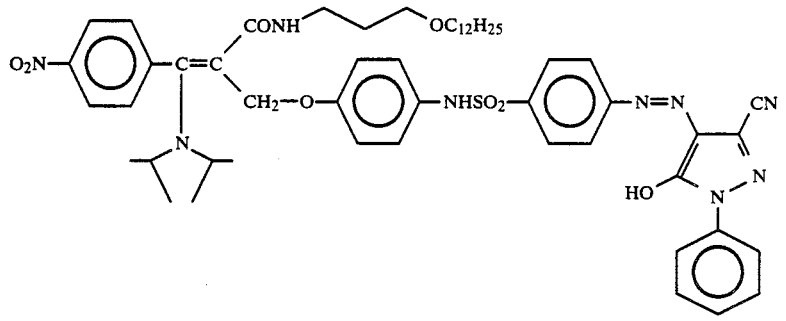
5.
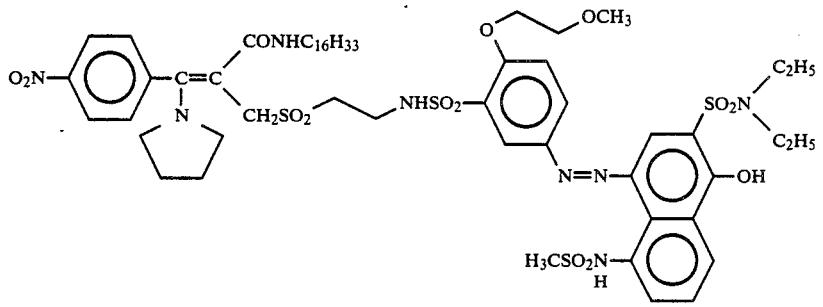
6.
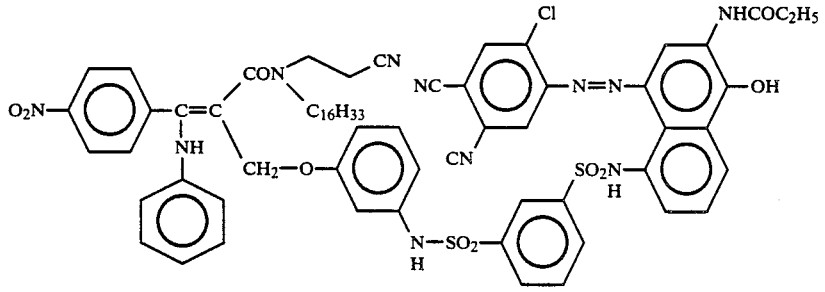
7.
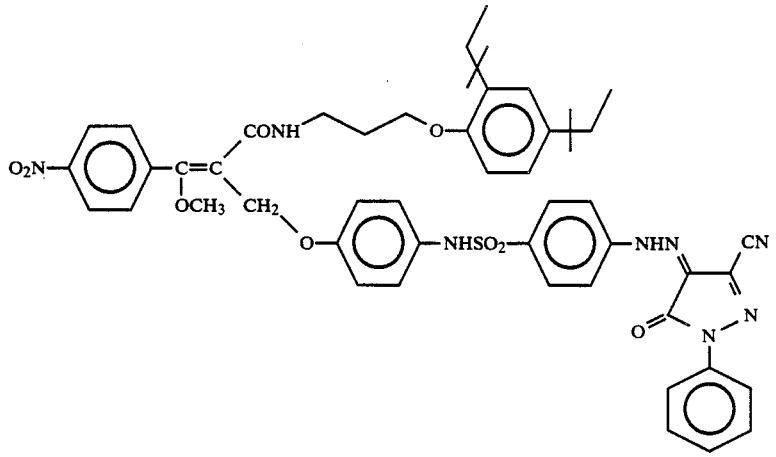

-continued
8.
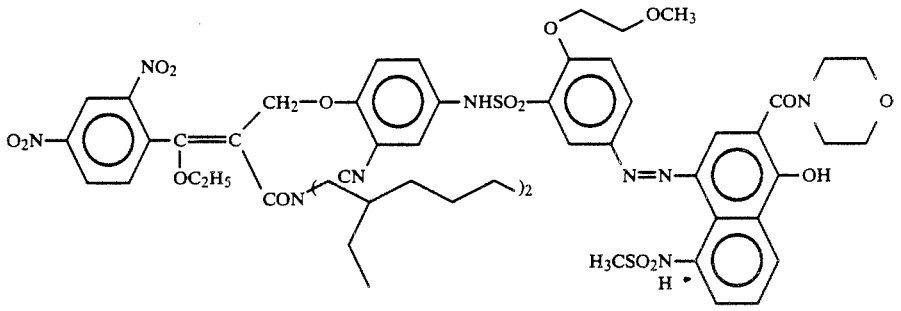
9.
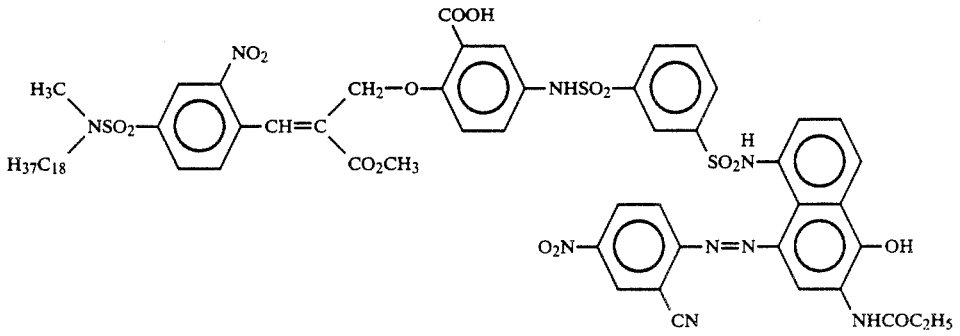
10.
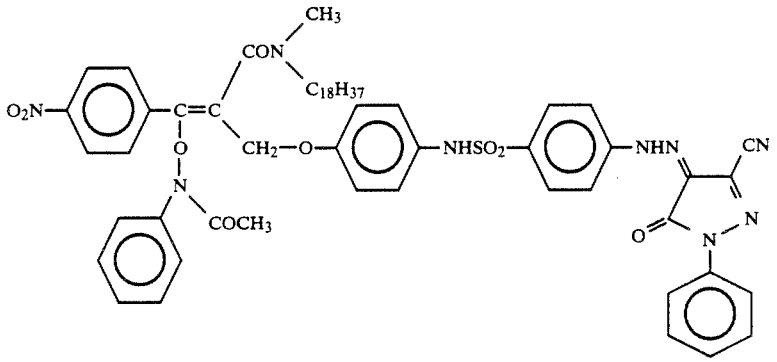
11.
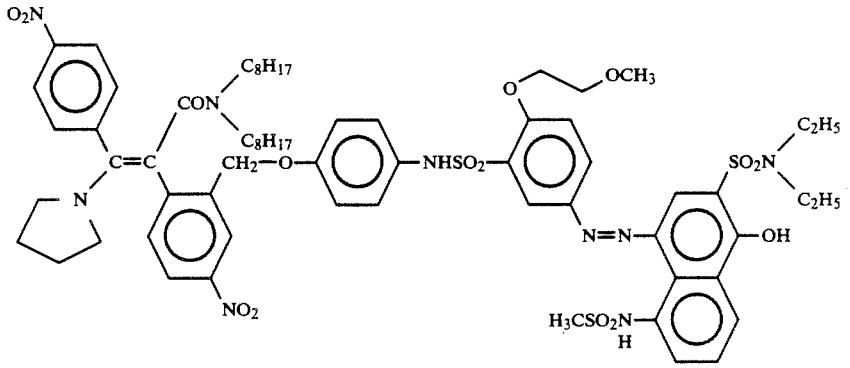

-continued
12.
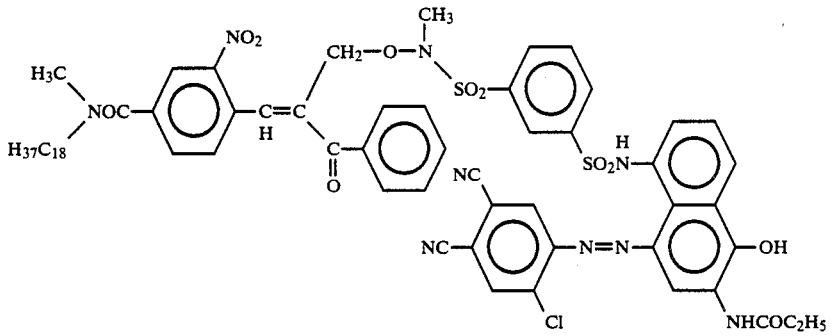
13.
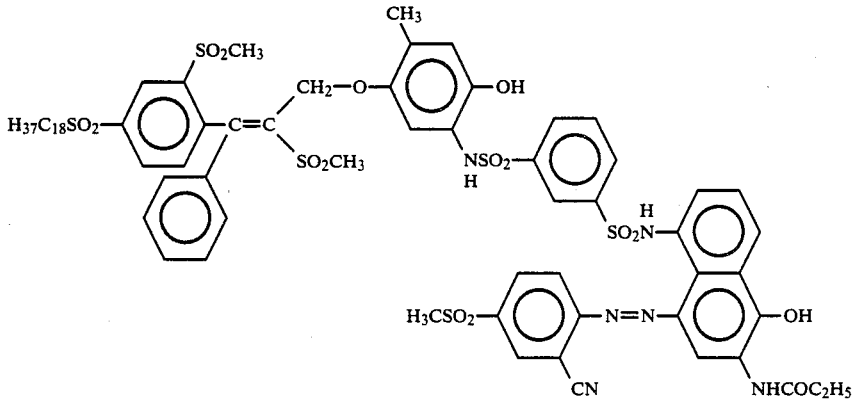
14.
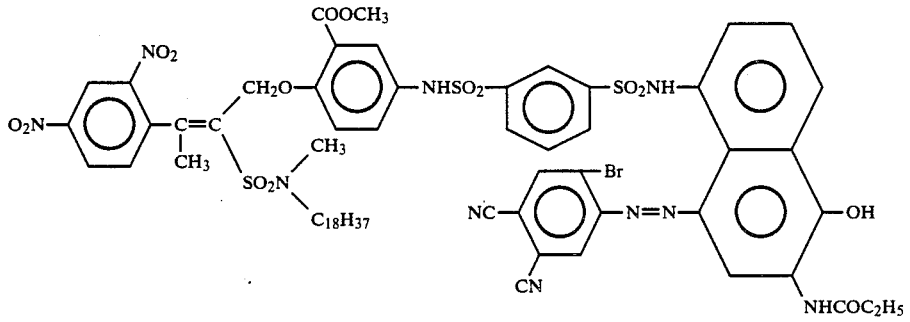
15.
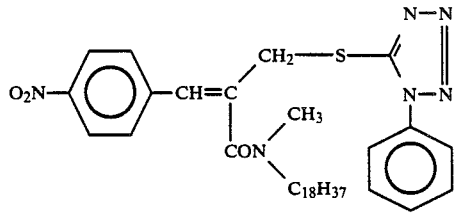
16.
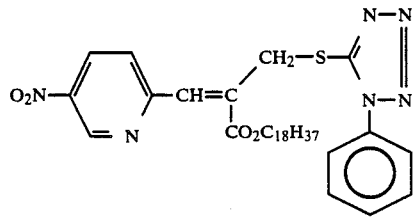

-continued
17.
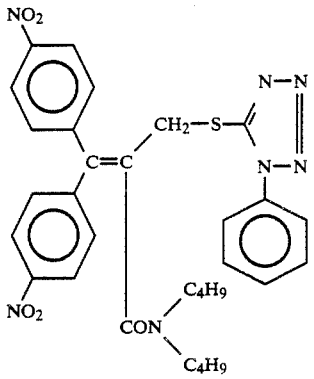
18.
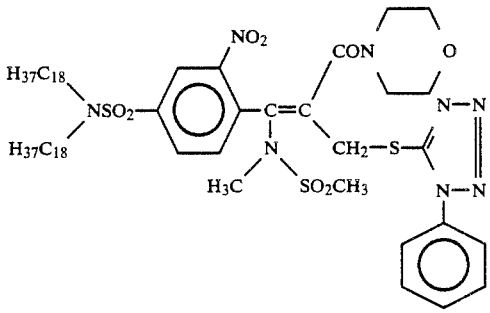
19.
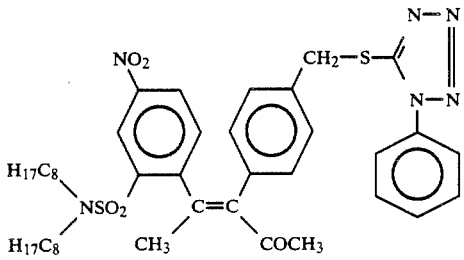
20.
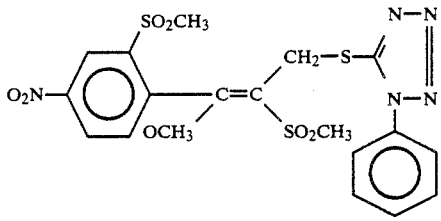
21.
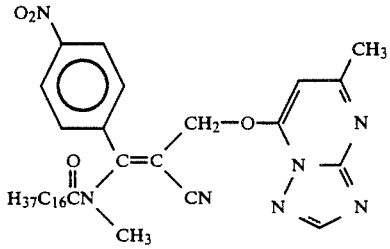

-continued
22.
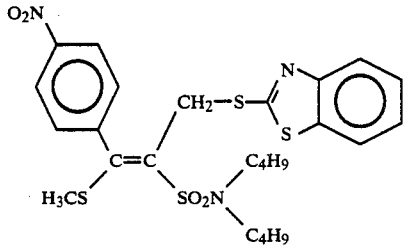
23.
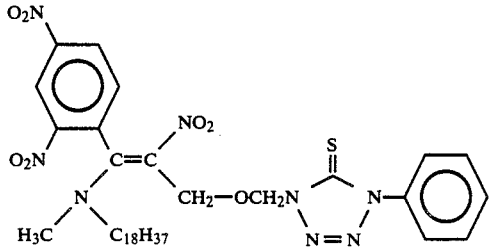
24.
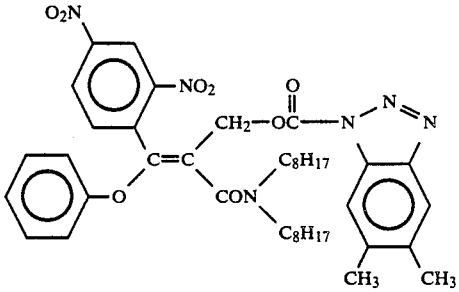
25.
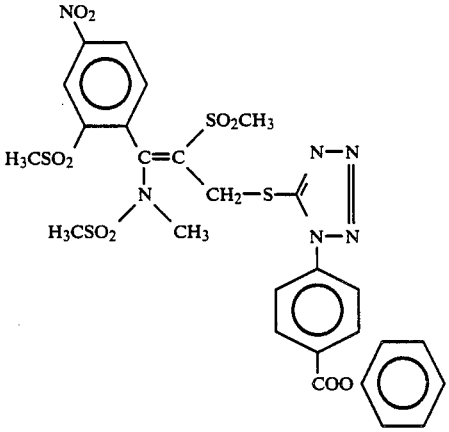
26.
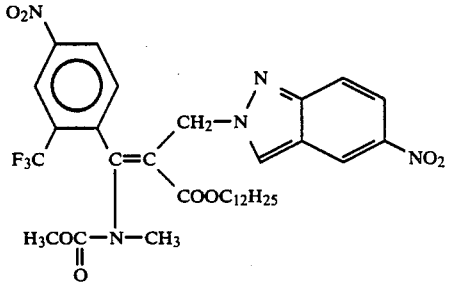

-continued
27.
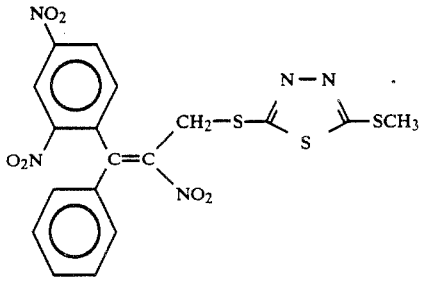
28.
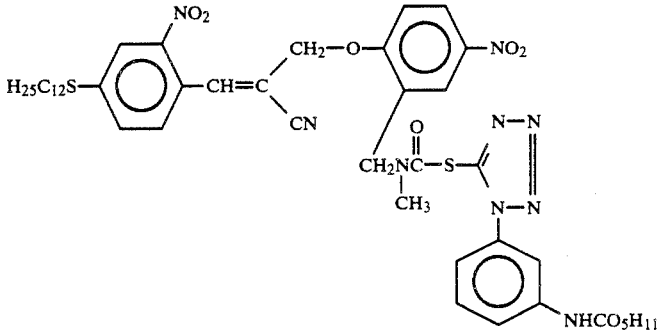
29.
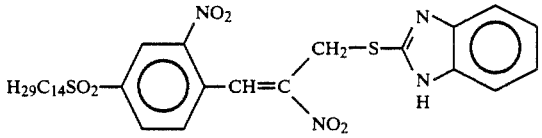
30.
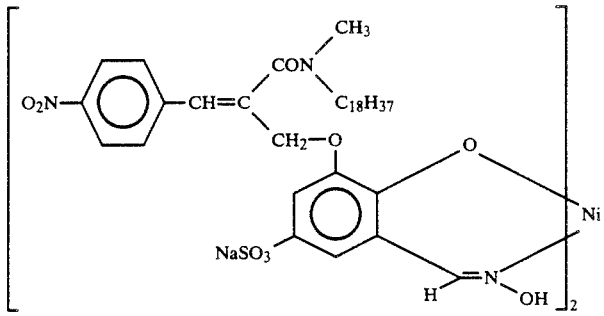
31.
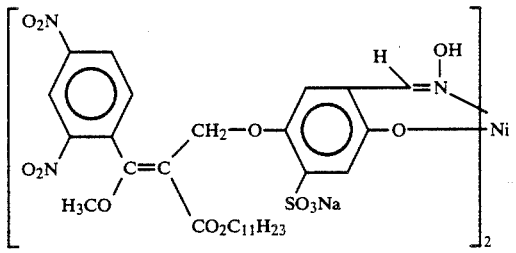
32.
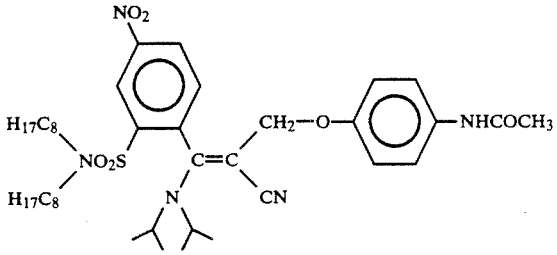

-continued
33.
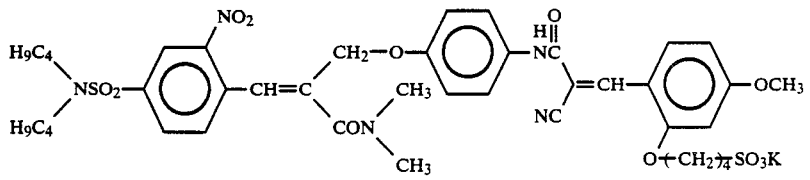
34.
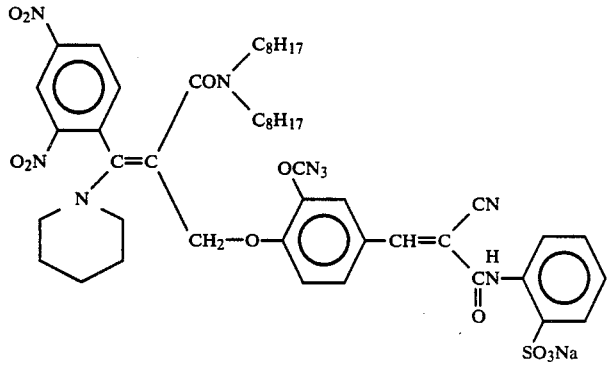
35.
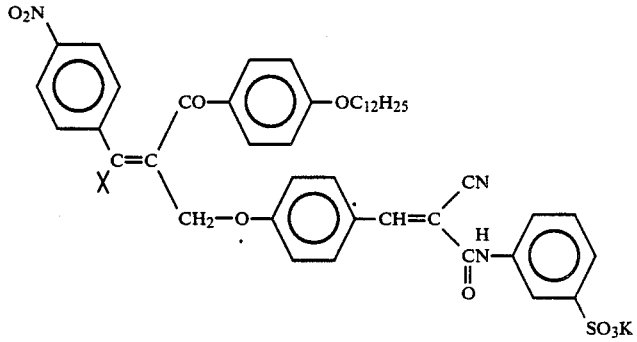
36.
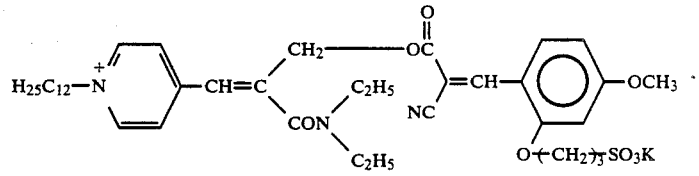
37.
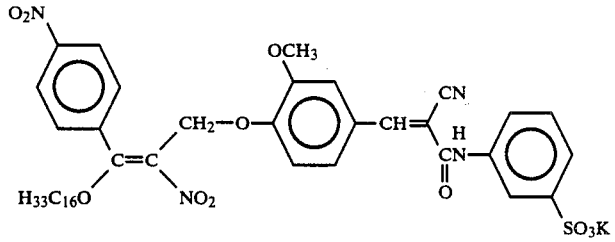
38.
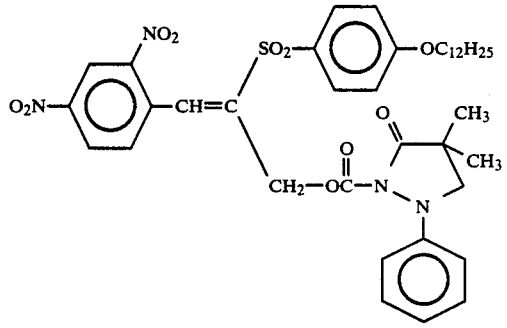

-continued
39.
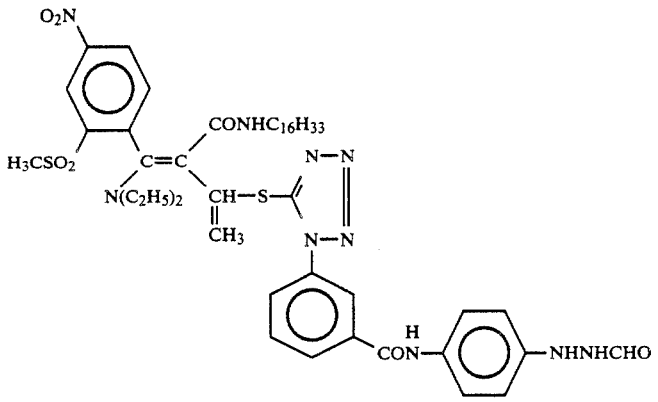
40.
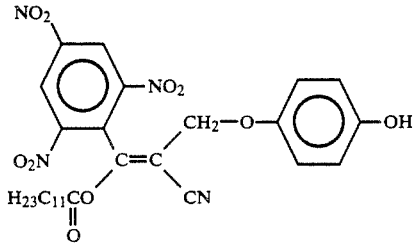
41.
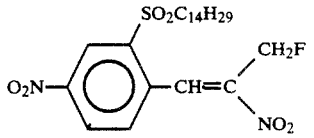
42.
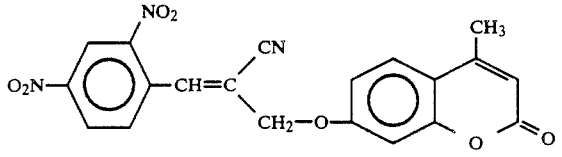
43.
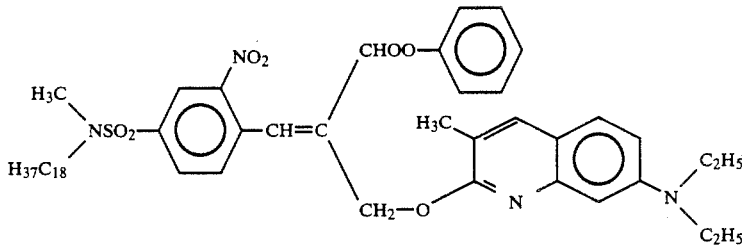
44.
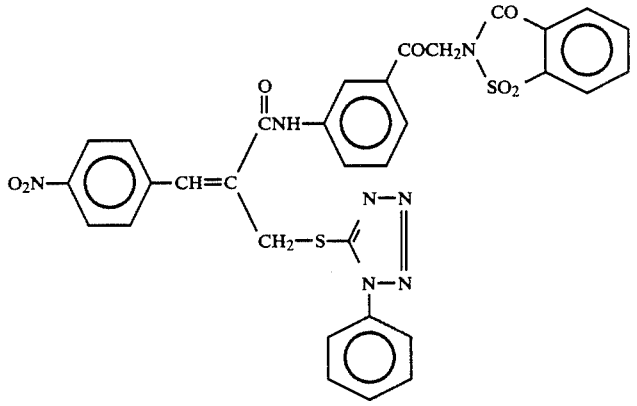

-continued
45.
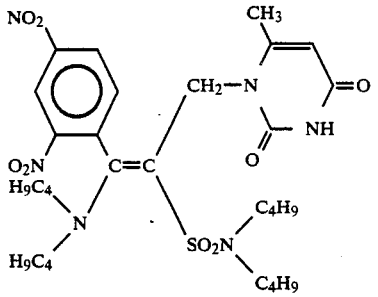
46.
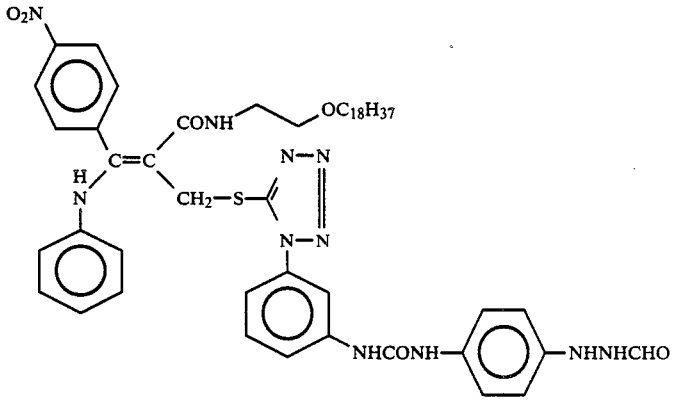
47.
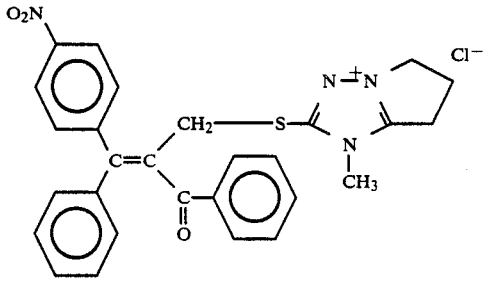
48.
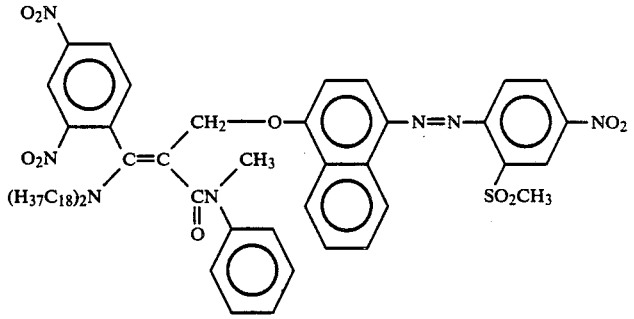
49.
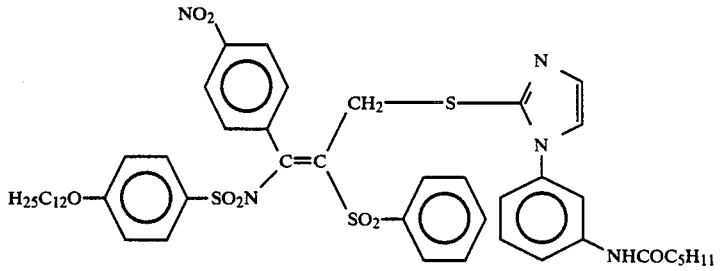

-continued

50.

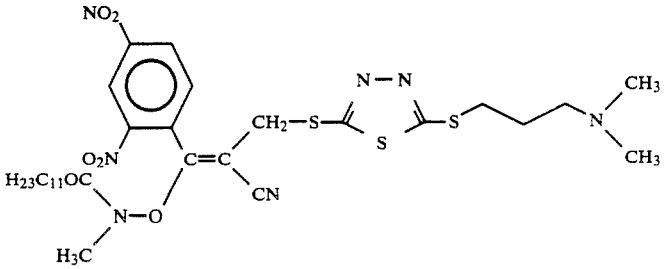

51.

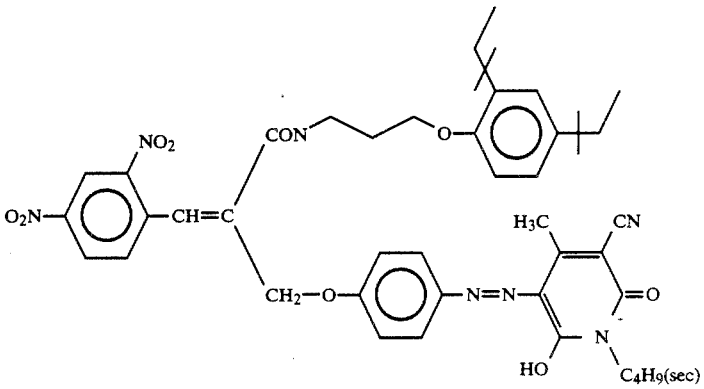

52.

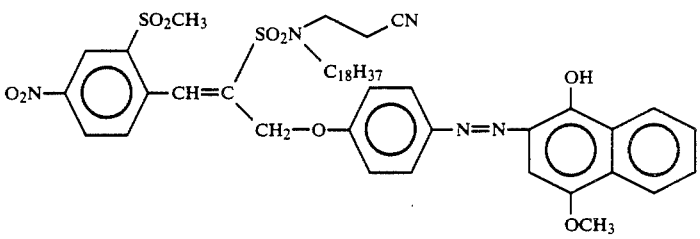

The key to the synthesis of the present compound is the synthesis of the olefin portion. Many approaches have heretofore been bound in connection with the synthesis of the olefin portion. Examples of these approaches include condensation reactions involving the production of a double bond, deformation, substitution and coupling reaction of compounds having a double bond, and reactions to introduce a double bond from saturated compounds.

Therefore, the introduction of various substituents can be accomplished by selecting a proper synthesis process.

Specific examples of these approaches can be referenced to *Methoden der Organischen Chemie* (Houben-Weyl) (1972), Vol. 5 (lb. alkene, cycloalkene, arylalkene), and *The Chemistry of Functional Groups* (PATAI) (The chemistry of alkenes).

Specific examples of such synthesis processes will be further described hereinafter.

SYNTHESIS EXAMPLE (synthesis of Compound 1)

Step 1: synthesis of α-methyl-4-nitrocinnamic acid 630 ml of pyridine was added to 76 g of 4-nitrobenzaldehyde (m.p. 105°-106.5° C.), 118 g of methylmalonic acid (prepared by hydrolysis of diethyl methylmalonate) and 85 g of piperidine. The mixture was heated with stirring over a steam bath for 24 hours. After being allowed to cool, the reaction mixture was then added to a mixture of 1,250 ml of concentrated hydrochloric acid and 2.5 kg of ice. The resulting oil content was then extracted with diethyl ether. The oil content was further extracted with a 5% aqueous solution of sodium hydroxide. The aqueous solution was then slightly acidified. The resulting crystal composition was then filtered off and dried. (Yield: 86 g (83%))

Step 2: synthesis of N-methyl-N-octadecyl-α-methyl-4-nitrocinnamic acid amide 30 g of thionyl chloride was added to 52 g of α-methyl-4-nitrocinnamic acid. The mixture was then heated with stirring for about 1 hour over a steam bath until the evolution of hydrogen chloride gas was completed. The mixture was further heated with stirring for 30 minutes, and then allowed to cool.

200 ml of benzene was added to the cooled mixture. A chloroform solution of 70 g of N-methyl-N-octadecylamine and 40 ml of triethylamine was gradually added dropwise to the solution at a temperature below room temperature. After the addition was completed, the solution was then stirred for 1 hour. The solution was then poured into ice water. The solution was then extracted with ethyl acetate. The extract was then washed with water, and dried with Glauber's salt. The solvent was then distilled off under reduced pressure. The resultant solution was then recrystallized from methanol. (Yield: 93 g (68%))

Step 3: synthesis of N-methyl-N-octadecyl-α-bromomethyl-4-nitrocinnamic acid amide 18 g of N-bromosuccinic acid imide and 0.5 g of benzoyl peroxide were added to a solution of 47 g of N-methyl-N-octadecyl-α-methyl-4-nitrocinnamic acid amide in 400 ml of carbon tetrachloride. The mixture was gradually heated from room temperature under reflux for about 1 hour. The mixture was heated under reflux for 10 hours while being irradiated with light from an incandescent lamp, and then allowed to cool. After the solvent was distilled off under reduced pressure, the residue was then subjected to silica gel column chromatography. The desired substance was obtained from a fraction extracted with a 1:2 mixture of hexane and ethyl acetate. (Yield: 23 g (42%))

Step 4: synthesis of N-methyl-N-octadecyl-α-(4-butoxycarbonylaminophenoxy)methyl-4-nitrocinnamic acid amide 20 g of N-methyl-N-octadecyl-α-bromomethyl-4-nitrocinnamic acid amide, 8 g of 4-t-butoxycarbonylaminophenol, 6 g of potassium carbonate, and 0.1 g of sodium iodide were mixed with 70 ml of acetone. The mixture was then heated under reflux for 5 hours.

After the reaction was completed, the acetone was distilled off. The resultant solution was then extracted with an ethyl acetate-water mixture. The ethyl acetate fraction was dried with Glauber's salt. The solvent was then distilled off under reduced pressure. The residue was then subjected to silica gel column chromatography to obtain the purified residue. (Yield: 19 g (77%))

Step 5: synthesis of N-methyl-N-octadecyl-α-(4-aminophenoxy)methyl-4-nitrocinnamic acid amide 10 g of N-methyl-N-octadecyl-α-(4-t-butoxycarbonylaminophenoxy)methyl-4-nitrocinnamic acid amide was dissolved in 50 ml of chloroform. The mixture was then cooled to a temperature of 0° C. or lower. 12 ml of trifluoroacetic acid wa gradually added dropwise to the mixture. The mixture was then stirred at room temperature for 10 hours. After the reaction was completed, the reaction mixture was neutralized with an aqueous solution of sodium bicarbonate. The neutralized mixture was then extracted with ethyl acetate. The extract was subjected to silica gel flash column chromatography. The desired substance was then obtained from a fraction extracted from a 1:1 mixture of ethyl acetate and hexane. (Yield: 5.4 g (63%))

Step 6: synthesis of Compound 1

5 g of N-methyl-N-octadecyl-α-(4-aminophenoxy)-methyl-4-nitrocinnamic acid amide was dissolved in 15 ml of dimethyl acetamide. The mixture was then cooled to a temperature of 0° C. 2 ml of pyridine was added dropwise to the reaction mixture. 3.4 g of Compound A* (illustrated below) was gradually added to the reaction mixture. After stirring at room temperature for 1 hour, the reaction mixture was then poured into water. The reaction mixture was then extracted with ethyl acetate. After being washed with water twice, the reaction mixture was washed with dilute hydrochloric acid and then with water. The resultant extract was then subjected to silica gel flash column chromatography. The desired substance was obtained from a fraction extracted from a 5:1 mixture of chloroform and ethyl acetate. The desired substance was then recrystallized from a 1:5 mixture of ethyl acetate and methanol. (Yield: 4.4 g (55%))

Compound A*

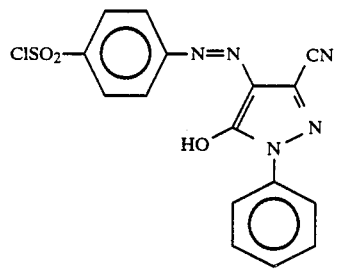

The present compound may be incorporated in the light-sensitive layer or other constituent layers such as protective layers, interlayers, filter layers, antihalation layers, and image receiving layers. Two compounds of the present invention having different photographically useful groups (PUG) may be used in combination. For example, a compound wherein PUG is a diffusible dye and a compound wherein PUG is a development inhibitor can be used in combination to provide a transfer dye image with an excellent S/N ratio.

The amount of the present compound incorporated in at least one layer, can vary widely. The preferred amount of the present compound to be used depends on the type of PUG. For example, if PUG is a diffusible dye, the amount of the present compound to be used depends on the extinction coefficient of dye but is normally in the range of 0.05 to 50 mmols/$m^2$, preferably 0.1 to 5 mmols/$m^2$. If PUG is a development inhibitor, the preferred amount of the present compound to be used is in the range of $1\times10^{-7}$ to $1\times10^{-1}$ mol, particularly $1\times10^{-3}$ to $1\times10^{-2}$ mol, per mol of silver halide. If PUG is a development accelerator or nucleating agent, the preferred amount of the present compound to be used is as specified above with reference to development inhibitor. If PUG is a silver halide solvent, the preferred amount of the present compound to be used is in the range of $1\times10^{-5}$ to $1\times10^{3}$ mols, particularly $1\times10^{-4}$ to $1\times10^{1}$ mols, per mol of silver halide.

The present compound receives electrons from a reducing substance to effect the release of the photographically useful group or its precursor. Therefore, a photographically useful group or its precursor can be uniformly released by allowing the reducing substance to uniformly act on the present compound. On the other hand, a photographically useful group or its precursor can be counter-imagewise released by imagewise oxidation of the reducing substance The photographically useful group may be such that it has the desired function before being released but loses it slightly or completely after being released rather than that it exhibits or increases the desired function after being released. Alternatively, the photographically useful group may be such that it elutes counter-imagewise due to a change in the properties such as an increase in the water solubility when released so that the present compound left acts imagewise on the light-sensitive material.

In other words, the present compound can act on silver development uniformly, counter imagewise or imagewise. Therefore, limitless applications are possible. Examples of possible applications will be described hereinafter. Various applications are summarized in Table A. However, the present invention should not be construed as being limited to these examples.

i. In the present compound, if the photographically useful group is a diffusible dye, the formation of a color image can be accomplished by the diffusion transfer process or a transfer process by sublimation. In this case, a negative emulsion can be used to provide a positive image. On the contrary, an autopositive emulsion can be used to provide a negative image.

ii. In the present compound, if the photographically useful group is a compound which is a colorless compound or a dye having a different absorption wavelength when bonded thereto but is colored or discolored after being released, the color thereof can be changed before or after the release of the photographically useful group. Therefore, this effect can be used to form a desired image.

iii. In the present compound, if the photographically useful group is a fog inhibitor, it is released more at the undeveloped portion than at the developed portion. Therefore, it is possible to effectively inhibit fog without any photographically undesired drop in sensitivity. In this case, either an autopositive emulsion or a negative emulsion can be used to obtain the same effect.

TABLE A

| | | Example of Photographic function | |
|---|---|---|---|
| No. | Type of PUG | Entire release | Release in counter-correspondence to AgX development |
| 1 | Image-forming dye | — | Positive-positive dye forming system |
| 2 | Photographic dye (antihalation etc.) | Colloidal silver for yellow filter alternative, dyeing of layers, improvement of color reproducibility, improvement of sharpness, sensitivity adjustment | Improvement of silver image tone, improvement of sharpness |
| 3 | UV absorber | Improvement of color reproducibility | Sensitivity adjustment, gradation adjustment |
| 4 | Fluorescent brightening agent | Improvement of whiteness in background, acceleration of desilvering | Improvement of S/N ratio by raising whiteness only in nonimage portion |
| 5 | Oxidation inhibitor | Stain inhibitor, discoloration inhibitor | Stain inhibition |
| 6 | Masking dye | — | Improvement of color reproducibility |
| 7 | Development inhibitor, fog inhibitor | $D_{min}$ reduction, stopping of development | Improvement of graininess, improvement of sharpness, dot gradation adjustment |
| 8 | Silver halide solvent | Acceleration of development | Improvement of sharpness |
| 9 | Development accelerator | Acceleration of development | Gradation adjustment, sensitivity adjustment |
| 10 | Nucleating agent | Acceleration of nucleation and development | Gradation adjustment |
| 11 | Fixing accelerator | Acceleration of fixing | Acceleration of fixing |
| 12 | Reducing agent | Color stain inhibition, development acceleration, gradation adjustment, graininess improvement | Color stain inhibition, graininess improvement, gradation adjustment |
| 13 | Silver image toner | Color toning | Color toning |
| 14 | Film improver | Development acceleration, silver image covering power improvement | Development acceleration |
| 15 | Toe cut agent | Contrast development | Gradation adjustment |
| 16 | Bleach accelerator | Bleach acceleration | Bleach acceleration |
| 17 | Discharging polymer | Dyeing of layers (colloidal silver for yellow filter alternative, anti-halation, irradiation inhibition, etc.) | Dye forming system |
| 18 | Polymer which elutes upon processing | Covering power improvement | Relief formation |

The present compound enables the above described applications. Furthermore, the present compound exhibits excellent properties as compared to the group of compounds heretofore known having the same function.

i. The present compound can release a photographically useful group at a sufficient rate even at temperatures of −20° C. or lower. The present compound shows little or no decomposition even at elevated temperatures. Therefore, the present compound can be used in an extremely wide temperature range. The present compound also can be used in all pH ranges which enable reduction reactions. The preferred temperature and pH ranges are −20° to +180° C. and 6.0 to 14.0, respectively, in the light of photographical practicality.

ii. The present compound is oxidizable. The present compound can stay completely stable while the light-sensitive material is stored in an oxidizing atmosphere. Therefore, the preservability of the light-sensitive material comprising the present compound is extremely excellent.

iii. Furthermore, the present compound is advantageous in that a compound produced by reduction upon processing, i.e., a reduction composition product of the present compound is chemically inert. This prevents undesired side-effects upon processing. This also prevents undesired effects on the photographic stability such as image stability.

The present compound and various additives described hereinafter may be incorporated in a hydrophilic colloid coating solution in the form of a solution in water or water-miscible organic solvent (if water-soluble). If the present compound or the additives are in the form of latex dispersion, they can be directly incorporated in the hydrophilic colloid coating solution. Furthermore, if they are oil-soluble high molecular weight compounds, they may be dispersed in the hydrophilic colloid coating solution by a commonly used dispersion process such as an oil dispersion process, Fischer dispersion process or polymer dispersion process. The dispersion of the material can be accomplished by a solid dispersion process without using any solvent.

Examples of suitable high boiling point organic solvents for oil dispersion process include phthalic acid alkyl esters (e.g., dibutyl phthalate, dioctyl phthalate), phosphoric acid esters (e.g., diphenyl phosphate, triphenyl phosphate, tricyclohexyl phosphate, tricresyl phosphate, dioctylbutyl phosphate), citric acid esters (e.g., tributyl acetylcitrate), benzoic acid esters (e.g., octyl benzoate), alkylamides (e.g., diethyl laurylamide), fatty acid esters (e.g., dibutoxyethyl succinate, dioctyl azelate), trimesic acid esters (e.g., tributyl trimesate), carboxylic acids as described in JP-A-63-85633, compounds as described in JP-A-59-83154, JP-A-59-178451, JP-A-59-178452, JP-A-59-17853, JP-A-59-178454, JP-A-59-178455, and JP-A-59-178457, and nondiffusible carboxylic acid derivatives represented by the general formula (a).

$$(R_1\text{—}COO^-)_nM^{n+} \qquad \text{(a)}$$

wherein $R^1$ represents a substituent which renders the compound of the general formula (I) nondiffusible; $M^{n+}$ represents a hydrogen ion, metal ion or ammonium ion; and n represents an integer 1 or 4.

The group represented by $R^1$ which renders the compound of the general formula (a) nondiffusible contains 8 to 40 carbon atoms, preferably 12 to 32 carbon atoms.

Specific examples of the group represented by $R^1$ are illustrated below.

(a-1)

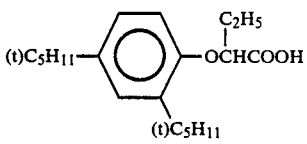

(a-2)

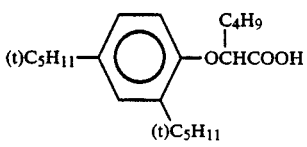

(a-3)

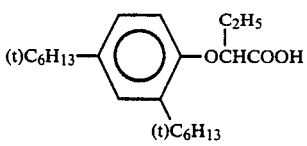

$C_{17}H_{35}COO^-NH_4^+$ (a-4)

(a-5)

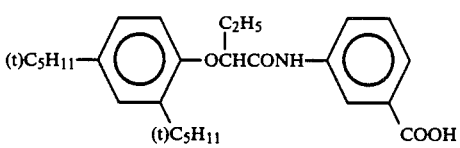

(a-6)

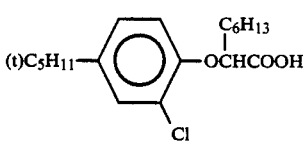

(a-7)

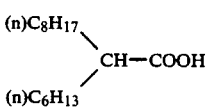

(a-8)

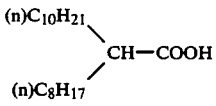

-continued (a-9)

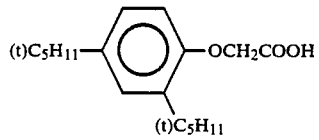

(a-10)

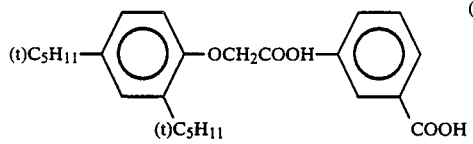

(a-11)

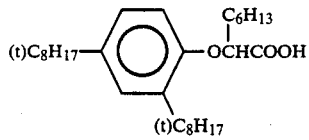

An organic solvent having a boiling point of about 30° to 160° C. such as lower alkyl acetates (such as ethyl acetate or butyl acetate), ethyl propionate, secondary butyl alcohol, methyl isobutyl ketone, β-ethoxyethyl acetate, methyl cellusolve acetate, and cyclohexanone may be used instead of or in combination with the above described high boiling organic solvent. Furthermore, after dispersion, the low boiling organic solvent may be optionally removed by ultrafiltration.

On the other hand, the solid dispersion process comprises grinding the above described compound into finely divided particles and then dispersing them in a hydrophilic colloid. The grinding of the compound may be accomplished by means of a known type of mill (grinding machine). The shearing force of the machine must be enough to grind the material into particles of necessary size in a proper period of time. Examples of suitable processing methods and mills are described in U.S. Pat. Nos. 2,581,414 and 2,855,156 and JP-A-52-110012.

The reducing substance which is used to release PUG from the present compound may be an inorganic compound or an organic compound. The oxidation potential of such a compound is preferably lower than the standard redox potential of silver ion/silver (0.80 V).

Examples of inorganic reducing compounds include metals having an oxidation potential of 0.8 V or lower such as Mn, Ti, Si, Zn, Cr, Fe, Co, Mo, Sn, Pb, W, $H_2$, Sb, Cu, and Hg, ions or its complex compounds having an oxidation potential of 0.8 V or lower such as $Cr^{2+}$, $V^{2+}$, $Cu^{+}$, $Fe^{2+}$, $MnO_4^{2-}$, $I^-$, $Co(CN)_6^{4-}$, $Fe(CN)_6^{4-}$, $(Fe\text{-}EDTA)^{2-}$, metallic hydrides having an oxidation potential of 0.8 V or lower such as NaH, LiH, KH, $NaBH_4$, $LiBH_4$, $LiAl(O\text{-}t\text{-}C_4H_9)_3H$, and $LiAl(OCH_3)_3H$, and sulfur or phosphorus compounds having an oxidation potential of 0.8 V or lower such as $Na_2SO_3$, NaHS, $NaHSO_3$, $H_3P$, $H_2S$, $Na_2S$ and $Na_2S_2$.

Suitable organic reducing substances include organic nitrogen compounds such as alkylamines or arylamines, organic sulfur compounds such as alkylmercaptans or arylmercaptans and organic phosphorus compounds such as alkyl phosphines or aryl phosphines. A silver halide reducing agent which follows Kendal-Pelz equation as described in James, *The Theory of the Photo-*

*graphic Process*, 4th ed., (1977), p. 299 may be preferably used in the present invention.

Preferred examples of reducing agents include 3-pyrazolidones and precursors thereof (e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3 -pyrazolidone, 1-(3-tolyl)-3-pyraxolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, 1-phenyl-3-acetoxypyrazolidone), and hydroquinones and precursors thereof (e.g., hydroquinone, toluhydroquinone, 2,6-dimethylhydroquinone, t-butylhydroquinone, 2,5-di-t-butylhydroquinone, t-octylhydroquinone, 2,5-di-t-octylhydroquinone, pentadecylhydrouinone, sodium 5-pentadecylhydroquinone-2-sulfonate, p-benzoyloxyphenol, -methyl-4-benzoyloxyphenol, 2-t-butyl-4-(4-chlorobenzoyloxy)-phenol).

Other useful examples of silver halide reducing agents include color developing agents. p-Phenylene color developing agents such as N,N-diethyl-3-methyl-p-phenylenediamine are described in U.S. Pat. No. 3,531,286. Further, other useful reducing agents include aminophenols which are described in U.S. Patent 3,761,270. Particularly useful among these aminophenol reducing agents are 4-amino-2,6-dichlorophenol, 4-amino-2,6-dibromophenol, 4-amino-2-methylphenol sulfate, 4-amino-3-methylphenol sulfate, and 4-dichlorophenol hydrochloride. Further useful examples of silver halide reducing agents include 2,6-dichloro-4-substituted sulfonamidophenols, and 2,6-dibromo 4-substituted sulfonamidophenols as described in *Research Disclosure* No. 15,108, and U.S. Pat. No. 4,021,240, and p-(N,N-dialkylaminophenol)sulfamines as described in JP-A-59-16740. Besides the above described phenolic reducing agents, naphtholic reducing agents such as 4-aminonaphthol derivatives and 4-substituted sulfonamidonaphthol derivatives as described in JP-A-61-259253 are particularly useful. Examples of ordinary color developing agents which can be used include aminohydroxypyrazole derivatives as described in U.S. Pat. No. 2,895,825, aminopyrazoline derivatives as described in U.S. Pat. No. 2,892,714, and hydrazone derivatives as described in Research Disclosure, Nos. 19,412 and 19,415 (June 1980), pp. 227–230, 236–240. These color developing agents may be used singly or in combination.

If a nondiffusible reducing substance (electron donor) is incorporated in a light-sensitive material, an electron transfer agent (ETA) may be preferably used in combination with said reducing substance to accelerate the transfer of electrons between said reducing substance and a developable silver halide emulsion. The electron donor and/or the electron transfer agent may be used in the form of their precursors. Alternatively, the electron donor and the electron transfer agent may be used in combination with their precursors.

A suitable electron donor is a compound represented by the general formula (C) or (D).

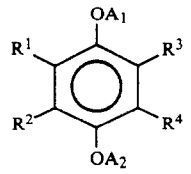

(C)

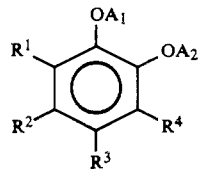

(D)

wherein $A^1$ and $A^2$ each represents hydrogen atOm or a phenolic hydroxyl group a protective group which can be protected from elimination by a nucleophilic reagent.

Examples of such nucleophilic reagents include anionic reagents such as $OH^-$, $RO^-$ (in which R represents an alkyl or aryl group), hydroxamic acid anions, and $SO_3^{2-}$, and compounds having nonpaired electrons such as primary or secondary amines, hydrazine, hydroxylamines, alcohols, and thiols. Preferred examples of $A^1$ and $A^2$ include hydrogen atom, acyl group, alkylsulfonyl group, arylsulfonyl group, alkoxycarbonyl group, aryloxycarbonyl group, dialkylphosphoryl group, diarylphosphoryl group, and protective groups as described in JP-A-59-197037 and JP-A-59-20105. $A^1$ and $A^2$ may be connected to $R^1$, $R^2$, $R^3$ and $R^4$ to form a ring if possible. $A^1$ and $A^2$ may be the same or different.

$R^1$, $R^2$, $R^3$ and $R^4$ each represents hydrogen atom or an alkyl group (e.g., an alkyl group which may be substituted, such as methyl group, ethyl group, n-butyl group, cyclohexyl group, n-octyl group, allyl group sec-octyl group, tert-octyl group, n-dodecyl group, n-pentadecyl group, n-hexadecyl group, tert-octadecyl group, 3-hexadecanoylaminophenylmethyl group, 4-hexadecylsulfonylaminophenylmethyl group, 2-ethoxycarbonylethyl group, 3-carboxypropyl group, N-ethylhexadecylsulfonylaminomethyl group, N-methyldodecylsulfonylaminoethyl group), aryl group (e.g., an aryl group which may be substituted, such as phenyl group, 3-hexadecyloxyphenyl group, 3-methoxyphenyl group, 3-sulfophenyl group, 3-chlorophenyl group, 2-carboxyphenyl group, 3-dodecanoylaminophenyl group), alkylthio group (e.g., an alkylthio group which may be substituted, such as n-butylthio group, methylthio group, tert-octylthio group, n-dodecylthio group, 2-hydroxyethylthio group, n-hexadecylthio group, 3-ethoxycarbonylpropiothio group), arylthio group (e.g., an arylthio group which may be substituted, such as phenylthio group, 4-chlorophenylthio group, 2-n-octyloxy-5-t-butylphenylthio group, 4-dodecyloxyphenylthio group, 4-hexadecanonylaminophenylthio group), sulfonyl group (e.g., an aryl or alkylsulfonyl group which may be substituted, such as methanesulfonyl group, butanesulfonyl group, p-toluenesulfonyl group, 4-dodecyloxyphenylsulfonyl group, 4-acetylaminophenylsulfonyl group), sulfo group, halogen atom (e.g., fluorine, chlorine, bromine, iodine), cyano group, carbamoyl group (e.g., a carbamoyl group which may be substituted, such as methylcarbamoyl group, diethylcarbamoyl group, 3-(2,4-di-t-pentylphenyloxy)propylcarbamoyl group, cyclohexylcarbamoyl group, di-n-octylcarbamoyl group), sulfamoyl group (e.g., a sulfamoyl group which may be substituted, such as diethylsulfamoyl group, di-n-octylsulfamoyl group, n-hexadecylsulfamoyl group, 3-isohexadecanoylaminophenylsulfamoyl group), amido group (e.g., an amido group which may be substituted, such as acetamido group, isobutyloylamino group, 4-tetradecyloxyphenylbenzamido group, 3-hexadecanoylaminobenzamido group), imido group (e.g., an imido group which may be substituted, such as succinimido group, 3-laurylsuccinimido group, phthalimido group), carboxyl group, and sulfonamido group (e.g., a sulfonamido group which may be substituted, such as methanesulfonamido group, octanesulfonamido group, hexadecanesulfonamido group, benzenesulfonamido group, toluenesulfonamido group, 4-lauryloxybenzenesulfonamido group).

The total number of carbon atoms contained in $R^1$ to $R^4$ is 8 or more. In the general formula (C), $R^1$ and $R^2$ and/or $R^3$ and $R^4$ may be connected to each other to form a saturated or unsaturated ring. In the general formula (D) $R^1$ and $R^2$, $R^2$ and $R^3$ and/or $R^3$ and $R^4$ may be connected to each other to form a saturated or unsaturated ring.

Preferred among electron donors represented by the general formula (C) or (D) is an electron donor wherein at least two of $R^1$ to $R^4$ are substituents other than hydrogen atom. A particularly preferred compound is an electron donor wherein at least one of $R^1$ and $R^2$ is a substituent other than hydrogen atom and at least one of $R^3$ and $R^4$ is a substituent other than hydrogen atom.

A plurality of electron donors may be used in combination. Alternatively, electron donors may be used in combination with their precursors. The electron donor may be the same compound as the reducing substance of the present invention.

Specific examples of electron donors will be shown hereinafter, but the present invention should not be construed as being limited thereto.

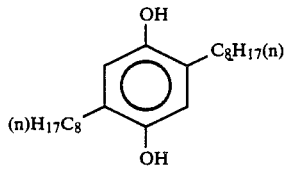

(ED-1)

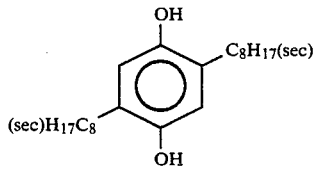

(ED-2)

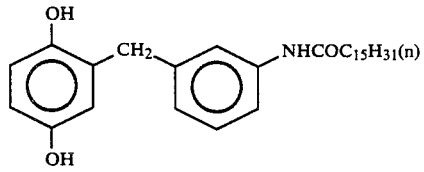

(ED-3)

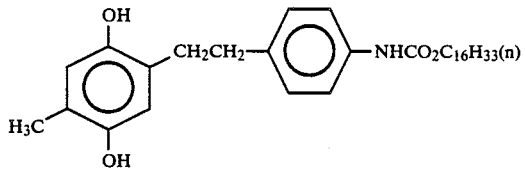

(ED-4)

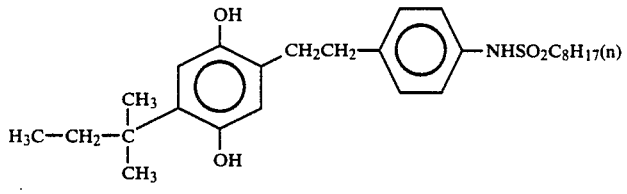

(ED-5)

-continued (ED-6)

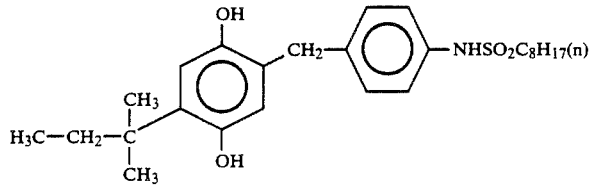

(ED-7)

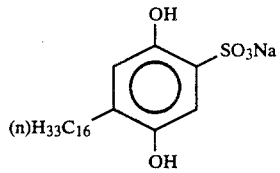

(ED-8)

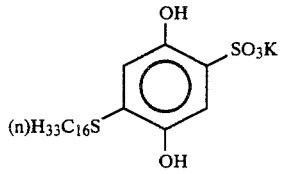

(ED-9)

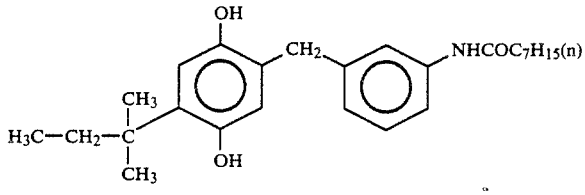

(ED-10)

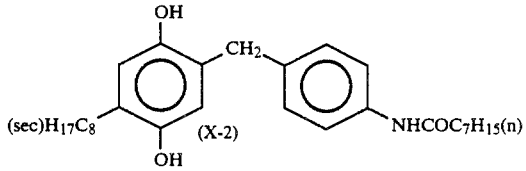

(ED-11)

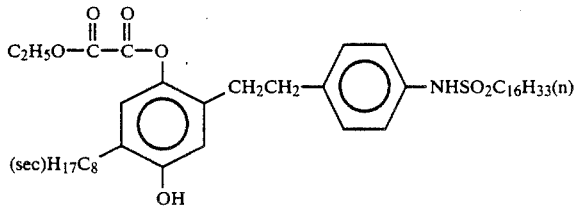

(ED-12)

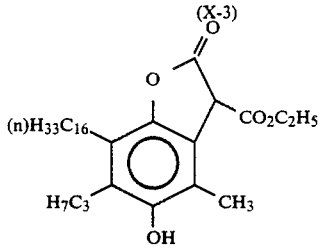

For the purpose of improving the storage stability, these electron donors may be oxidized prior to their incorporation into the light-sensitive material.

The amount of the electron donor (or its precursor) used can vary widely. Preferably, the amount used is in the range of 0.01 to 50 mols, particularly 0.1 to 5 mols, per mol of positive dye-providing substance and of 0.001 to 5 mols, preferably 0.01 to 1.5 mols, per mol of silver halide, respectively.

Regarding the ETA for use in combination with these electron donors, any compound which undergoes oxidation by silver halide to give an oxidation product which is capable of cross-oxidizing these electron donors may be used. Mobile compounds may be preferably used.

A particularly preferred ETA compound is represented by the general formula (X-I) or (X-II):

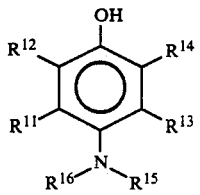

[X-I]

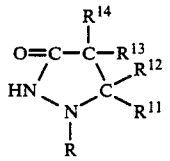

[X-II]

wherein R represents an aryl group; and $R^{11}$, $R^{12}$, $R^{13}$, $R^{14}$, $R^{15}$ and $R^{16}$ may be the same or different and each represents hydrogen atom, a halo9en atom, an acylamino group, an alkoxy group, an alkylthio group, an alkyl group or an aryl group.

Examples of aryl groups represented by R in the general formula (X-II) include phenyl group naphthyl group, tolyl group and xylyl group. These groups may be substituted by a halogen atom (e.g., chlorine, bromine), an amino group, an alkoxy group, an aryloxy group, hydroxyl group, an aryl group, a carbonamido group, a sulfonamido group, an alkanoyloxy group, a benzoyloxy group, a ureido group, a carbamate group, a carbamoyloxy group, a carbanate group, a carboxyl group, a sulfo group, or an alkyl group (e.g., methyl group, ethyl group, propyl group).

The alkyl group represented by $R^{11}$, $R^{12}$, $R^{13}$, $R^{14}$, $R^{15}$ and $R^{16}$ in the general formulas (X-I) and (X-II) is a $C_{1-10}$ alkyl group such as methyl group, ethyl group, propyl group, and butyl group. These alkyl groups may be substituted by hydroxyl group, an amino group, a sulfo group, or a carbonyl group. As the suitable aryl groups for use in the present invention include phenyl group, naphthyl group, xylyl group, and tolyl group. These aryl groups may be substituted by a halogen atom (e.g., chlorine, bromine), an alkyl group (e.g., methyl group, ethyl group, propyl group), a hydroxyl group, an alkoxy group (e.g., methoxy group, ethoxy group), a sulfo group, or a carboxyl group. In the present invention, a compound represented by the general formula (X-II) is particularly preferred. Preferably, in the general formula (X-II), $R^{11}$, $R^{12}$, $R^{13}$, and $R^{14}$ each represents hydrogen atom, a $C_{1-10}$ alkyl group, a $C_{1-10}$ substituted alkyl group, or a substituted or unsubstituted aryl group. More preferably, $R^{11}$, $R^{12}$, $R^{13}$, and $R^{14}$ each represents hydrogen atom, methyl group, hydroxymethyl group, phenyl group, or a phenyl group substituted by a hydrophilic group such as a hydroxyl group, an alkoxy group, a sulfo group, and a carboxyl group.

Specific examples of compounds represented by the general formula (X-II) will be shown hereinafter.

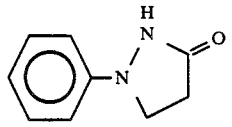

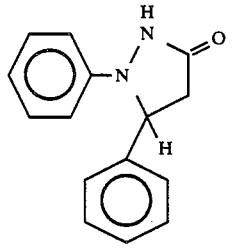

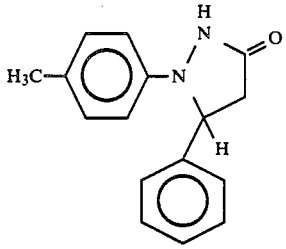

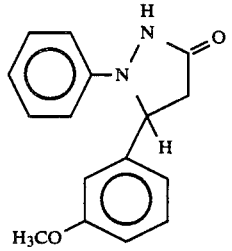

-continued

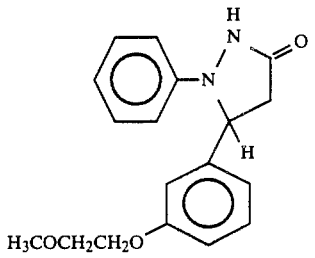

(X-5)

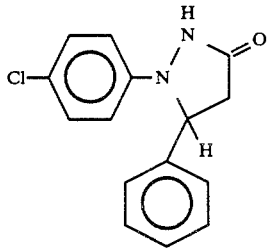

(X-6)

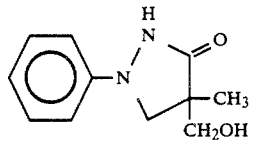

(X-7)

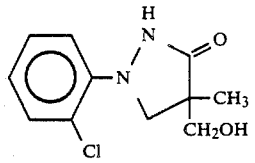

(X-8)

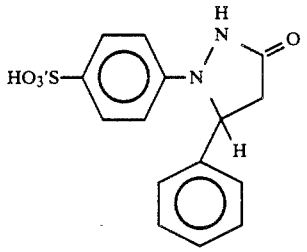

(X-9)

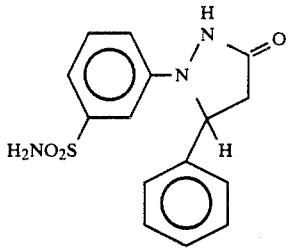

(X-10)

The ETA precursor for use in the present invention is a compound which has no developing effect during storage of the light-sensitive material prior to its use but releases ETA only when acted upon by a proper activator such as a base or nucleophilic agent, or heating.

Particularly, the ETA precursor for use in the present invention doesn't serve as ETA before development because its reactive functional group is blocked by a blocking group. The ETA precursor can serve as ETA only when subjected to an alkaline condition or heated so that the blocking group cleaves. Examples of ETA precursors which can be used in the present invention include 2- or 4-acyl derivatives or 2-aminoalkyl or hydroxylalkyl derivatives of 1-phenyl-3-pyrazolidinone, hydroquinone, metallic salts of catechol (e.g., lead, cadmium, calcium, or barium salts), halogenated acyl derivatives of hydroquinone, oxazine or bisoxazine derivatives of hydroquinone, lactone type ETA precursors, hydroquinone derivatives containing a quaternary ammonium group, cyclohexakis-2-en-1,4-dione type compounds, compounds which undergo electron transfer reaction to release ETA, compounds which undergo intramolecular nucleophilic displacement reaction to release ETA, ETA precursors blocked by phthalido group, and ETA precursors blocked by indomethyl group.

ETA precursors for use in the present invention include known compounds. Suitable known ETA precursor compounds include the developing agent precursors described in U.S. Pat. Nos. 3,241,967, 3,246,988, 3,295,978, 3,462,266, 3,586,506, 3,615,439, 3,650,749, 4,209,580, 4,330,617, and 4,310,612, British Patent Nos. 1,023,701, 1,231,830, 1,258,924, and 1,346,920, JP-A-57-40245, JP-A-58-1139, JP-A-58-1140, JP-A-59-178458, JP-A-59-182449, and JP-A-59-182450.

Particularly preferred among these compounds are precursors of 1-phenyl-3-pyrazolidinones as described in JP-A-59-178458, JP-A-59-182449, and JP-A-59-182450.

The present light-sensitive material is suitable for use as a so-called conventional light-sensitive material which is developed at near normal temperatures with a developing solution, or as a heat developable light-sensitive material.

If the present light-sensitive material is used as a conventional light-sensitive material, the combination of a reducing substance or electron donor and/or its precursor and ETA and/or its precursor can be utilized with the light-sensitive material by a process in which the combination is supplied to the light-sensitive material in the form of a developing solution during development, or a process in which the electron donor and/or its precursor is incorporated in the light-sensitive material and ETA and/or its precursor is supplied to the light-sensitive material in the form of a developing solution. In the former case, the preferred amount of the combination to be used is in the range of 0.001 to 1 mol/l as calculated in terms of total liquid concentration. In the latter case, the preferred amount of the electron donor and/or its precursor to be used is in the range of 0.01 to 50 mol per mol of the present compound, and the preferred amount of ETA and/or its precursor to be used is in the range of 0.001 to 1 mol/l as calculated in terms of liquid concentration.

If the present light-sensitive material is used as a heat developable light-sensitive material, an electron donor and/or its precursor and ETA and/or its precursor may be preferably incorporated in the light-sensitive material.

The electron donor and/or its precursor and ETA and/or its precursor may be incorporated in the same or different layers. These reducing agents may be incorporated in the same layer as or in a different layer from the present compound. A diffusible electron donor and/or its precursor may be preferably incorporated in the same layer as the present compound. ETA and/or its precursor may be incorporated in an image receiving material (dye fixing material). Alternatively, if a slight amount of water is present during heat development, ETA and/or its precursor may be dissolved in the water. The preferred total amount of these reducing agents to be used is in the range of 0.01 to 50 mols, particularly 0.1 to 5 mols, per mol of the present compound, or 0.001 to 5 mols, particularly 0.01 to 1.5 mols, per mol of silver halide.

The amount of ETA and/or its precursor to be used is in the range of 60 mol % or less, preferably 40 mol % or less, based on the total amount of the reducing agents. If ETA and/or its precursor is supplied in the form of an aqueous solution, its concentration is preferably in the range of $10^{-4}$ mol/l to 1 mol/l.

If the reducing agents are incorporated in the light-sensitive material as described above, a measure is preferably taken to prevent the present compound and these reducing agents from reacting with each other during storage, thus improving the preservability of the light-sensitive material. One of the measures is to use a precursor of a reducing agent (e.g., electron donor precursor or oxidation product thereof or ETA precursor) as described above. Another possible measure is to isolate the present compound from at least part of the reducing substance by microencapsulation. In this measure, the following embodiments can be used.

| | Contents inside Microcapsule | Contents outside Microcapsule |
|---|---|---|
| A | Present compound | Reducing agent |
| B | Reducing agent | Present compound |
| C | Reducing agent | Present compound + reducing agent |
| D | Present compound + reducing agent | Reducing agent |

If a plurality of reducing agents are used, only specific reducing agents may be isolated from the present compound by the wall of microcapsules or at least part of each reducing agent may be isolated from the present compound by the wall of microcapsules. Particularly, nondiffusible reducing agents (e.g., above described electron donors) are preferably isolated from the present compound by the wall of microcapsules. In order to accelerate the diffusion of released photographically useful group (e.g., dye), the present compound is preferably present outside microcapsules.

The light-sensitive silver halide, binder and various additives as described later may also be present either inside or outside microcapsules.

The preparation of the microcapsules can be accomplished by any suitable method known in the art. Examples of such suitable methods include methods such as those described in U.S. Pat. Nos. 2,800,457 and 2,800,458 which utilize coarcervation of a hydrophilic wall-forming material, the surface polymerization process, as described in U.S. Pat. No. 3,287,154, British Patent No. 990,443, JP-B-38-19574, JP-B-42-446, and JP-B-42-771 (the term "JP-B" as used herein means as "examined Japanese patent publication"), the method described in U.S. Pat. Nos. 3,418,250 and 3,660,304 which comprise polymer precipitation, the method described in U.S. Pat. Nos. 3,796,669 which comprises using isocyanate-polyol wall material, the method described in U.S. Pat. No. 3,914,511 which comprises using isocyanate wall material, the methods described in U.S. Pat. Nos. 4,001,140, 4,087,376, and 4,089,802 which comprises using urea-formaldehyde or urea-formaldehyde-resorcinol system wall-forming material, the method described in U.S. Pat. No. 4,025,455 which comprises using melamineformaldehyde resin or hydroxypropyl cellulose, the methods described in JP-B-36-9163 and JP-A-51-9079 which comprises an in situ process by monomer polymerization, the electrolytic dispersion cooling process as described in British Patent Nos. 952,807 and 965,074, and a sprayed wing process described in U.S. Pat. No. 3,111,407, and British Patent No. 930,422. However, the present invention should not be construed as being limited to these methods. It is preferred that a high molecular weight film be formed as the. microcapsule wall after a core material has been emulsified.

The preparation of the present microcapsules can be effectively accomplished by a microcapsulization process whereby reactants are polymerized from the interior of oil drops. That is, this process can provide capsules suitable as light-sensitive materials having uniform particle diameter and an excellent preservability in a short period of time.

For example, if polyurethane is used as capsule wall material, a polyvalent isocyanate and a second material which reacts with the polyvalent isocyanate to form a capsule wall (e.g., polyol, polyamine) are mixed with an oil solution to be capsulized. The mixture is then emulsion-dispersed in water. By raising the temperature of the emulsion dispersion, a high molecule forming reaction occurs on the oil surface to form the microcapsule walls. In this case, an auxiliary solvent having a low boiling point and strong dissolving power may be incorporated in the oil solution.

Examples of such a polyvalent isocyanate and polyol or polyamine which reacts with polyvalent isocyanate are disclosed in U.S. Pat. Nos. 3,281,383, 3,773,695, and 3,793,268, JP-B-48-40347, JP-B-49-24159, JP-A-48-80191, JP-A-48 84086, and JP-A-60-49991. These compounds can be used in the present invention.

The preparation of such a microcapsule can be accomplished by using a water soluble high molecular weight compound such as a water-soluble anionic, nonionic or amphoteric high molecular weight compound.

These water-soluble high molecular weight compounds may be used in the form of an aqueous solution in a concentration of 0.01 to 10 wt %. The particle diameter of such a microcapsule is adjusted to 80 μm or less.

The size of the capsule to be used in the present invention is 80 μm or less, preferably 20 μm or less in the light of preservability and processability.

One approach to improve the preservability of the present compound in the light-sensitive material is to keep the pH value of the film of the light sensitive material at 7 or less, particularly 4 to 7, during storage. The film pH value can be determined by dropping 20 μl of water onto the film surface of the light-sensitive material, and measuring the pH value in equilibrium with pH electrodes having a flat tip (sensor portion) kept in close contact with the waterdrop.

Unexpectedly, it was discovered that by keeping the film pH value of the light-sensitive material at 4 to 7, the fluctuation in the photographic properties with time can be drastically controlled with little or no inhibition of development.

An acid or acidic salt thereof may be used to keep the film pH value of the light-sensitive material at 4 to 7. A useful acid for this purpose has an acid dissociation constant pKa of 7 or less, preferably 5 or less. Examples of such an acid are described in *Kagaku Binran* (Handbook of Chemistry) (elementary edition), 1975, pp. 993–1,000.

Another useful example of such an acid is a thermal-decomposable carboxylic acid. Specific examples of such a thermal-decomposable carboxylic acid are described in JP-A-61-42650.

Furthermore, a polymer made of polystyrenesulfonic acid, polyacrylic acid or derivatives thereof may be used. The molecular weight of such a polymer is preferably 1,000 or more, particularly 5,000 or more to insure the prevention of contamination by elution of the polymer into a processing solution such as a developing solution.

Suitable silver halides for use in the present invention may be selected from the group consisting of silver chloride, silver bromide, silver iodide, silver bromochloride, silver chloroiodide, silver bromoiodide, and silver bromochloroiodide. The halogen composition of the particulate silver halide may be uniform or such that the composition differs from the surface to the interior thereof as described in JP-A-57-154232, JP-A-58-108533, JP-A-59-48755, JP-A-59-52237, U.S. Pat. No. 4,433,048, and European Patent No. 100,984. Alternatively, a monodisperse emulsion of tabular particulate silver halide having a particle thickness of 0.5 μm or less, a particle diameter of at least 0.6 μm and an average aspect ratio of 5 or more (as described in U.S. Pat. Nos. 4,414,310 and 4,435,499, and West German Patent Application (OLS) No. 3,241,646Al) or of particulate silver halide having a nearly uniform particle size distribution (as described in JP-A-57-178235, JP-A-58-100846, JP-A-58-14829, International Patent Disclosure No. 83/02338 A1, and European Patent Nos. 64,412A and 83,377A1) may be used in the present invention. Two or more particulate silver halides having different crystal habits, halogen compositions, particle sizes, and particle size distributions may be used in combination. Two or more monodisperse emulsions of particulate silver halide having different particle sizes may be used in admixture to adjust gradation.

The particle size of the silver halide for use in the present invention is preferably in the range of 0.001 to 10 μm, particularly 0.001 to 5 μm as calculated in terms of average particle diameter. The preparation of such a silver halide emulsion can be accomplished by any suitable method selected from acid process, neutral process, and ammonia process. The reaction of a soluble silver salt with a soluble halide can be accomplished by a single mixing process, simultaneous mixing process or combination thereof. A reverse mixing process in which particles are formed in excess silver ion of a controlled double jet process in which pAg is kept constant may be employed. In order to accelerate the particle growth, the amount and rate of addition of silver salt and halide can be raised as described in JP-A-55-142329, JP-A-55-158124, and U.S. Pat. No. 3,650,757.

An epitaxial junction type particulate silver halide as described in JP-A-56-16124 and U.S. Pat. No. 4,094,684 may be used.

At the formation stage of the particulate silver halide for use in the present invention, ammonia, an organic thioether derivative as described in JP-B-47-11386, or a sulfur-containing compound as described in JP-A-53-144319 can be used as the silver halide solvent.

Cadmium salts, zinc salts, lead salts, or thallium salts may be present in the formation process or the physical ripening of the particulate silver halide.

To improve high intensity reciprocity law failure or low intensity reciprocity law failure, a water-soluble iridium salt such as iridium chloride (III, IV) and ammonium hexachloroiridiumate or a water-soluble rhodium salt such as rhodium chloride may be used. By incorporating iridium in an amount of $10^{-9}$ to $10^{-5}$ mol per mol of silver halide, a silver halide excellent in reciprocity law failure, fog and gradation can be obtained.

The soluble salts may be removed from the silver halide emulsion after precipitation or physical ripening. To this end, the noodle rinsing process or sedimentation process may be used.

The present silver halide emulsion may be used unripened but is normally subjected to chemical sensitization before use. An emulsion for a conventional type light-sensitive material may be subjected to a known sulfur sensitization process, reduction sensitization process, or noble metal sensitization process, singly or in combination. These chemical sensitization processes may be effected in the presence of a nitrogen-containing heterocyclic compound as described in JP-A-58-126526 and JP-A-58-215644.

The silver halide emulsion for use in the present invention may be of the surface latent image type in which latent images are formed mainly on the surface of the particles or of the internal latent image type in which latent images are formed mainly in the interior thereof. A direct reverse emulsion made of a combination of an internal latent image type emulsion and a nucleating agent may be used. Examples of an internal latent image type emulsion suitable for this purpose are described in U.S. Pat. Nos. 2,592,250 and 3,761,276, JP-B-58-3534, and JP-A-57-136641. Examples of suitable nucleating agents are described in U.S. Pat. Nos. 3,227,552, 4,245,037, 4,255,511, 4,266,031, and 4,276,364, and West German Patent Application (OLS) No. 2,635,316.

The silver halide for use in the present invention may be spectrally sensitized with a methine dye or the like. Examples of suitable dyes include cyanine dyes, merocyanine dyes, complex cyanine dyes, complex merocyanine dyes, holopolar cyanine dyes, hemicyanine dyes, styryl dyes and hemioxonol dyes. Particularly useful among these dyes are cyanine dyes, merocyanine dyes, and complex merocyanine dyes. Any nucleus which is commonly used as a basic heterocyclic nucleus in cyanine dyes can be applied for these dyes. Suitable examples of the nucleus include pyrroline nucleus, oxazoline nucleus, thiazoline nucleus pyrrole nucleus, oxazole nucleus, thiazole nucleus, selenazole nucleus, imidazole nucleus, tetrazole nucleus, pyridine nucleus and the nucleus obtained by fusion of alicyclic hydrocarbon rings to these nuclei or the nucleus obtained by fusion of aromatic hydrocarbon rings to these groups, e.g., indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. These nuclei may be applied to carbon atoms in the dyes.

Examples of suitable nuclei which can be applied to merocyanine dyes or complex merocyanine dyes include those having a ketomethylene structure such as pyrazolin-5-one nucleus, thiohydantoin nucleus, 2-thiooxazolidin-2,4-dione nucleus, thiazolidin-2,4-dione nucleus, rhodanine nucleus, thiobarbituric acid nucleus and other 5- or 6-membered heterocyclic nuclei.

These sensitizing dyes may be used singly or in combination. Such a combination of sensitizing dyes may be often used for the purpose of supersensitization.

The present photographic emulsion may comprise a dye which itself doesn't have a spectral sensitizing effect or a substance which doesn't substantially absorb visible light but exhibits supersensitizing effect together with the above described a sensitizing dye. Examples of such a dye or substance which may be incorporated in the emulsion include aminostyryl compounds substituted by nitrogen-containing heterocyclic groups as described in U.S. Pat. Nos. 2,933,390 and 3,635,721, aromatic organic acid-formaldehyde condensates as described in U.S. Pat. No. 3,743,510, cadmium salts and azaindene compounds. Combinations as described in U.S. Pat. Nos. 3,615,613, 3,615,641, 3,617,295, and 3,635,721 are particularly useful.

The photographic emulsion for use in the present invention may comprise surface active agents, singly or in combination.

These surface active agents are used as a coating aid. These surface active agents may also and be used for other purposes such as emulsion dispersion, sensitization, improvement of photographic properties, or prevention of static charge or adhesion. These surface active agents include natural surface active agents such as saponin, nonionic surface active agents such as alkylene oxide, glycerin or glycidol series surface active agents, cationic surface active agents such as higher alkylamines, quaternary ammonium salts, pyridine or other heterocyclic compounds, phosphoniums or sulfoniums, anionic surface active agents such as surface active agents containing an acid group such as carboxylic acid, sulfonic acid, phosphoric acid, sulfuric acid ester, or phosphoric acid ester, and amphoteric surface active agents such as amino acids, aminosulfonic acids, sulfuric or phosphoric esters of amino alcohols.

The photographic emulsion for use in the present invention may comprise various compounds for the purpose of inhibiting fog during the preparation, storage or photographic processing of the light-sensitive material or stabilizing the photographic properties. Examples of such compounds which can be used in the present invention include development inhibitors as described with reference to PUG.

The photographic emulsion layers in the present photographic light-sensitive material may comprise a thioether compound, thiomorpholine, quaternary ammonium salt compound, urethane derivative, urea derivative, imidazole derivative, or 3-pyrazolidone, for the purpose of improving sensitivity, raising contrast or accelerating development.

The photographic light-sensitive material for use in the present invention may comprise a dispersion of a water-insoluble or slightly soluble synthetic polymers in the photographic emulsion layer or other hydrophilic colloidal layer for the purpose of improving dimensional stability. For example, a polymer comprising as the monomer component an alkyl (meth)acrylate, alkoxyalkyl (meth)acrylate, glycidyl (meth)acrylate, (meth)acrylamide, vinyl ester (e.g., vinyl acetate), acrylonitrile, olefin, or styrene, singly or in combination, or a combination thereof with acrylic acid, methacrylic acid, an $\alpha,\beta$-unsaturated dicarboxylic acid, a hydroxyalkyl (meth)acrylate, a sulfoalkyl (meth)acrylate, or styrenesulfonic acid may be used. Suitable binders may be incorporated in an emulsion layer or auxiliary layer (e.g., protective layer, interlayer) in the present light-sensitive material. Preferable binders include hydrophilic colloids, particularly gelatin. However, other hydrophilic colloids can be used. Examples of other suitable hydrophilic colloids for use in the present invention include proteins such as gelatin derivatives, graft polymers of gelatin with other high molecular compounds, albumin, and casein, cellulose derivatives such as hydroxyethyl cellulose, carboxymethyl cellulose, and cellulose sulfuric acid ester, sugar derivatives such as sodium alginate, and starch derivatives, single polymers or copolymers such as polyvinyl alcohol, polyvinyl alcohol partial acetal, poly-N-vinylpyrrolidone, polyacrylic acid, polymethacrylic acid, polyacrylamide, polyvinyl imidazole, and polyvinylpyrazole, and other various synthetic hydrophilic high molecular weight substances. Besides these compounds lime-treated gelatin, acid-treated gelatin, or enzyme-treated gelatin may be used.

The present photographic light-sensitive material may comprise an inorganic or organic film hardener in the photographic emulsion layer or other hydrophilic colloidal layer. For example, chromium salts (e.g., chrome alum, chromium acetate), aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-triazine), and mucohalogenic acids (e.g., mucochloric acid, mucophenoxychloric acid) may be used, singly or in combination.

The present silver halide photographic material may also comprise other various additives such as brightening agents, dyes, desensitizers, coating aids, antistatic agents, plasticizers, lubricants, matt agents, development accelerators, mordants, ultraviolet absorbers, discoloration inhibitors, and color fog inhibitors.

Specific examples of suitable additives include those described in *Research Disclosure,* No. 17,643, Dec., 1978, pp. 22–31.

The present compound can be incorporated in any so-called conventional silver halide light-sensitive material which is intended to be developed with a developing solution at near room temperature, such as X-ray film (e.g., industrial X-ray film, medical indirect X-ray film, medical direct X-ray film), printing light-sensitive material (e.g., film for photographing line or dot, reversing film, photo-composing film or paper), ordinary black-and-white photographic paper, black-and-white photographic film, scanner film, and other black-and-white light-sensitive material, color negative film, color paper, color reversal film, color reversal paper, copying color paper, and other color light-sensitive material, direct reverse black-and-white or color light-sensitive material, silver salt diffusion transfer light-sensitive material, and color diffusion transfer light-sensitive material.

Examples of printing light-sensitive materials to which the present compound can be applied include so-called lith film as well as printing light-sensitive material comprising silver bromochloride or silver bromochloroiodide containing silver chloride in an amount of 60% or more (silver iodide content: 0 to 5%) and polyalkylene oxides as described in U.S. Pat. No. 4,452,882, and printing light-sensitive material which reacts with arylhydrazines to form an ultrahigh contrast negative image with a stable developing solution as described in U.S. Pat. No. 4,224,401.

The color light-sensitive material to which the present compound is applied normally has a multilayer structure in which at least two different spectral sensitivities are provided on a support. A multilayer natural color photographic material normally has at least one red-sensitive emulsion layer, one green-sensitive emulsion layer and one blue-sensitive emulsion layer on a support. The order of arrangement of these emulsion layers can be freely selected as necessary. A preferred layer arrangement is a red-sensitive layer, a green sensitive layer and a blue-sensitive layer or a blue-sensitive layer, a red-sensitive layer and a green-sensitive layer as viewed from the support. Each of these emulsion layers may consist of two or more emulsion layers having different sensitivities. A light-insensitive layer may be interposed between two or more emulsion layers having the same sensitivity. In a normal combination, a cyan-forming coupler is incorporated in the red-sensitive emulsion layer, a magenta-forming coupler is incorporated in the green-sensitive emulsion layer, and a yellow-forming coupler is incorporated in the blue-sensitive emulsion layer. Different combinations may be optionally used.

In the present invention, various color couplers may be used. The term "color coupler" as used herein means a compound which can undergo a coupling reaction with an oxidation product of an aromatic primary amine developing agent to produce a dye. Typical examples of useful color couplers include naphtholic or phenolic compounds, pyrazolone or pyrazoloazole compounds, and open-chain or heterocyclic ketomethylene compounds. Specific examples of these cyan, magenta and yellow couplers suitable for use in the present invention include those described in the patents cited in *Research Disclosure* Nos. 17,643 (December, 1978), VII-D and 18,717 (November, 1979).

The color to be incorporated in the light-sensitive material exhibits nondiffusibility by containing a ballast group or being polymerized. A two-equivalent coupler which is substituted by a coupling-off group is better used than a four-equivalent coupler containing hydrogen atom in the coupling active site because it can reduce the coated amount of silver. Other examples of couplers which can be used in the present invention include couplers which provide a dye exhibiting proper diffusibility, colorless couplers, DIR couplers which undergo coupling reactions to release development inhibitors, and couplers which undergo coupling reactions to release development accelerators.

The photographic processing of the present silver halide photographic material in an ordinary wet process can be accomplished by any known method. Any known processing solution may be used. The processing temperature may be normally selected from 18° C. to 50° C. but may be below 18° C. or above 50° C. Either a development process for forming a silver image (black-and-white photographic process) or a color photographic process comprising a development process for forming a color image may be used depending on the application.

Suitable processing conditions are described in detail in James, *The Theory of the Photographic Process,* 4th ed., pp. 291–436, and *Research Disclosure,* No. 17,643, December, 1978, pp. 28–30.

Any known fixing solution may be used after black-and-white development. Suitable fixing agents include thiosulfates, thiocyanates, or organic sulfur compounds which are known to serve as fixing agents. The fixing solution may comprise a water-soluble aluminum salt as a film hardener.

The photographic emulsion layer which has been color-developed is normally bleached. The bleach process may be conducted simultaneously with or separately from the fixing process. As a suitable bleaching agents include compounds of polyvalent metals such as iron (III), cobalt (III), chromium (IV) or copper (II), peracid, quinone, or nitroso compound. For example, ferricyanides, bichromates, organic complexes of iron (III) or cobalt (III) with aminopolycarboxylic acids such as ethylenediaminetetraacetic acid, nitrilotriacetic acid, 1,3-diamino-2-propanoltetraacetic acid or organic acids such as citric acid, tartaric acid or malic acid, persulfates, permanganates or nitrosophenol may be used. Particularly useful compounds include potassium ferricyanate, ferric sodium ethylenediaminetetraacetate, and ferric ammonium ethylenediaminetetraacetate. Ferric ethylenediaminetetraacetate complex salts are useful in a single bleaching bath as well as in a combined bleaching and fixing bath.

The bleaching or blix bath may comprise a bleach accelerator as described in U.S. Pat. Nos. 3,042,520 and 3,241,966, JP-B-45-8506, and JP-B-45-8836, a thiol compound as described in JP-A-53-65732, or other various additives.

The present compound can be applied to a heat developable light-sensitive material on which a black-and-white image or coupler dye image is formed. A heat developable light-sensitive material essentially comprises a light-sensitive silver halide, a binder, and a reducing agent on a support. The heat developable light-sensitive material may further comprise an organic metal oxidizing agent or a dye-providing compound (which may concurrently serve as a reducing agent as described later) as necessary. The present compound may be preferably used a the above described dye-providing compound. These components may be incorporated in the same layer or ma be incorporated in separate layers if they are reactive with each other. Preferably, they are incorporated in the same layer. For example, a colored dye-providing compound may be provided in a layer under the silver halide emulsion to inhibit the decrease in the sensitivity.

In order to obtain a wide range of colors in a chromaticity diagram with three primaries (yellow, magenta and cyan), at least three silver halide emulsion layers having sensitivities in different spectral regions are used in combination. Examples of such a combination include a combination of a blue-sensitive layer, a green-sensitive layer and a red-sensitive layer and a combination of a green-sensitive layer, a red-sensitive layer and an infrared-sensitive layer. These light-sensitive layers may be arranged in various known orders in the ordinary color light-sensitive material. These light-sensitive layers may be divided into two or more layers as necessary.

The heat developable light-sensitive material may be provided with various auxiliary layers such as protective layers, subbing layers, interlayers, yellow filter layers, antihalation layers, and back layers.

In the heat developable light-sensitive material, an organic metal salt may be used as an oxidizing agent in combination with the light-sensitive silver halide. In this case, it is necessary that the light-sensitive silver halide and the organic metal salt be kept in contact with each other or adjacent to each other.

Particularly preferred among these organic metal salts are organic silver salts.

Examples of organic compounds which can be used to form the above described silver salt oxidizing agents include the compounds described in U.S. Pat. No. 4,500,626 (52nd column to 53rd column). Other examples of useful organic compounds include carboxylic acid silver salts containing an alkynyl group such as silver phenylpropiolate as described in JP-A-60-113235, and acetylene silver as described in JP-A-61-249044. Two or more organic silver salts may be used in combination.

The amount of organic silver salt to be used is in the range of 0.01 to 10 mols, preferably 0.01 to 1 mol, per mol of light-sensitive silver halide. The total coated amount of the light-sensitive silver halide and the organic silver salt is preferably in the range of 50 mg to 10 g/m$^2$ as calculated in terms of silver.

In the present invention, a compound wherein PUG in general formula (I) is a diffusible dye is preferably used as a dye-providing compound to be incorporated in a heat developable light-sensitive material. Alternatively, a compound of the general formula (I) wherein PUG is a photographically useful group other than dye (e.g., development inhibitor) may be used while a different compound is used as the dye-providing compound. As such a different dye-providing compound there may be used a compound which undergoes an oxidation coupling reaction to form a dye (coupler). Such a coupler may be a two-equivalent coupler or four-equivalent coupler. A two-equivalent coupler containing a nondiffusible group as a split-off group which undergoes oxidation coupling reaction to form a diffusible dye is preferably used. Specific examples of suitable developing agents and couplers are described in T. H. James, *The Theory of the Photographic Process* pp. 291–334 and 354–361, JP-A-58-123533, JP-A-58-149046, JP-A-58-149047, JP-A-59-111148, JP-A-59-124399, JP-A-59-174835, JP-A-59-231539, JP-A 59-231540, JP-A-60-2950, JP-A-60-2951, JP-A-60-14242, JP-A-60-23474, and JP-A-60-66249.

Examples of different dye-providing compounds include compounds which serves to imagewise release or diffuse a diffusible dye. Such a compound can be represented by the following general formula (LI):

$$(\text{Dye-Y})_n\text{—Z} \qquad \text{(LI)}$$

wherein Dye represents a dye group, a dye group which has been temporarily shifted to a short wavelength range or a dye precursor group; Y represents a mere bond or connecting group; Z represents a group which makes a difference in the diffusibility of the compound represented by $(\text{Dye-Y})_n$—Z in corresponding or counter-corresponding to light-sensitive silver salts having a latent image distributed imagewise or releases Dye in corresponding or counter-corresponding to light-sensitive silver salts having a latent image distributed imagewise to make no difference in the diffusibility between Dye thus released and $(\text{Dye-Y})_n$—Z; and n represents an integer of 1 or 2. If n is 2, two (Dye-Y)'s may be the same or different.

Specific examples of the dye providing compound represented by the general formula (LI) include the following compounds i to v. The compounds i to iii form a diffusible dye image (positive dye image) in counter-corresponding to the development of silver halide while the compounds iv and v form a diffusible dye image (negative dye image) in corresponding to the development of silver halide.

i. Dye developing agents comprising a hydroquinone developing agent connected to a dye component as described in U.S. Pat. Nos. 3,134,764, 3,362,819, 3,597,200, 3,544,545, and 3,482,972. These dye developing agents are diffusible in alkaline conditions but become nondiffusible upon reaction with silver halide.

ii. Nondiffusible compounds which release a diffusible dye in alkaline conditions but lose their function upon reaction with silver halide as described in U.S. Pat. No. 4,503,137. Examples of such compounds include compounds which undergo intramolecular nucleophilic displacement reactions to release a diffusible dye as described in U.S. Pat. No. 3,980,479, and compounds which undergo an intramolecular rewinding reaction of the isooxazolone ring to release a diffusible dye as described in U.S. Pat. No. 4,199,354.

iii. Nondiffusible compounds that react with a reducing agent left unoxidized after being developed to release a diffusible dye as described in U.S. Pat. No. 4,559,290, European Patent No. 220,746A2, and Kokai Giho 87-6,199.

Examples of such compounds include compounds which undergo intramolecular nucleophilic displacement reaction after being reduced to release a diffusible dye as described in U.S. Pat. Nos. 4,139,389 and 4,139,379, and JP-A-59-185333, and JP-A-57-84453, compounds which undergo an intramolecular electron transfer reaction after being reduced to release a diffusible dye as described in U.S. Pat. No. 4,232,107, JP-A-59-101649 JP-A-61-88257, and *Research Disclosure,* No. 24,025 (1984), compounds which undergo cleavage of a single bond after being reduced to release a diffusible dye as described in West German Patent No. 3,008,588A, JP-A-56-142530, and U.S. Pat. Nos. 4,343,893, and 4,619,884, nitro compounds which receive electrons to release a diffusible dye as described in U.S. Pat. No. 4,450,223, and compounds which receive electrons to release a diffusible dye as described in U.S. Pat. No. 4,609,610.

Preferred examples of such compounds include compounds containing an N-X bond (wherein X represents oxygen atom, sulfur atom or nitrogen atom) and an electrophilic group in one molecule as described in European Patent No. 220,746A2, Kokai Giho 87-6,199, JP-A-63-201653, and JP-63-201654, compounds containing an $SO_2$—X group (wherein X is as defined above) and an electrophilic group in one molecule as described in U.S. application Ser. No. 07/188,779, compounds containing a PO—X bond (wherein X is as defined above) and an electrophilic group in one molecule as described in JP-A-63-271344, and compounds containing a C—X′ bond (wherein X′ is as defined above for X or represents —$SO_2$—) and an electrophilic group in one molecule as described in JP-A-63-271341.

Particularly preferred among these compounds are compounds containing an N-X bond and an electrophilic group in one molecule. Specific examples of such compounds include Compounds (1) to (3), (7) to (10), (12), (13), (15), (23) to (26), (31), (32}, (35), (36), (40), (41), (44), (53) to (59}, (64), and (70) described in European Patent No. 220,746A2, and Compounds (11) to (23) described in Kokai Giho 87-6,199.

iv. Couplers containing a diffusible dye as the split-off group which reacts with an oxidation product of a reducing agent to release a diffusible dye (DDR coupler). Specific examples of such compounds include those described in British Patent No. 1,330,524, JP-B-48-39165, and U.S. Pat. Nos. 3,443,940, 4,474,867, and 4,483,914.

v. Compounds which are capable of reducing silver halide or organic silver salts and release a diffusible dye after reducing silver halide or organic silver salts (DDR compound). These compounds are advantageous in that they need no other reducing agents They eliminate image staining due to the action of oxidation decomposition products of reducing agents. Typical examples of such compounds are described in U.S. Pat. Nos. 3,928,312, 4,053,312, 4,055,428, 4,336,322, 3,725,062, 3,728,113, 3,443,939, and 4,500,626, JP-A-59-65839, JP-A-59-69839, JP-A-53-3819, JP-A-51-104343, JP-A-58-116537, JP-A-57-179840, and *Research Disclosure,* No. 17,465. Specific examples of DRR compounds include compounds as described in U.S. Pat. No. 4,500,626, 22nd column to 44th column, and particularly preferred among these compounds are compounds (1) to (3), (10) to (13), (16) to (19), (28) to (30), (33) to (35), (38) to (40), and (42) to (64). Other preferred examples of such compounds include those described in U.S. Pat. No. 4,639,408, 37th column to 39th column.

Examples of dye-providing compounds other than the above described couplers and compounds of the general formula [LI] include silver dye compounds comprising an organic silver salt connected to a dye as described in *Research Disclosure* (May 1978, pp. 54–58), azo dyes for use in heat developable silver dye bleaching processes as described in U.S. Pat. No. 4,235,957 and *Research Disclosure* (April 1976, pp. 30–32), and leuco dyes as described in U.S. Pat. Nos. 3,985,565 and 4,022,617.

In the present invention, the light-sensitive element may comprise a compound which serves both to activate development and to stabilize the image. Specific examples of such suitable compounds are described in U.S. Pat. No. 4,500,626, 51st column to 52nd column.

In the system which comprises diffusion transfer of a dye to from a dye image, a dye fixing element may be used with the light-sensitive element The dye fixing element may be coated on a support different from the light-sensitive element or the same support as the light-sensitive element For the relationship between the light-sensitive element and the dye fixing element, between the light-sensitive element and the support, and between the light-sensitive element and the white reflective element, those described in U.S. Pat. No. 4,500,626, 57th column can be applied to the present invention.

Preferably, the dye fixing element for use in the present invention may comprise at least one layer containing a mordant and a binder. Any mordant known in the art may be used. Specific examples of such a mordant include those described in U.S. Pat. No. 4,500,626 (58th column to 59th column), JP-A-61-88256 (pp. 32–41), JP-A-60-118834, JP-A-60-119557, JP-A-60-235134, JP-A-62-244043, and JP-A-62-244036. Other examples of such a mordant for use in the present invention include dye-receiving high molecular weight compounds as described in U.S. Pat. No. 4,463,079.

The dye fixing element may optionally comprise various auxiliary layers such as a protective layer, a release layer, and an anticurl layer. Particularly preferred among these auxiliary layers is the protective layer.

The natural or synthetic high molecular weight compound used in the light sensitive element may also be used as a binder for the dye fixing element.

The light-sensitive element may constitute one or a plurality of layers and the dye fixing element may comprise a heat solvent, a plasticizer, a discoloration inhibitor, a UV absorber, a lubricant, a matting agent, an antioxidant, a dispersed vinyl compound for increasing dimensional stability, a surface active agent, or a fluorescent brightening agent. Specific examples of these additives are described in JP-A-61-88256, pp.26–32. Particularly, in a system which comprises heat development and dye transfer at the same time in the presence of a slight amount of water, the dye fixing element may preferably comprise a base and/or a base precursor described later to improve the preservability of the light-sensitive element.

In the present invention, the light sensitive element and/or the dye fixing element may comprise an image formation accelerator. Such an image formation accelerator serves to accelerate the redox reaction between a silver salt oxidizing agent and a reducing agent, accelerate a reaction such as the reaction which results in the production of a dye from a dye-providing substance, the decomposition of a dye or the release of a diffusible dye, or to accelerate the transfer of a dye from a light sensitive material layer to a dye fixing layer. From a physicochemical point of view, image formation accelerators can be classified into either bases or base precursors, nucleophilic compounds, high boiling organic solvents (oil), heat solvents, surface active agents, and compounds capable of interacting with silver or silver ion. However, these substance groups normally exhibit accelerating effects in combination with other composite functions. The details are described in U.S. Pat. No. 4,678,739, 38th column to 40th column.

Suitable base precursors for use in the present invention include organic salts which undergo decarboxylation with a base by heat, or a compound which undergoes intramolecular nucleophilic displacement reaction, Lossen rearrangement or Beckmann rearrangement to release amines. Specific examples of such a compound are described in U.S. Pat. No. 4,511,493 and JP-A-65038. Other examples of such a precursor for use in the present invention include a combination of a slightly soluble metal compound and a compound capable of complexing with metal ions constituting the metal compound (complexing compound) as described in European Patent No. 210,660A, and a compound which undergoes electrolysis to produce a base as described in JP-A-61-232451. Particularly, the former system may be effectively used. Such a slightly soluble metal compound and such a complexing compound may be advantageously incorporated separately in the light-sensitive element and the dye fixing element.

The present light-sensitive element and/or dye fixing element may comprise various development stop agents for the purpose of obtaining a constant quality image regardless of fluctuation in the developing temperature and time.

The term "development stop agent" as used herein means a compound which readily neutralizes or reacts with a base after a proper development to lower the base concentration in the film and thus stop the development or a compound which interacts with silver and silver salts to inhibit the development. Specific examples of such a development stop agent include acid precursors which release an acid upon heating, electrophilic compounds which undergo displacement reactions with a base upon heating, nitrogen-containing heterocyclic compounds, mercapto compounds, and precursors thereof (e.g., compounds as described in U.S. Pat. Nos. 4,670,373, 4,656,126, 4,610,957, 4,626,499, 4,678,735, and 4,639,408, JP-A-61-147249, JP-A-61-147,244, JP-A-61-184,539, JP-A-61-185,743, JP-A-61-185,744, JP-A 61-188,540, JP-A-61-269,148, and JP-A-61-269,143).

The layers constituting the present light-sensitive element and/or dye fixing element (e.g., photographic emulsion layer, dye fixing layer) may comprise an inorganic or organic film hardener.

The support for use in the present light-sensitive element and/or dye fixing element must with stand processing temperatures Suitable general supports include glass, paper, polymer film, metal and its analogues, and materials described as supports in JP-A-61-14724 (page 25).

Specific examples of film hardeners for use in the present invention include those described in U.S. Pat. No. 4,678,739 (41st column), and JP-A-59-116,655. These film hardeners may be used singly or in combination.

The light-sensitive element and/or dye fixing element may comprise an electrically conductive heat element layer as a heating means for heat development or dye diffusion transfer.

In this embodiment, a transparent or opaque heating element can be prepared as a resistive heating element by using any suitable known technique. The preparation of such a resistive heating element can be accomplished by the use of a semi-conductive thin film of an inorganic material or by the use of an organic thin film comprising a particulate electrically conductive material dispersed in a binder. In these preparation processes, the materials described in JP-A-61-145544 can be used in these preparation processes. Such an electrically conductive layer can also be used as an antistatic layer.

In the present invention, the coating of a heat developable light-sensitive layer, protective layer, interlayer, subbing layer, back layer, dye fixing layer or other layers can be accomplished by any suitable method including the method described in U.S. Pat. No. 4,500,626, 55th column to 56th column.

Suitable light sources for imagewise exposure of the light-sensitive element include radiation including visible light. In general, light sources for the exposure of ordinary color prints, such as a tungsten lamp, a mercury vapor lamp, a halogen lamp (e.g., iodine lamp), a xenon lamp, a laser, a CRT light source, a light emitting diode, and those described in U.S. Pat. No. 4,500,626 (56th column) can be used.

The heat development can be effected at temperatures of from about 50° C. to about 250° C., particularly from about 80° C. to about 180° C. The diffusion transfer of a dye may be effected simultaneously with or after the heat development. In the latter case, the transfer process can be effected at a temperature ranging from room temperature to the heating temperature to be used in the heat development process. Preferably, when transfer of the dye is effected after the heat development, the transfer process is effected at temperatures of from about 50° C. or more to the temperature about 10° C. lower than the heating temperature to be used in the heat development process. The transfer of a dye can be effected only by heat However, a solvent may be used to accelerate the transfer of the dye.

Alternatively, a process as described in JP-A-59-218443 and JP-A-61-238056 can be effectively used for simultaneous development and transfer or for development in sequence and transfer upon heating in the presence of a small amount of a solvent (water in particular). In this sequential process, the heating temperature is preferably in the range of 50° C. or more to less than the boiling point of the solvent. For example, if the solvent is water, the heating temperature is preferably in the range of 50° C. to 100° C.

Suitable examples of solvents to be used for the acceleration of development and/or the transfer of a diffusible dye to the dye fixing layer include water, and basic aqueous solutions of inorganic alkali metal salts or organic bases. Examples of such a base include those described with reference to the image formation accelerator. Other examples of such a solvent include low boiling point solvents, and mixtures of low boiling point solvents and water or basic aqueous solutions. Such a solvent may contain a surface active agent, a fog inhibitor, a slightly soluble metal salt, a complexing compound, or the like.

Such a solvent may be provided to either or both of the dye fixing elements and the light-sensitive element. The amount of such a solvent used may be in the range of the weight of the solvent corresponding to the maximum swelling volume of the total coat film or less (particularly the value obtained by subtracting th weight of the total coat film from the weight of the solvent corresponding to the maximum swelling volume of the total coat film).

The provision of the solvent to the light-sensitive layer or dye fixing layer can be accomplished by any suitable method including the method described in JP-A 61-147244 (page 26). Alternatively, the solvent may be incorporated in the light-sensitive element and/or the dye fixing element, in microcapsulized form.

In order to accelerate the transfer of a dye, a heat solvent which is solid at normal temperatures but soluble at elevated temperatures may be incorporated in the light-sensitive element and/or the dye fixing element. The heat solvent may be incorporated in any of emulsion layer, interlayer, protective layer, and dye fixing layer. The heat solvent may be preferably incorporated in the dye fixing layer and/or adjacent layers.

Examples of heat solvents include ureas, pyridines, amides, sulfonamides, imides, alcohols, oximes, and other heterocyclic compounds.

In order to accelerate the transfer of a dye, a high boiling organic solvent may be incorporated in the light-sensitive element and/or the dye fixing element.

If the present heat developable color light-sensitive material is used to form color images, various processes may be used in combination. For example, if a so-called two-sheet type photographic material comprising a light-sensitive layer and a dye fixing layer formed on separate supports is used, typical combinations of processes include:

(i) Exposure step—heat development step—light-sensitive material/image receiving material lamination step—transfer step—peeling step (ii) Exposure step—light-sensitive material/image receiving lamination step—heat development/transfer step—peeling step (iii) Exposure step—heat development step—solvent provision step—light-sensitive material/image receiving material lamination step—transfer step—peeling step (iv) Exposure step—solvent provision step—light-sensitive material/image receiving material lamination step—heat development/transfer step—peeling step The peeling step may be omitted depending on the structure of the image receiving material. The above described classification is for the sake of convenience. These combinations include the case where a plurality of steps are effected in sequence, e.g., the case where the exposure step is subsequently followed by the heat development step, and the case where one step is conducted by a plurality of stages. These combinations can be properly selected depending on the process of production of a base, e.g., whether a thermal decomposable base precursor is incorporated in the light-sensitive material or compounds which have been incorporated in two photographic materials in the presence of a solvent are allowed to react with each other, or the process of using an accelerator for adjusting the speed of development and transfer.

Alternatively, a heat developable light-sensitive material may be heat-developed after being kept in such a state that the reaction between silver halide and a reducing agent takes place in preference to the reaction resulting in the formation or release of a diffusible dye, i.e., the reaction between silver halide and a reducing agent takes place at a temperature of not higher than the temperature at which the reaction of formation or release of a diffusible dye takes place (heat development temperature) for a predetermined period of time. Specifically, the reaction between silver halide and a reducing agent can take place when the pH value and the temperature of the light-sensitive layer in the heat developable light-sensitive material fully satisfy the required conditions. The term "temperature lower than the heat development temperature" as used herein preferably means a temperature 10° C. or more, particularly 15° C. or more lower than the heat development temperature (i.e., temperature predetermined for the reaction of formation or release of a diffusible dye from a dye-providing compound). The temperature can vary within this range.

As described above, the heat developable light-sensitive material may be heat-developed after being kept in the above described state for a predetermined period of time. This means that the light-sensitive material is kept in this state until at least 5%, particularly 10% of the final amount of developed silver is reached.

Heating means for use in the development step and/or transfer step include a heating plate, iron, heat roller, or other means as described in JP-A-61-147244 (pp. 26–27).

The pressure conditions and pressure application process described in JP A-61-147244 (page 27) can be used for the lamination of the light-sensitive material and the dye fixing material.

The processing of the present photographic element can be accomplished by means of any suitable heat development apparatus including those described in JP-A-59-75247, JP-A-59-177547, JP-A-59-181353, and JP-A- 60-18951, and JP-A-U-62-25994. (The term "JP-A-U" as used herein means an "unexamined published Japanese utility model application".)

The present compound can also be used for a so-called color diffusion transfer silver halide photographic material which is adapted to be developed with a processing solution at nearly room temperature. Examples of such a color diffusion transfer process are described in Belgium Patent No. 757,959. As a dye-providing substance to be used in the color diffusion transfer process there may be used a compound of the general formula (I) wherein PUG is a diffusible dye or a compound of the general formula (LI).

The photographic element for use in the color diffusion transfer process will be further described hereinafter.

Preferably, the photographic element for use in the color diffusion transfer process may be a film unit comprising a combination of a light-sensitive material (light sensitive element) and a dye fixing material (image receiving element).

In a typical embodiment of such a film unit, the image receiving element and the light-sensitive element are laminated on a transparent support having a structure such that the light-sensitive element needs not be peeled off the image receiving element after the completion of transfer images. More particularly, the image receiving element consists of at least one mordant layer. In its preferred embodiment, the light-sensitive element may comprise a combination of a blue-sensitive emulsion layer, a green-sensitive emulsion layer, and a red-sensitive emulsion layer, a combination of a green-sensitive emulsion layer, a red-sensitive emulsion layer, and an infrared-sensitive emulsion layer, or a combination of a blue-sensitive emulsion layer, a red-sensitive emulsion layer, and an infrared-sensitive emulsion layer, each emulsion layer comprising a combination of a yellow dye-providing substance, a magenta dye providing substance and a cyan dye-providing substance. The term "infrared-sensitive emulsion layer" as used herein means an emulsion sensitive to light having a wavelength of 700 nm or more, particularly 740 nm or more. A white reflective layer containing a solid pigment such as titanium oxide may be provided interposed between the mordant layer and the light-sensitive layer or the dye-providing substance-containing layer so that the transfer images can be viewed through the transparent support. A light screen layer may be provided interposed between the white reflective layer and the light-sensitive layer so that the development can be effected in the daylight If desired, a release layer may be provided in a proper position so that the light-sensitive element can be entirely or partially peeled off the image receiving element. This embodiment is described in JP-A-56-67840 and Canadian Patent No. 674,082.

In another peelless embodiment, the light-sensitive element is coated on a transparent support, a white reflective layer is coated on the light-sensitive element, and an image receiving layer is laminated on the white reflective layer. In an embodiment described in U.S. Pat. No. 3,730,718, an image receiving element, a white reflective layer, a release layer, and light-sensitive element are laminated on the same support in such a way that the light-sensitive element can be peeled off the image receiving element. Typical embodiments of a structure comprising a light-sensitive element and an image receiving element coated on two separate supports can be roughly classified into two embodiments, i.e., peel type and peelless type film units. More particularly, a preferred embodiment of the peel type film unit comprises a light reflective layer provided behind the support and at least one image receiving layer coated on the surface of the light reflective layer. Furthermore, the light-sensitive element is coated on a support having a light screen layer in such a way that the light-sensitive layer-coated surface and the mordant layer-coated surface are not opposed to each other before the completion of exposure but the light-sensitive layer-coated surface is reversed and laminated on the image receiving layer-coated surface after the completion of exposure (e.g., during development). Once transfer images are completed in the mordant layer, the light-sensitive element is readily peeled off the image receiving element.

In a preferred embodiment of the peelless film unit, at least one mordant layer is coated on a transparent support and a light-sensitive element is coated on a transparent support or a support comprising a light screen layer in such a way that the light-sensitive layer-coated surface and the mordant layer-coated surface are laminated opposed to each other.

The above described photographic element for use in the color diffusion transfer process may be combined with a pressure-rupturable vessel containing an alkaline processing solution (processing element) In the peelless film unit comprising an image receiving element and a light-sensitive element laminated on a support, this processing element is preferably provided interposed between the light-sensitive element and a cover sheet laminated thereon. In the embodiment comprising a light-sensitive element and an image receiving element coated on two separate supports, this processing element is preferably provided interposed between the light-sensitive element and the image receiving element at latest during the development. This processing element may preferably comprise a light screen layer (e.g., carbon black or dye which changes color with different pH values) and/or a white pigment (e.g., titanium oxide) depending on the embodiment of film unit. In a film unit for use in the color diffusion transfer process, a neutralization timing mechanism made of a combination of a neutralizing layer and a neutralization timing layer is preferably incorporated in the cover sheet, image receiving element or light-sensitive element.

The present invention will be further described in the following examples, but the present invention should not be construed as being limited thereto.

EXAMPLE 1

A test element was prepared by coating the following layers (I) and (II) in this order on a transparent polyethylene terephthalate support.

Layer (I): Coloring material containing:

(a) Gelatin dispersion of the present compound 1 (reducible dye-providing substance) (0.27 mmol/m$^2$) and tricresyl phosphate (0.4 g/m$^2$);

(b) Gelatin dispersion of 1-phenyl-4-methyl-4-stearoyloxymethyl-3-pyrazolidone (0.52 mmol/m$^2$) and tricresyl phosphate (0.2 g/m$^2$);

(c) Guanidinetrichloroacetic acid (0.22 g/m$^2$);

(d) Th following compound (0.1 g/m$^2$):

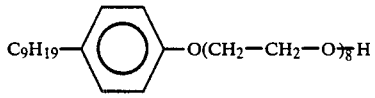

and gelatin (1.2 g/m$^2$, including gelatin contained in the dispersions (a) and (b)).

Layer (II): Protective layer containing:

(a) Guanidinetrichloroacetic acid (0.37 g/m$^2$); and gelatin (1 g/m$^2$).

Thus, Test Element 101 was prepared. Test Elements 102 to 106 were then prepared in the same manner as in Test Element 101 except that the dye-providing substance 1 to be incorporated in Layer (I) was replaced by Compounds 2, 3, 4, 7, and 10 as described herein respectively.

The process for the preparation of an image receiving sheet comprising a dye fixing layer will be described hereinafter.

10 g of poly(methyl acrylate-co-N,N,N-trimethyl-N-vinylbenzylammonium chloride) (proportion of methyl acrylate to vinylbenzylammonium chloride: 1:1) was dissolved in 200 ml of water. The aqueous solution thus obtained was then uniformly mixed with 100 g of 10% lime-treated gelatin. The mixed solution was then uniformly coated on a polyethylene terephthalate film to a wet film thickness of 20 μm to obtain an image receiving sheet.

Test Elements 101 to 106 thus prepared were then heated for a predetermined period of time over a heat block which had been heated to a temperature of 140° C. Water was supplied to these test elements in an amount of 8 ml/m$^2$. These test elements were brought into close contact with the image receiving sheet in such a manner that the coated surface thereof was opposed to the image receiving sheet. The lamination was then heated to a temperature of 90° C. for 20 seconds so that the dye was transferred to the image receiving sheet. The image receiving sheet was then peeled off these test elements. On heating at the first stage, the reducible dye-providing substance was reduced by an electron donor to release the dye. Thus, a high transfer color density was obtained.

Table 1 shows the time required for half the dye-providing substance to release the dye (T50%) together with the ultimate density (reflection).

TABLE 1

| Test Element No. | Exemplary Compound | T50% (sec) | Ultimate Density (reflection) |
|---|---|---|---|
| 101 | 1 | 28 | 1.33 (yellow) |
| 102 | 2 | 23 | 1.38 (magenta) |
| 103 | 3 | 32 | 1.41 (cyan) |
| 104 | 4 | 19 | 1.62 (yellow) |
| 105 | 7 | 20 | 1.50 (yellow) |
| 106 | 10 | 16 | 1.69 (yellow) |

Table 1 shows that the dye-providing substances of the present invention can release a dye in a sufficiently short period of time. It can also be seen that by properly selecting the structure of substituent, the rate at which the dye-providing substances of the present invention release the dye can be easily controlled.

EXAMPLE 2

Light-sensitive Element 201 was prepared by coating the following layers in this order on a transparent polyethylene terephthalate support.

Layer (I): Light-sensitive silver layer containing:

(a) Light-sensitive silver bromoiodide emulsion (0.36 g Ag/m$^2$);

(b) Benzotriazole silver emulsion (0.18 g Ag/m$^2$);

(c) Gelatin dispersion of Compound 1 of the present invention (0.27 mmol/m$^2$) and tricresyl phosphate (1 g/m$^2$);

(d) Gelatin dispersion of 1-phenyl-4-methyl-4-stearoyloxymethyl-3-pyrazolidone (0.27 mmol/m$^2$) and tricresyl phosphate (0.2 g/m$^2$);

(e) Base precursor of the following structural formula (0.44 g/m$^2$):

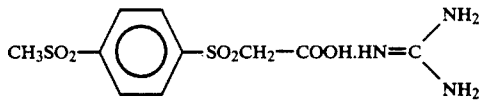

(f) Compound of the structural formula (0.1 g/m$^2$):

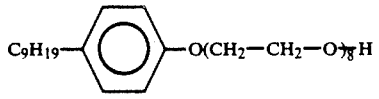

and gelatin (1.2 g/m$^2$, including gelatin contained in the components (a) to (d)).

Layer (II): Protective layer containing:

(a) Base precursor as used in Layer (I) (0.74 g/m$^2$); and gelatin (1 g/m$^2$).

Light-sensitive Elements 202 to 206 were then prepared in the same manner as in Light-sensitive Element 201 except that Compound 1 to be incorporated in Layer (I) was replaced by Compounds 2, 3, 4, 7, and 10, respectively. These test elements were then exposed to light and uniformly heated for 30 seconds over a heating plate which had been heated to a temperature of 140° C. Water was supplied to an image receiving sheet which had been prepared in the same manner as in Example 1 in an amount of 8 ml/m$^2$. These test elements were then brought into close contact with the image receiving sheet. The laminations were then heated to a temperature of 90° C. for 20 seconds. When the image receiving sheet was peeled off the test elements, positive color images were obtained on the image receiving sheet.

The positive color images were then measured for sensitometry. The results of photographic properties are shown in Table 2.

TABLE 2

| Test Element No. | Exemplary Compound | Max. Density (reflection) | Min. Density |
|---|---|---|---|
| 201 | 1 | 1.32 | 0.20 |
| 202 | 2 | 1.40 | 0.22 |
| 203 | 3 | 1.35 | 0.23 |
| 204 | 4 | 1.55 | 0.32 |
| 205 | 7 | 1.50 | 0.30 |
| 206 | 10 | 1.68 | 0.47 |

EXAMPLE 3

The preparation of Emulsion (I) for the 1st layer will be described hereinafter.

600 ml of an aqueous solution containing sodium chloride and potassium bromide and an aqueous solution of silver nitrate (obtained by dissolving 0.59 mol of silver nitrate in 600 ml of water) were simultaneously added to an aqueous solution of gelatin (obtained by dissolving 20 g of gelatin and 3 g of sodium chloride in 1,000 ml of water, kept at a temperature of 75° C.) at the same flow rate with vigorous stirring in 40 minutes. Thus, a monodisperse emulsion of particulate cubic silver bromochloride having an average grain size of 0.35 μm (bromine content: 80 mol %) was prepared.

After being washed with water and desalted, the emulsion was then subjected to chemical sensitization with 5 mg of sodium thiosulfate and 20 mg of 4-hydroxy-6-methyl-1,1,3a,7-tetrazaindene at a temperature of 60° C.

The preparation of Emulsion (II) for the 3rd layer will be described hereinafter.

600 ml of aqueous solution containing sodium chloride and potassium bromide, an aqueous solution of silver nitrate (obtained by dissolving 0.59 mol of silver nitrate in 600 ml of water) and the undermentioned dye solution (I) were simultaneously added to an aqueous solution of gelatin (obtained by dissolving 20 g of gelatin and 3g of sodium chloride in 1,000 ml of water, kept at a temperature of 75° C.) at the same flow rate with vigorous stirring in 40 minutes. Thus, a monodisperse emulsion of dye-adsorbed particulate cubic silver bromochloride having an average grain size of 0.35 μm (bromine content: 80 mol %) was prepared.

After being washed with water and desalted, the emulsion was then subjected to chemical sensitization with 5 mg of sodium thiosulfate and 20 mg of 4-hydroxy-6-methyl-1,3,3a,7-tetrazaindene at a temperature of 60° C. The yield of the emulsion was 600 g.

Dye Solution (I)

Dye of the structural formula:

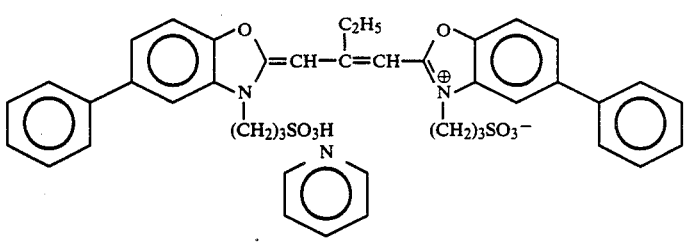

160 mg

Methanol 400 mg

The preparation Emulsion (III) for the 5th layer will be described hereinafter.

1,000 ml of an aqueous solution containing potassium iodide and potassium bromide and an aqueous solution (obtained by dissolving 1 mol of silver nitrate in 1,000 ml of water) were simultaneously added to an aqueous solution (obtained by dissolving 20 g of gelatin and ammonium in 1,000 ml of water, kept at a temperature of 50° C.) while the pAg value thereof was kept constant. Thus, a monodisperse emulsion of particulate octahedral silver bromoiodide having an average grain size of 0.5 μm (iodine content: 5 mol %) was prepared.

After being washed with water and desalted, the emulsion was then subjected to gold and sulfur sensitization with 5 mg of chloroauric acid (tetrahydrate) and 2 mg of sodium thionitrate at a temperature of 60° C. The yield of the emulsion was 1 kg.

The preparation of a gelatin dispersion of a dye-providing substance will be described hereinafter.

18 g of a yellow dye-providing substance (1) (the present compound (1)), 13 g of an electron donor (ED-1) and 9 g of tricyclohexyl phosphate were measured out and then dissolved in 46 ml of cyclohexanone on heating at a temperature of about 60° C. to obtain a homogenous solution. The solution thus obtained was then mixed with 100 g of a 10% aqueous solution of lime-treated gelatin, 60 ml of water and 1.5 g of sodium dodecylbenzenesulfonate. The mixture was then dispersed at 10,000 rpm in a homogenizer for 10 minutes. Thus, a dispersion of a yellow dye-providing substance was prepared.

A dispersion of a magenta dye-providing substance and a dispersion of a cyan dye-providing substance were then prepared in the same manner as in the dispersion of a yellow dye-providing substance except that the yellow dye-providing substance was replaced by a magenta dye-providing substance (2) (the present compound (2)) and a cyan dye-providing substance (3) (the present compound (3)), respectively.

With these materials, a multilayer color light-sensitive material specimen 301 as shown in Table 3 was prepared.

TABLE 3

| Layer No. | Layer Name | Additive | Added amount ($g/cm^2$) |
|---|---|---|---|
| 6th layer | Protective layer | Gelatin | 0.91 |
| | | Matting agent (silica) | 0.03 |
| | | Water-soluble polymer (1)* | 0.23 |
| | | Surface active agent (1)* | 0.06 |
| | | Surface active agent (2)* | 0.13 |
| | | Film hardener (1)* | 0.01 |
| | | $ZnSO_4 \cdot 7H_2O$ | 0.06 |
| 5th layer | Blue light-sensitive layer | Emulsion (III) | 0.58 (as calculated in terms of silver) |
| | | Gelatin | 0.68 |
| | | Fog inhibitor (1)* | $0.36 \times 10^{-3}$ |
| | | Yellow dye-providing substance (1) (present compound (1)) | 0.50 |
| | | High boiling organic solvent (1)* | 0.25 |
| | | Electron donor (ED-1) | 0.35 |
| | | Surface active agent (3)* | 0.05 |
| | | Electron transfer agent (X-2) | 0.04 |
| | | Film hardener (1)* | 0.01 |
| | | Water-soluble polymer (3)* | 0.03 |
| | | Water-soluble polymer (2)* | 0.02 |
| 4th layer | Interlayer | Gelatin | 0.75 |
| | | $Zn(OH)_2$ | 0.32 |
| | | Surface active agent (1)* | 0.02 |
| | | Surface active agent (4)* | 0.07 |
| | | Water-soluble polymer (2)* | 0.02 |
| | | Film hardener (1)* | 0.01 |
| | | Reducing agent (1)* | 0.27 |
| 3rd layer | Green light-sensitive layer | Emulsion (II) | 0.41 (as calculated in |

TABLE 3-continued

| Layer No. | Layer Name | Additive | Added amount ($g/cm^2$) |
|---|---|---|---|
| | | | terms of silver) |
| | | Gelatin | 0.47 |
| | | Fog inhibitor (1)* | $1.25 \times 10^{-3}$ |
| | | Magenta dye-providing substance (2) (present compound (2)) | 0.37 |
| | | High boiling organic solvent (1)* | 0.19 |
| | | Electron donor (ED-6) | 0.20 |
| | | Surface active agent (3)* | 0.04 |
| | | Electron transfer agent (X-2) | 0.04 |
| Film hardener (1)* | 0.01 | | |
| | | Water-soluble polymer (3)* | 0.03 |
| | | Water-soluble polymer (2)* | 0.02 |
| 2nd layer | Interlayer | Gelatin | 0.80 |
| | | $Zn(OH)_2$ | 0.31 |
| | | Surface active agent (1)* | 0.06 |
| | | Surface active agent (4)* | 0.10 |
| | | Water-soluble polymer (2)* | 0.03 |
| | | Film hardener (1)* | 0.01 |
| | | Reducing agent (1)* | 0.27 |
| 1st layer | Red light-sensitive layer | Emulsion (I) | 0.36 (as calculated in terms of silver) |
| | | Sensitizing dye (1)* | $1.07 \times 10^{-3}$ |
| | | Gelatin | 0.49 |
| | | Fog inhibitor (1)* | $1.25 \times 10^{-3}$ |
| | | Cyan dye-providing substance (3) (present compound (3)) | 0.40 |
| | | High boiling organic solvent (1)* | 0.20 |
| | | Electron donor (ED-6) | 0.14 |
| | | Surface active agent (3)* | 0.04 |
| | | Electron transfer agent (X-2) | 0.04 |
| | | Film hardener (1)* | 0.01 |
| | | Water-soluble polymer (2)* | 0.02 |
| | | Water-soluble polymer (3)* | 0.03 |
| Support | | (polyethylene terephthalate; 100 μm thick) | |
| Backing layer | | Carbon black | 0.44 |
| | | Polyester | 0.30 |
| | | Polyvinyl chloride | 0.30 |

Water-soluble polymer (1)*: Sumikagel® L-5 (H) (made by Sumitomo Chemical Co., Ltd.)

Water-soluble polymer (2)*:

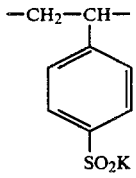

Water-soluble polymer (3)*:

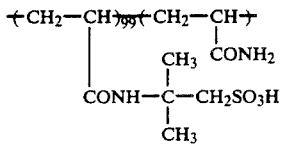

Surface active agent (1)*: Aerosol® OT

Surface active agent (2)*:

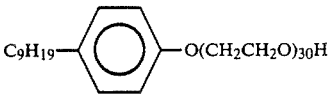

Surface active agent (3)*:

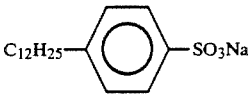

Surface active agent (4)*:

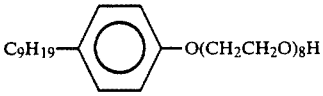

Film hardener (1)*: 1,2-bis(vinylsulfonylacetamido)ethane

Reducing agent (1)*:

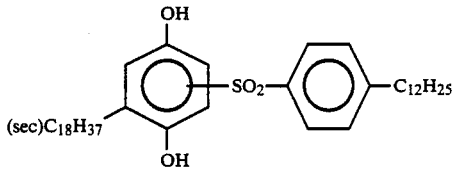

High boiling organic solvent (1)*:
Tricyclohexyl phosphate
Fog inhibitor (1)*:

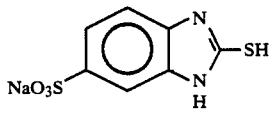

Sensitizing dye (1)*:

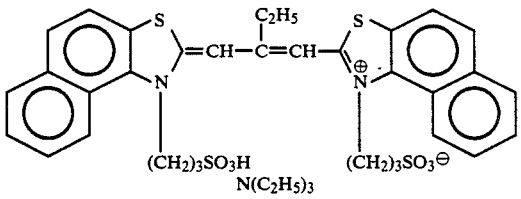

Light-sensitive Element 302 was prepared in the same manner as in Light-sensitive Element 301 except that the yellow dye-providing substance (1) (present compound (1)) to be incorporated in the 5th layer, the magenta dye-providing substance (2) (present compound (2)) to be incorporated in the 3rd layer and the cyan dye-providing substance (3) (present compound (3)) to be incorporated in the 1st layer were replaced by Compounds 4, 5 and 6, respectively.

The preparation of a dye fixing material will be described hereinafter.

63 g of gelatin, 130 g of a mordant of the undermentioned structural formula, and 80 g of guanidine picrate were dissolved in 1,300 ml of water The solution was then coated on a polyethylene-laminated paper support to a wet film thickness of 45 μm. The coat was then dried.

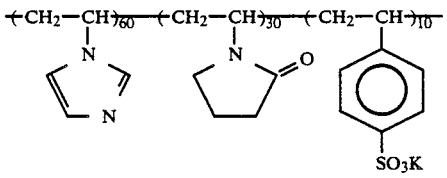

A solution obtained by dissolving 35 g of gelatin and 1.05 g of a film hardener (1,1-bis(vinylsulfonylacetamido)ethane in 800 ml of water was further coated on the coat thus obtained to a wet film thickness of 17 μm. The coat was then dried to prepare a dye fixing material.

The multilayer color light-sensitive material of specimens 301 and 302 were then exposed to light of 2,000 lux from a tungsten lamp through a color separation filter (B, G, R and grey) having a continuous density gradation for 1 second.

Water was then supplied to the emulsion surface of the color light-sensitive materials thus exposed through a wire bar in an amount of 15 ml/m². These light-sensitive materials were then superimposed on the dye fixing material such that the film surface thereof was brought into contact with the dye fixing material.

The lamination was then heated for 20 seconds by means of a heat roller which had been temperature-adjusted so that the temperature of the film was kept at 85° C. When the dye fixing material was then peeled off the light-sensitive material, sharp blue, green, red and grey images were obtained on the dye fixing material in correspondence to the B, G, R and grey color separation filters. These images were measured for maximum density ($D_{max}$) and minimum density ($D_{min}$). The results are shown in Table 4.

TABLE 4

| Light-sensitive Element No. | | Maximum Density | Minimum Density |
|---|---|---|---|
| 301 | B | 1.43 | 0.19 |
| | G | 1.40 | 0.21 |
| | R | 1.58 | 0.23 |
| 302 | B | 1.65 | 0.24 |
| | G | 1.69 | 0.25 |
| | R | 1.80 | 0.28 |

Table 4 shows that the present color light-sensitive material can provide an excellent positive image with a high maximum density and a low minimum density.

EXAMPLE 4

Light-sensitive Element 401 was prepared by coating the following layers in the order indicated below onto a transparent polyethylene terephthalate Layer (I): Dye receiving layer containing:
(a) Copoly[styrene-N-vinylbenzyl-N,N,N-trihexylammonium] (4.0 g/m²); and
(b) Gelatin (4.0 g/m²).

Layer (II): White reflective layer containing:
(a) Titanium dioxide (22 g/m²); and
(b) Gelatin (2.2 g/m²)

Layer (III): Opaque layer containing:
(a) Carbon black (2.7 g/m²); and
(b) Gelatin (2.7 g/m²).

Layer (IV): Cyan dye-providing layer containing:
(a) Gelatin dispersion of the present cyan dye-providing compound 9 (present compound (9)) (0.33 mmol/m²) and Compound SR-1* (0.4 mmol/m²); and
(b) Gelatin (1.1 g/m², including gelatin contained in the dispersion (a)).

SR-1*

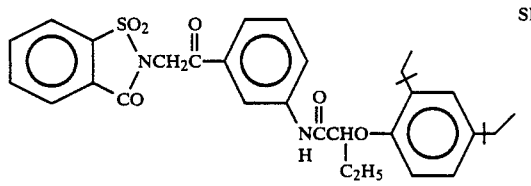

Layer (V): Red-sensitive layer containing:
(a) Red-sensitive silver bromoiodide emulsion (0.5 g Ag/m²); and
(b) Gelatin (1.1 g/m², including gelatin contained in the dispersion (a)).

Layer (VI): Interlayer containing:
(a) 2,5-Di(t-pentadecyl)hydroquinone (0.82 g/m²);

(b) Vinyl acetate (0.8 g/m$^2$); and (c) Gelatin (0.4 g/m$^2$).

Layer (VII): Magenta dye-providing layer containing:

(a) Gelatin dispersion of the present magenta dye-providing compound 8 (present compound (8)) (0.3 mmol/m$^2$) and Compound SR-1 (0.4 mmol/m$^2$); and (b) Gelatin (1.1 g/m$^2$, including gelatin contained in the dispersion (a)).

Layer (VIII): Green-sensitive layer containing:

(a) Green-sensitive silver bromoiodide emulsion (0.5 g Ag/m$^2$); and (b) Gelatin (1.1 g/m$^2$, including gelatin contained in the dispersion (a)).

Layer (IX): Same interlayer as Layer (VI)

Layer (X): Yellow dye providing layer containing:

(a) Gelatin dispersion of the present yellow dye-providing compound 7 (present compound (7)) (0.5 mmol/m$^2$) and Compound SR-1 (0.6 mmol/m$^2$); and (b) Gelatin (1.1 g/m$^2$, including gelatin contained in the dispersion (a)).

Layer (XI): Blue-sensitive layer containing:

(a) Blue-sensitive silver bromoiodide emulsion (0.5 g/m$^2$); and (b) Gelatin (1.1 g/m$^2$, including gelatin contained in the dispersion (a)).

Layer (XII): Protective layer containing:

(a) Latex of polyethylene acrylate (0.9 g/m$^2$);

(b) Tinuvin ® (0.5 g/m$^2$);

(c) Film hardener (triacryloyl perhydrotriazine) (0.026 g/m$^2$); and (d) Gelatin (1.3 g/m$^2$).

A cover sheet was then prepared by coating the following layers in the below order onto a transparent polyethylene terephthalate film.

Layer (I): Acid neutralizing layer containing:

(a) Polyacrylic acid (17 g/m$^2$);

(b) N-hydroxysuccinimide benzenesulfonate (0.06 g/m$^2$); and (c) Ethylene glycol (0.5 g/m$^2$).

Layer (II): Timing layer comprising a 2-μm thick coat of cellulose acetate (acetylation degree: 54%)

Layer (III): Timing layer comprising a 4-μm thick coat of a copolymerized latex of vinylidene chloride and acrylic acid.

A processing solution of the following composition was prepared.

| | |
|---|---|
| Potassium hydroxide | 48 g |
| 4-Hydroxymethyl-4-methyl-1-p-tolyl-3-pyrazolidinone | 10 g |
| 5-Methylbenzotriazole | 2.5 g |
| Sodium sulfite | 1.5 g |
| Potassium bromide | 1 g |
| Benzyl alcohol | 1.5 ml |
| Carboxymethyl cellulose | 6.1 g |
| Carbon black | 150 g |
| Water to make | 1 l |

Light sensitive Element 401 was exposed to light through a wedge. The light-sensitive element was super-imposed on the cover sheet. The processing solution was uniformly spread between the light-sensitive element and the cover sheet to a thickness of 80 μm by means of a pair of juxtaposed rollers.

After being processed, the light-sensitive element then measured for sensitometry. The results are shown in Table 5. Table 5 shows that the present light-sensitive material can provide an excellent color image with less turbidity in white portions and higher transfer dye density.

TABLE 5

| | B | G | R |
|---|---|---|---|
| Maximum Density | 1.62 | 1.53 | 1.70 |
| Minimum Density | 0.28 | 0.20 | 0.41 |

EXAMPLE 5

Laminated color diffusion transfer light-sensitive sheets and a cover sheet were prepared in accordance with the following manner.

Preparation of Light-sensitive Sheet

Light-sensitive sheets 501 to 509 were prepared by coating the following layers in the below order on a transparent polyethylene terephthalate support.

(1) Image receiving layer containing copoly[styrene N-vinylbenzyl-N-methylpiperidinium chloride] (3.0 g/m$^2$) and gelatin (3.0 g/m$^2$).

(2) White reflective layer containing titanium dioxide (20 g/m$^2$) and gelatin (2.0 g/m$^2$).

(3) Light-shielding layer containing carbon black (2.0 g/m$^2$) and gelatin (1.5 g/m$^2$).

(4) Layer containing the below illustrated cyan dye-releasing redox compound of the present invention (0.44 g/m$^2$), tricyclohexyl phosphate (0.09 g/m$^2$), 2,5-di-t-pentadecylhydroquinone (0.008 g/m$^2$), and gelatin (0.8 g/m$^2$).

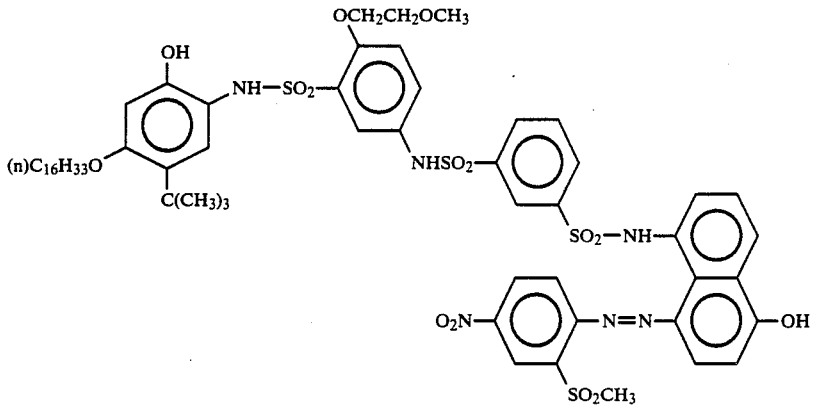

(5) Red-sensitive emulsion layer containing a red-sensitive internal latent image type direct positive silver bromide emulsion (1.03 g as calculated in terms of silver), gelatin (1.2 g/m$^2$), the below illustrated nucleating agent (0.04 mg/m$^2$), and sodium 2-sulfo-5-n-pentadecylhydroquinone (0.13 g/m$^2$).

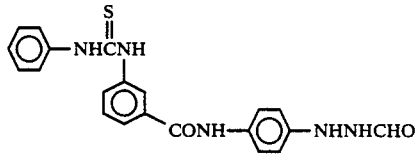

(6) Layer containing 2,5-di-t-pentadecylhydroquinone (0.43 g/m$^2$), trihexyl phosphate (0.100 g/m$^2$) and gelatin (0.43 g/m$^2$).

(7) Layer containing the below illustrated magenta dye-releasing redox compound of the present invention (0.3 g/m$^2$), tricyclohexyl phosphate (0.08 g/m$^2$), 2,5-di-tert-pentadecylhydroquinone (0.009 g/m$^2$) and gelatin (0.5 g/m$^2$).

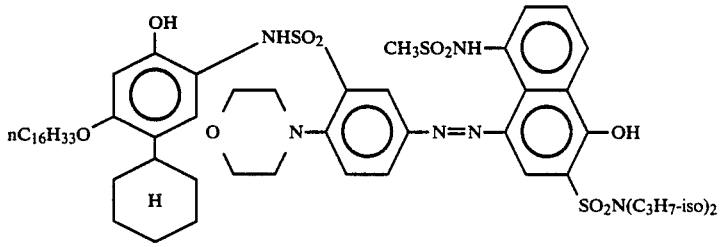

(8) Green-sensitive emulsion layer containing a green-sensitive internal latent image type direct positive silver bromide emulsion (0.82 g/m$^2$ as calculated in terms of silver), gelatin (0.9 g/m$^2$), the same nucleating agent as used in the layer (5) (0.03 mg/m$^2$), and sodium 2 sulfo-5-n-pentadecylhydroquinone (0.08 g/m$^2$).

(9) Same layer as the layer (6).

(10) Layer containing a yellow dye-releasing redox compound of the below illustrated structural formula of the present invention (0.53 g/m$^2$), tricyclohexyl phosphate (0.13 g/m$^2$), 2,5-di-t-pentadecylhydroquinone (0.014 g/m$^2$), and gelatin (0.7 g/m$^2$).

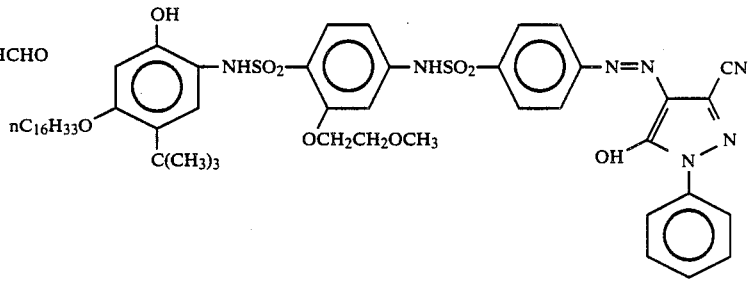

(11) Blue-sensitive emulsion layer containing a blue-sensitive internal latent image type direct positive silver bromide emulsion (1.09 g/m$^2$ as calculated in terms of silver), gelatin (1.1 g/m$^2$), the nucleating agent as used in the layer (5) (0.04 mg/m$^2$), sodium 2-sulfo-5-n-pentadecylhydroquinone, and each of compounds as shown in Table 6 (amounts shown in Table 6).

(12) Ultraviolet absorbing layer containing ultraviolet absorbers of the below illustrated undermentioned structural formulas (4×10 mols/m$^2$ each), and gelatin (0.30 g/m$^2$).

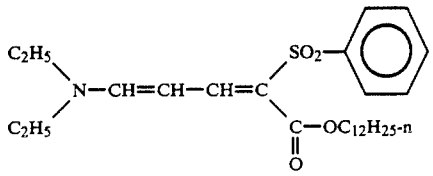

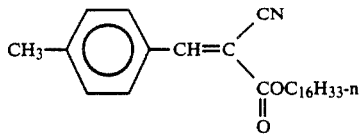

(13) Protective layer containing a polymethyl methacrylate latex (average particle size: 4 μm, 0.10 gelatin (0.8 g/m$^2$), and a film hardener (triacroyl triazine) (0.02 g/m$^2$).

Preparation of Cover Sheet A

A cover sheet was prepared by coating the following layers (1') to (4') in the below order on a transparent polyethylene terephthalate support.

(1') Neutralizing layer containing an acrylic acid-butyl acrylate copolymer (weight ratio: 8:2) with an average molecular weight of 50,000 (10 g/m$^2$), and 1,4-bis(2,3-epoxypropoxy)butane (0.2 g/m$^2$).

(2) 2nd timing layer containing cellulose acetate with an acetylation degree of 51.0%, and a methyl vinyl ether monomethyl maleate alternating copolymer in a weight proportion of 95/5 (7.5 g/m$^2$).

(3') Auxiliary neutralizing layer containing a methyl vinyl ether-maleic anhydride alternating copolymer (1.05 g/m$^2$), and 5-(2-cyano-1-methylthio)-1-phenyltetrazole (0.98 mmol/m$^2$).

(4') 1st timing layer of 2 μ thickness containing a 6:4 (solids content) mixture of a 49.7:42.3:3:5 copolymer latex of styrene-n-butyl acrylate-acrylic acid-N-methylolacrylamide and a 93:4:3 (weight ratio) copolymer latex of methyl methacrylateacrylic acid-N-methylol acrylamide.

| Composition of Processing Solution A | |
|---|---|
| 1-p-Tolyl-4-hydroxymethyl-4-methyl-3-pyrazolidone | 14 g |
| Methylhydroquinone | 0.3 g |
| 5-Methylbenzotriazole | 3.5 g |
| Sodium sulfite (anhydride) | 0.2 g |
| Sodium carboxymethyl cellulose | 58 g |
| Potassium hydroxide (28% aqueous solution) | 200 cc |
| Benzyl alcohol | 1.5 cc |
| Carbon black | 150 g |
| Water | 685 cc |

Light-sensitive Sheets 501 to 509 thus prepared were exposed to light through a continuous wedge. These sheets were then laminated with the cover sheet previously prepared. Processing solution A was then spread between the light-sensitive sheets and the cover sheet by means of a pair of pressure rollers. After 1 hour, the light-sensitive material was then measured for density by a color densitometer. The results of $D_{max}$ and $D_{min}$ are shown in Table 6.

Shortly after the processing solution was spread, the change in $D_{max}$ was measured every 5 seconds ThuS, the time at which the value of $D_{max}$ reaches half of the $D_{max}$ value at 60 minutes was determined. This time represents transfer speed. The shorter this time is, the better is transfer speed.

Table 6 shows that the photographic elements comprising the present light-sensitive sheet can provide a drastically reduced $D_{min}$ value without lowering $D_{max}$ value and transfer speed.

Another analysis showed that the difference in transfer speed corresponds to the difference in silver development speed. In other words, a low transfer speed is attributed to a low silver development speed.

TABLE 6

| Specimen No. | Compound | Amount mol/m$^2$ | B $D_{max}$ | B $D_{min}$ | Transfer Speed | |
|---|---|---|---|---|---|---|
| 501 | None | 0 | 1.92 | 0.33 | 112 | Comparative |
| 502 | Comparative compound A | $5.0 \times 10^{-5}$ | 1.80 | 0.26 | 153 | Comparative |
| 503 | Comparative compound B | $1.4 \times 10^{-4}$ | 1.90 | 0.34 | 115 | Comparative |
| 504 | Exemplary compound 15 | " | 1.93 | 0.28 | 113 | Present invention |
| 505 | Exemplary compound 16 | " | 1.92 | 0.26 | 114 | Present invention |
| 506 | Exemplary compound 17 | " | 1.93 | 0.28 | 113 | Present invention |
| 507 | Exemplary compound 18 | " | 1.90 | 0.26 | 113 | Present invention |
| 508 | Exemplary compound 19 | " | 1.91 | 0.32 | 112 | Present invention |
| 509 | Exemplary | " | 1.90 | 0.24 | 117 | Present |

TABLE 6-continued

| Specimen No. | Compound | Amount mol/m² | B $D_{max}$ | B $D_{min}$ | Transfer Speed | |
|---|---|---|---|---|---|---|
| | compound 20 | | | | | invention |

Comparative compound A

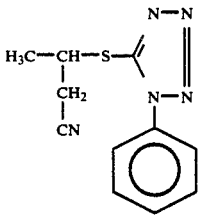

Comparative compound B

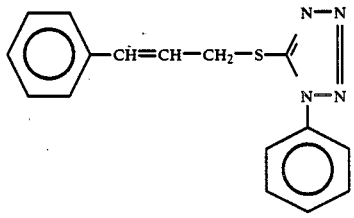

EXAMPLE 6

Preparation of Silver Halide Emulsion

Silver nitrate and an aqueous solution of halogenated alkali were added to a gelatin solution by an ordinary ammonia process to prepare particulate silver bromoiodide having an average grain diameter of 1.0 μm (AgI content: 2mol %). The emulsion was then desalted by an ordinary aggregation process. The emulsion was subjected to gold and sulfur sensitization with chloroacuric acid and sodium thiosulfate. 4-Hydroxy-6-methyl-1,3,3a,7-tetrazaindene was added to the emulsion as a stabilizer to obtain a light-sensitive silver bromoiodide emulsion.

Exemplary compounds as shown in Table 7 were added to the emulsion thus prepared. These coating solutions were then coated on supports and dried to prepare Specimens 601 to 605. These specimens were gradationally exposed to light through an optical wedge by means of a sensitometer. These specimens were then developed for 90 seconds each at temperatures of 35° C. and 37° C. with developing solution A and fixing solution A of the undermentioned compositions in an automatic developing machine RU (made by Fuji Photo Film Co., Ltd.). These specimens were measured for photographic properties. The results are shown in Table 7.

| Developing Solution A | |
|---|---|
| Ethylenediaminetetraacetic acid | 1.2 g |

-continued

| | |
|---|---|
| Sodium sulfite (anhydride) | 50 g |
| Potassium hydroxide | 20.0 g |
| Hydroquinone | 25.0 g |
| 1-Phenyl-3-pyrazolidone | 1.5 g |
| Boric acid | 10.0 g |
| Triethylene glycol | 25.0 g |
| Glutaraldehyde | 5.0 g |
| Potassium bromide | 6.0 g |
| Glacial acetic acid | 3.0 g |
| Sodium bisulfite (anhydride) | 4.5 g |
| 5-Nitroindazole | 0.15 g |
| 5-Methylbenzotriazole | 0.03 g |
| Water to make | 1.0 l |
| pH (at 25° C.) | about 10.30 |

| Fixing Solution A | |
|---|---|
| Ammonium thiosulfate | 200.0 g |
| Sodium sulfite (anhydride) | 20.0 g |
| Boric acid | 8.0 g |
| Ethylenediaminetetraacetic acid | 0.1 g |
| Aluminum sulfate | 15.0 g |
| Sulfuric acid | 2.0 g |
| Glacial acetic acid | 22.0 g |
| Water to make | 1.0 l |
| pH (at 25° C.) | about 4.10 |

TABLE 7

| Specimen No. | Added compound | Added amount (mol/mol Ag) | Fog 35° C. | Fog 37° C. | Relative sensitivity 35° C. | Relative sensitivity 37° C. |
|---|---|---|---|---|---|---|
| 601 (control) | — | — | 0.18 | 0.20 | 100 | 145 |
| 602 | PMT* (comparative) | $3.70 \pm 10^{-4}$ | 0.13 | 0.15 | 75 | 106 |
| 603 | 15 | " | 0.16 | 0.18 | 99 | 141 |
| 604 | 16 | " | 0.16 | 0.17 | 97 | 140 |
| 605 | 20 | " | 0.14 | 0.15 | 95 | 135 |

*1-Phenyl-5-mercaptotetrazole

The sensitivity value shown in Table 7 is the reciprocal of the exposure required to obtain a density of (fog value +1.0). The sensitivity value is represented relative to that of Specimen 601 at a development temperature of 35° C. as 100.

The fog value shown in Table 7 contains base density.

Table 7 shows that Specimens 603 to 605 comprising the present compounds exhibit an effective fog inhibition without deteriorating the sensitivity as compared to Specimen 602 comprising the comparative compound.

Thus, it can be seen that the present compounds are advantageous in that they can inhibit fog without deteriorating the sensitivity, making it possible to constantly provide stable, high quality photographic properties.

EXAMPLE 7

A multilayer color light-sensitive material Specimen 701 was prepared by coating various layers of the undermentioned compositions on a subbed cellulose triacetate film support.

Light-sensitive Layer

The coated amount of silver halide and colloidal silver is represented in g/m$^2$ as calculated in terms of amount of silver. The added amounts of coupler, additives and gelatin are represented in g/m$^2$. The added amount of sensitizing dye are represented in mols per mol of silver halide incorporated in the same layer.

| | |
|---|---|
| 1st Layer (anthihalation layer) | |
| Black colloidal silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| 2nd Layer (interlayer) | |
| Finely divided particulate silver bromide (average grain diameter: 0.07 μm) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| 3rd Layer (1st red-sensitive emulsion layer) | |
| Silver bromoiodide emulsion (AgI content: 2 mol %; internal high AgI type; grain diameter: 0.3 μm (as calculated in terms of sphere); coefficient of fluctuation in grain diameter (as calculated in terms of sphere): 29%; mixture of regular crystal and twin; diameter/thickness ratio: 2.5) | 0.4 |
| Gelatin | 0.6 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.06 |
| ExC-4 | 0.06 |
| ExC-7 | 0.04 |
| ExC-2 | 0.03 |
| Solv-1 | 0.03 |
| Solv-3 | 0.012 |
| 4th Layer (2nd red-sensitive emulsion layer) | |
| Silver bromoiodide emulsion (AgI content: 5 mol %; internal high AgI type; grain diameter: 0.7 μm (as calculated in terms of sphere); coefficient of fluctuation in grain diameter (as calculated in terms of sphere): 25%; mixture of regular crystal and twin; diameter/thickness ratio: 4) | 0.7 |
| Gelatin | 0.5 |
| ExS-1 | $1 \times 10^{-4}$ |
| ExS-2 | $3 \times 10^{-4}$ |
| ExS-3 | $1 \times 10^{-5}$ |
| ExC-3 | 0.24 |
| ExC-4 | 0.24 |
| ExC-7 | 0.04 |
| ExC-2 | 0.04 |
| Solv-1 | 0.15 |

-continued

| | |
|---|---|
| Solv-3 | 0.02 |
| 5th Layer (3rd red-sensitive emulsion layer) | |
| Silver bromoiodide emulsion (AgI content: 10 mol %; internal high AgI type; grain diameter: 0.8 μm (as calculated in terms of sphere); coefficient of fluctuation in grain diameter (as calculated in terms of sphere): 16%, mixture of regular crystal and twin; diameter/thickness ratio: 1.3) | 1.0 |
| Gelatin | 1.0 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.1 |
| Solv-1 | 0.01 |
| Solv-2 | 0.05 |
| 6th Layer (interlayer) | |
| Gelatin | 1.0 |
| Cpd-1 | 0.03 |
| Solv-1 | 0.05 |
| 7th Layer (1st green-sensitive emulsion layer) | |
| Silver bromoiodide emulsion (AgI content: 2 mol %; internal high AgI type; grain diameter: 0.3 μm (as calculated in terms of sphere); coefficient of fluctuation in grain diameter (as calculated in terms of sphere): 28%; mixture of regular crystal and twin; diameter/thickness ratio: 2.5) | 0.30 |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |
| 8th Layer (2nd green-sensitive emulsion layer) | |
| Silver bromoiodide emulsion (AgI content: diameter: 0.6 μm (as calculated in terms of sphere); coefficient of fluctuation in grain diameter (as calculated in terms of sphere): 38%; mixture of regular crystal and twin; diameter/thickness ratio: 4) | 0.4 |
| Gelatin | 0.5 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |
| 9th Layer (3rd green-sensitive emulsion layer) | |
| Silver bromoiodide emulsion (AgI content: internal high AgI type; grain diameter: 1.0 μm (as calculated in terms of sphere); coefficient of fluctuation in grain diameter (as calculated in terms of sphere): 80%; mixture of regular crystal and twin; diameter/thickness ratio: 1.2) | 0.85 |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| 10th Layer (yellow filter layer) | |
| Gelatin | 1.2 |
| Yellow colloidal silver | 0.08 |
| Cpd-2 | 0.1 |
| Solv-1 | 0.3 |
| 11th Layer (1st blue-sensitive emulsion layer) | |

-continued

| | |
|---|---|
| Silver bromoiodide emulsion (AgI content: 4 mol %, internal high AgI type; grain diameter: 0.5 μm (as calculated in terms of sphere); coefficient of fluctuation in grain diameter (as calculated in terms of sphere): 15%; octahedral grain) | 0.4 |
| Gelatin | 1.0 |
| ExS-9 | $2 \times 10^{-4}$ |
| ExY-16 | 0.9 |
| ExY-14 | 0.07 |
| Solv-1 | 0.2 |
| 12th Layer (2nd blue-sensitive emulsion layer) | |
| Silver bromoiodide emulsion (AgI content: 10 mol %; internal high AgI type; grain diameter: 1.3 μm (as calculated in terms of sphere); coefficient of fluctuation in grain diameter (as calculated in terms of sphere): 25%; mixture of regular crystal and twin; diameter/thickness ratio: 4.5) | 0.5 |
| Gelatin | 0.6 |

-continued

| | |
|---|---|
| ExS-9 | $1 \times 10^{-4}$ |
| ExY-16 | 0.25 |
| Solv-1 | 0.07 |
| 13th Layer (1st protective layer) | |
| Gelatin | 0.8 |
| UV-1 | 0.1 |
| UV-2 | 0.2 |
| Solv-1 | 0.01 |
| Solv-2 | 0.01 |
| 14th Layer (2nd protective layer) | |
| Finely divided particulate silver bromide (average grain diameter: 0.07 μm) | 0.5 |
| Gelatin | 0.45 |
| Particulate polymethyl methacrylate (diameter: 1.5 μm) | 0.2 |
| H-1 | 0.4 |
| Cpd-3 | 0.5 |
| Cpd-4 | 0.5 |

Thus, Specimen 701 was prepared.

The structural formula or chemical name of each of the compounds used herein will be shown hereinafter.

UV-1:

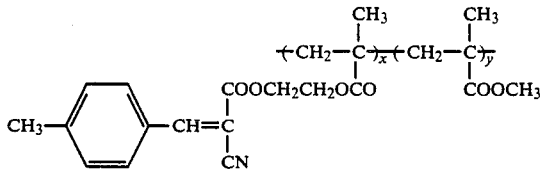

x/y = 7/3 (weight ratio)

UV-2:

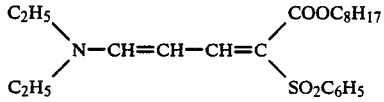

Solv-1: Tricresyl phosphate

Solv-2: Dibutyl phthalate

Solv-3: Bis(2-ethylhexyl) phathalate

ExM-8:

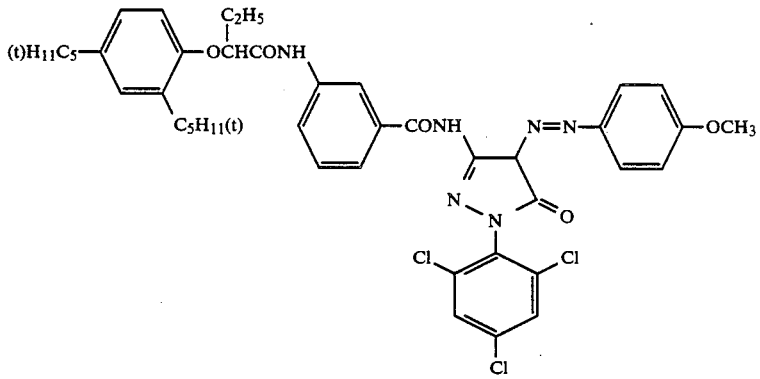

ExF-1:

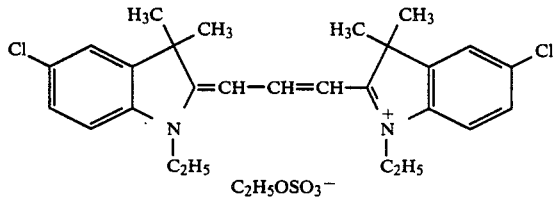

-continued
ExC-2:
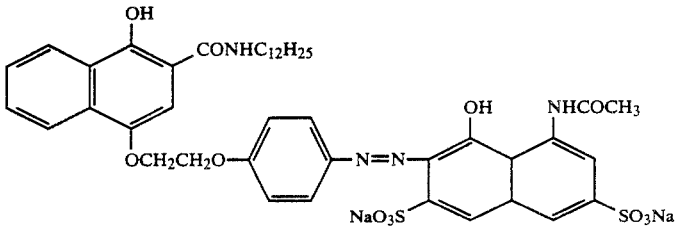
ExC-3:
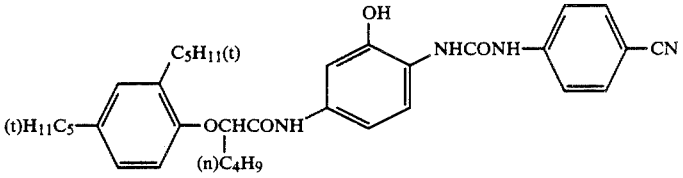
ExC-4:
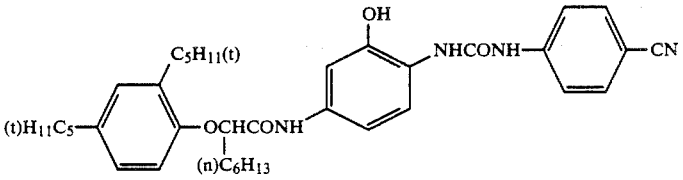
ExY-14
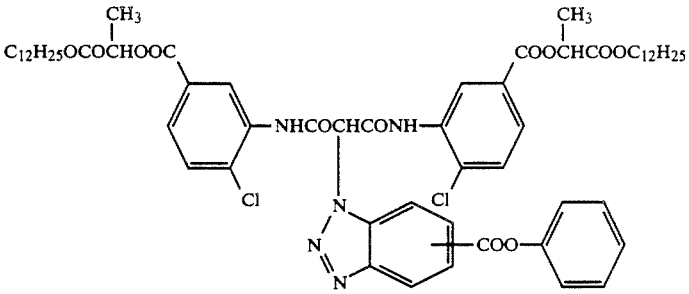
ExY-15
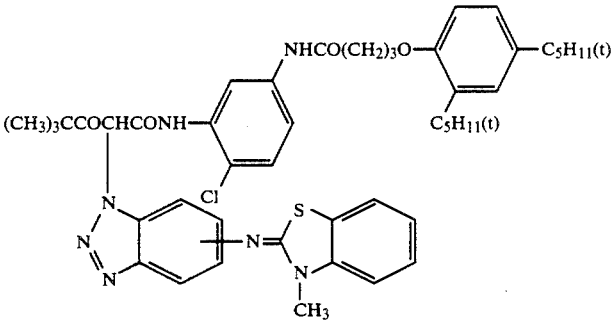
ExC-5:
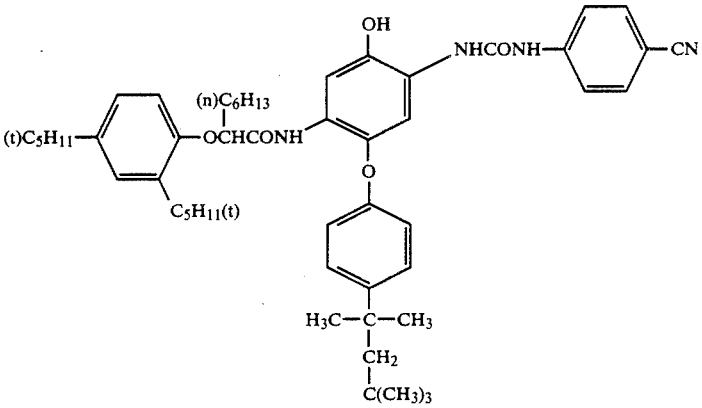

-continued
ExC-6:
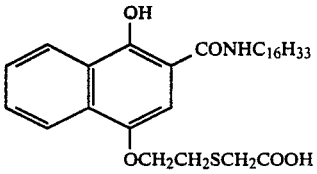
ExC-7:
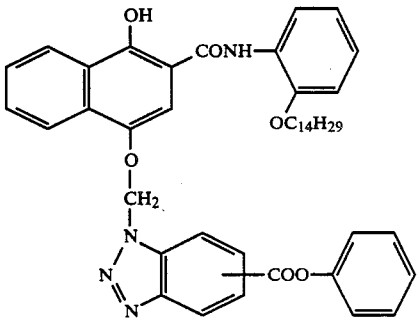
ExM-9:
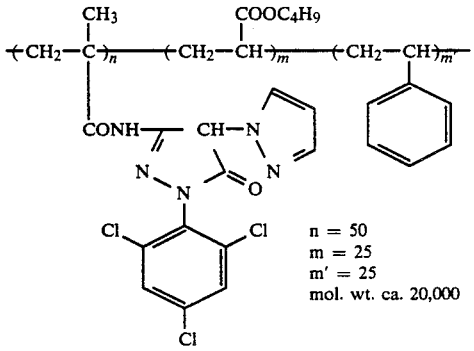
ExM-10:
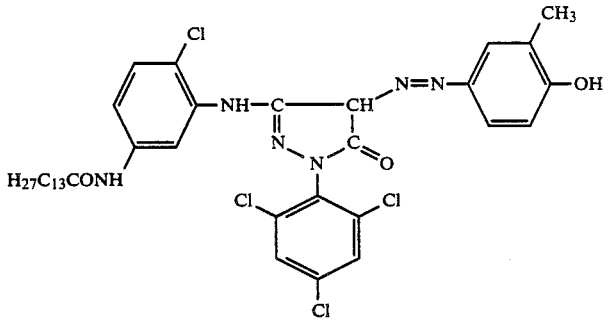
ExM-11:
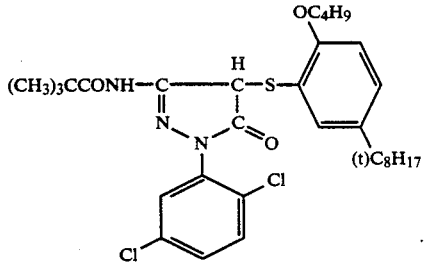

-continued
ExM-12:
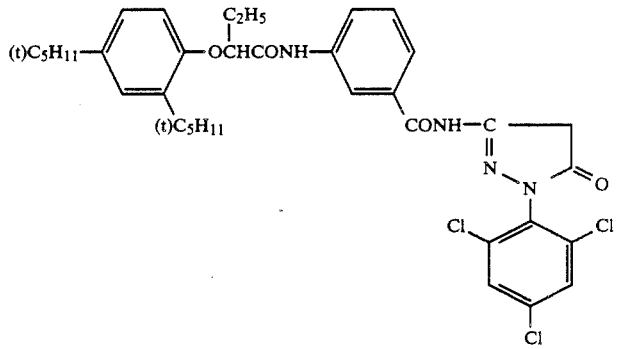
ExM-13:
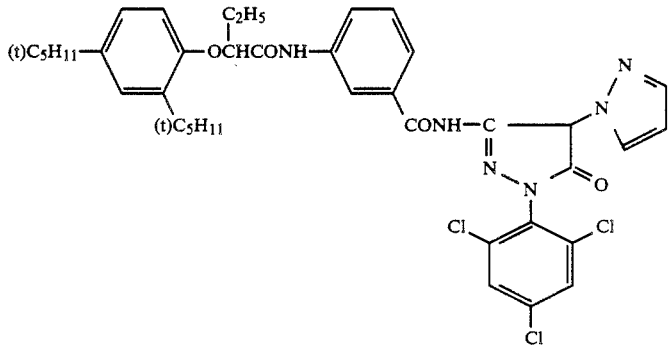
ExY-16:
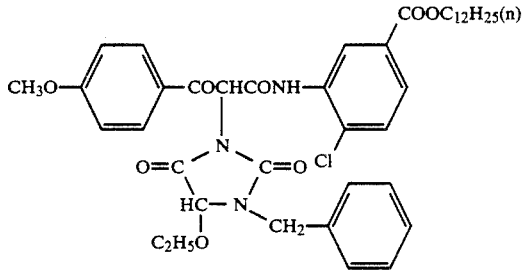
Cpd-1:
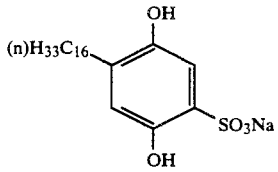
Cpd-2:
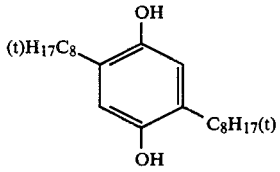
ExS-1:
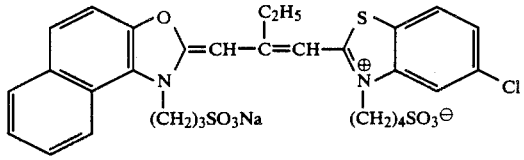

-continued
ExS-2:
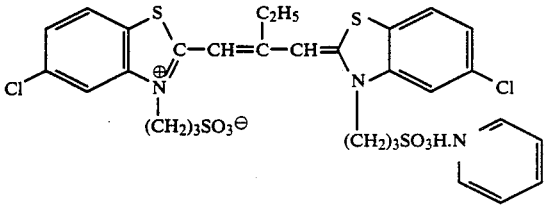
ExS-3:
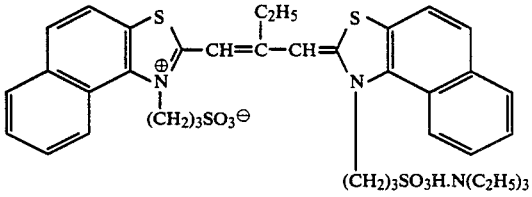
ExS-4:
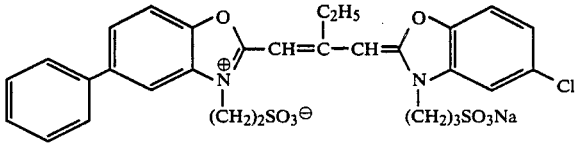
ExS-5:
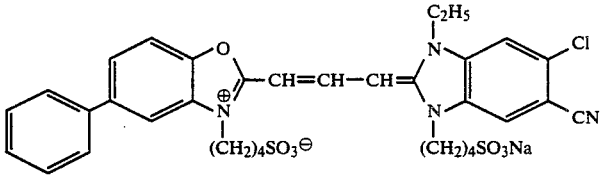
ExS-6:
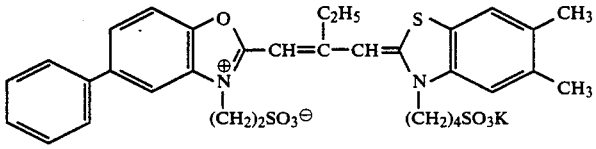
ExS-7:
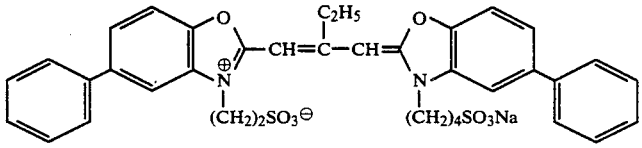
ExS-8:
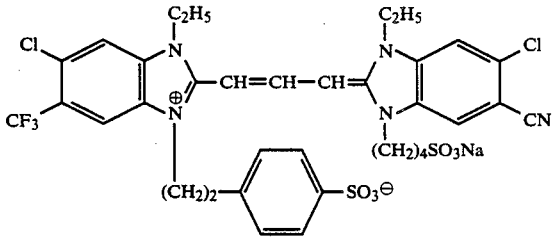
ExS-9:
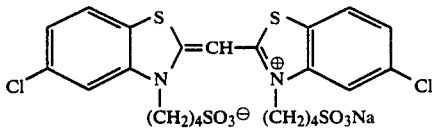
H-1:
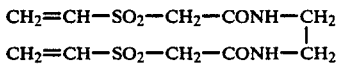

-continued

Cpd-3:

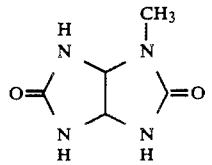

Cpd-4:

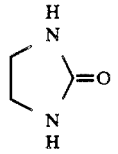

Preparation of Specimens 702 to 704

Specimens 702 to 704 were prepared in the same manner as Specimen 701 except that Comparative Compound PMT, the present compound and ED-2were incorporated in the 5th layer in amounts as shown in Table 8.

These specimens were then imagewise exposed to light from a light source which had been adjusted by a filter so that the color temperature thereof was 4,800° K and the maximum exposure was 10 CMS. These specimens were color developed in the following manner.

The results are shown in Table 8.

| Step | Processing Time | Processing Temperature |
|---|---|---|
| Color development | 3 min. 15 sec. | 38° C. |
| Bleach | 6 min. 30 sec. | 38° C. |
| Rinse | 2 min. 10 sec. | 24° C. |
| Fixing | 4 min. 20 sec. | 38° C. |
| Rinse (1) | 1 min. 05 sec. | 24° C. |
| Rinse (2) | 2 min. 10 sec. | 24° C. |
| Stabilizing | 1 min. 05 sec. | 38° C. |
| Drying | 4 min. 20 sec. | 55° C. |

The composition of the processing solution used will be described hereinafter

| | (unit: g) |
|---|---|
| Color Developing Solution | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-Ethyl-N-β-hydroxyethylamino)-2-methylaniline sulfate | 4.5 |
| Water to make | 1.0 l |
| pH | 10.05 |
| Bleaching Solution | |
| Ferric sodium ethylenediaminetetraacetate (trihydrate) | 100.0 |
| Disodium ethylenediaminetetraacetate | 10.0 |
| Ammonium bromide | 140.0 |
| Ammonium nitrate | 30.0 |
| Aqueous ammonia (27%) | 6.5 ml |
| Water to make | 1.0 l |
| pH | 6.0 |
| Fixing Solution | |
| Disodium ethylenediaminetetraacetate | 0.5 |
| Sodium sulfite | 7.0 |
| Sodium bisulfite | 5.0 |
| 70% aqueous solution of ammonium thiosulfate | 170.0 ml |
| Water to make | 1.0 l |
| pH | 6.7 |
| Stabilizing Solution | |
| Formalin (37%) | 2.0 ml |
| Polyoxyethylene-p-monononylphenyl ether (average polymerization degree: 10) | 0.3 |
| Disodium ethylenediaminetetraacetate | 0.05 |
| Water to make | 1.0 l |
| pH | 5.0-8.0 |

TABLE 8

| Specimen No | Compound | Added Amount | ED-2**** Added Amount | ΔS0.21* | $\Delta D_{min}$** |
|---|---|---|---|---|---|
| 701 | None | 0 | 0 | ±0 | ±0 |
| 702 | PMT*** | $1.6 \times 10^{-4}$ (mol/mol Ag) | 0 | −0.30 | −0.04 |
| 703 | Exemplary compound 15 | $8.0 \times 10^{-4}$ | $8.0 \times 10^{-4}$ | −0.03 | −0.01 |
| 704 | Exemplary compound 20 | " | " | −0.05 | −0.03 |

*ΔS0.2: Change of the logarithm of the exposure E which gives a cyan density of fog + density 0.2 from that of Specimen 701

**$\Delta D_{min}$: Change of the minimum cyan density from that of Specimen 701

***PMT: 1-Phenyl-5-mercaptotetrazole

****ED-2:

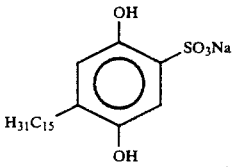

Table 8 shows that Specimens 703 to 704 comprising the present fog inhibitor-releasing compounds and proper reducing agents can exhibit a fog inhibition with little or no deterioration of the sensitivity.

EXAMPLE 8

A multilayer photographic paper (Specimen 801) was prepared by coating various layers of the undermentioned compositions on a paper support comprising polyethylene laminated on both sides thereof.

Coating Solution for 1st Layer 10.2 g of a yellow coupler (ExY-1), 9.1 g of a yellow coupler (ExY-2) and 4.4 g of a dye stabilizer (Cpd-2) were dissolved in 27.2 cc of ethyl acetate and 7.7 cc (8.0 g) of a high boiling solvent (Solv-1). The solution thus prepared was emulsion-dispersed in 185 cc of a 10% aqueous solution of gelatin containing 8 cc of 10% sodium dodecylbenzenesulfonate. The emulsion dispersion, Emulsion EM1 and Emulsion EM2 were mixed. The gelatin concentration of the solution was adjusted so that the undermentioned composition was obtained. Thus, the coating solution for the 1st layer was prepared.

The coating solutions for the 2nd layer to the 7th layer were prepared in the similar manner.

The gelatin hardener used for each layer was sodium 1-oxy-3,5-dichloro-s-triazine.

The thickening agent used was Cpd-1.

Layer Structure

The composition of the various layers will be described hereinafter. The coated amount of each component is represented in g/m$^2$. The coated amount of silver halide emulsion is represented in g/m$^2$ as calculated in terms of silver.

Support

Polyethylene-laminated paper (containing a white pigment ($TiO_2$) and a blue dye in polyethylene on the 1st layer side).

| | |
|---|---|
| 1st Layer (blue-sensitive layer) | |
| Monodisperse silver bromochloride emulsion (EM1) spectrally sensitized with sensitizing dye (ExS-1) | 0.13 |
| Monodisperse silver bromochloride emulsion (EM2) spectrally sensitized with sensitizing dye (ExS-1) | 0.13 |
| Gelatin | 1.86 |
| Yellow coupler (ExY-1) | 0.44 |
| Yellow coupler (ExY-2) | 0.39 |
| Dye stabilizer (Cpd-2) | 0.19 |

-continued

| | |
|---|---|
| Solvent (Solv-1) | 0.35 |
| Dispersing polymer (Cpd-12) | 0.21 |
| Dye stabilizer (Cpd-19) | 0.02 |
| 2nd Layer (color stain inhibiting layer) | |
| Gelatin | 0.99 |
| Color stain inhibitor (Cpd-3) | 0.08 |
| 3rd Layer (green-sensitive layer) | |
| Monodisperse silver bromochloride emulsion (EM3) spectrally sensitized with sensitizing dyes (ExS-2, 3) | 0.05 |
| Monodisperse silver bromochloride emulsion (EM4) spectrally sensitized with sensitizing dyes (ExS-2, 3) | 0.11 |
| Gelatin | 1.80 |
| Magenta coupler (ExM-1) | 0.39 |
| Dye stabilizer (Cpd-4) | 0.20 |
| Dye stabilizer (Cpd-5) | 0.02 |
| Dye stabilizer (Cpd-6) | 0.03 |
| Solvent (Solv-2) | 0.12 |
| Solvent (Solv-3) | 0.25 |
| 4th Layer (ultraviolet absorbing layer) | |
| Gelatin | 1.60 |
| Ultraviolet absorber (Cpd-7/Cpd-9/Cpd-17 = 3/2/6: weight ratio) | 0.70 |
| Color stain inhibitor (Cpd-11) | 0.05 |
| Solvent (Solv-4) | 0.27 |
| 5th Layer (red-sensitive layer) | |
| Monodisperse silver bromochloride emulsion (EM5) spectrally sensitized with sensitizing dyes (ExS-4, 5) | 0.07 |
| Monodisperse silver bromochloride emulsion (EM6) spectrally sensitized with sensitizing dyes (ExS-4, 5) | 0.16 |
| Gelatin | 0.92 |
| Cyan coupler (ExC-1) | 0.16 |
| Cyan coupler (ExC-2) | 0.16 |
| Dye stabilizer (Cpd-8/Cpd-9/Cpd-10 = 3/4/2: weight ratio) | 0.17 |
| Dispersing polymer (Cpd-12) | 0.28 |
| Solvent (Solv-2) | 0.15 |
| Solvent (Solv-5) | 0.10 |
| Dye stabilizer (Cpd-19) | 0.02 |
| 6th Layer (ultraviolet absorbing layer) | |
| Gelatin | 0.54 |
| Ultraviolet absorber (Cpd-7/Cpd-8/Cpd-9 = 1/5/3: weight ratio) | 0.21 |
| Solvent (Solv-5) | 0.08 |
| 7th Layer (protective layer) | |
| Acid-treated gelatin | 1.33 |
| Acryl-modified copolymer of polyvinyl alcohol (modification degree: 17%) | 0.17 |
| Liquid paraffin | 0.03 |

Cpd-13 and Cpd-14 were used as antiirradiation dyes.

The emulsion dispersants and coating aids incorporated in each layer were Alkanol® XC (DuPont), sodium alkylbenzenesulfonate, succinic ester, and Megafacx® F-120 (Dainippon Ink and Chemicals, Incorporated). The silver halide stabilizers used were Cpd-15, Cpd-16 and Cpd-18.

ExS-1

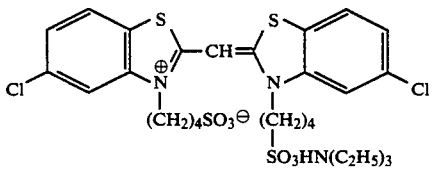

-continued
ExS-2
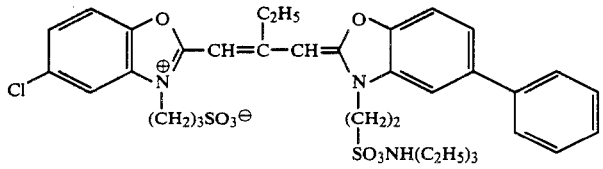
ExS-3
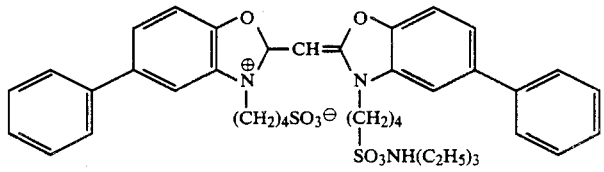
ExS-4
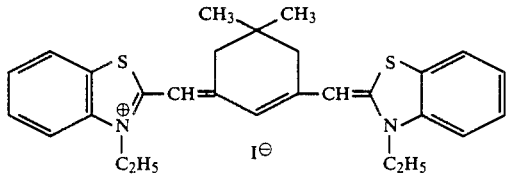
ExS-5
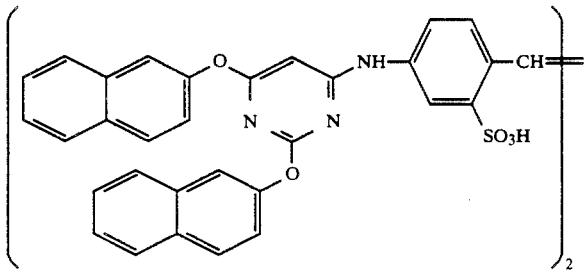
ExY-1
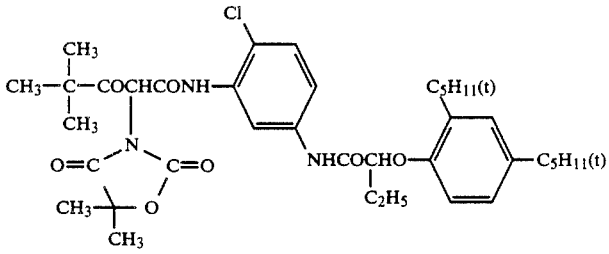
ExY-2
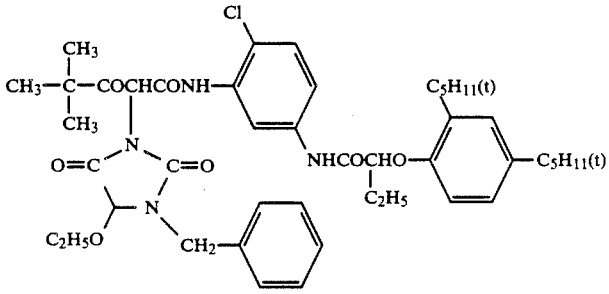

-continued
ExM-1
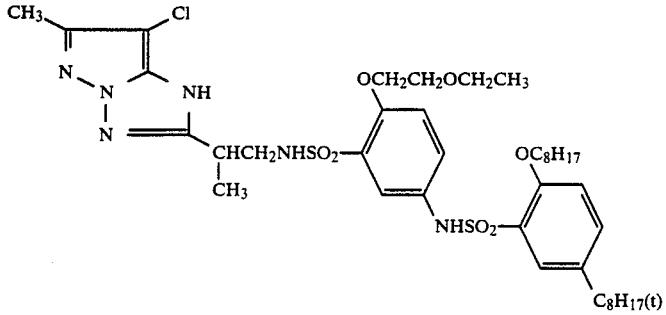
ExC-1
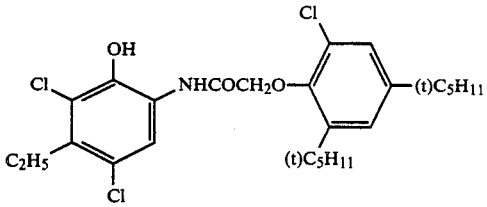
ExC-2
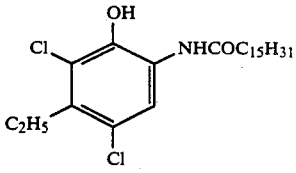
Cpd-1
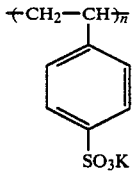
Cpd-2
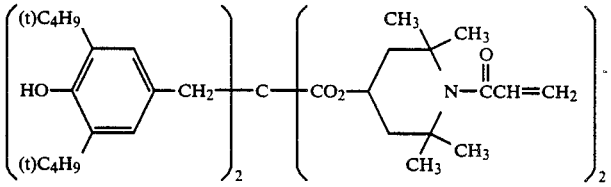
Cpd-3
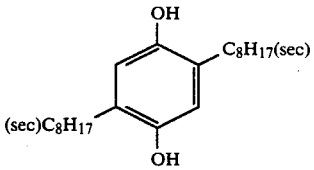
Cpd-4
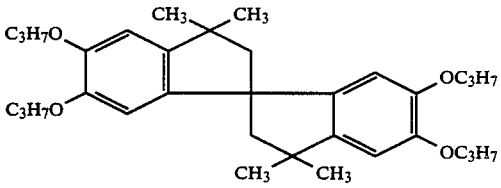
Cpd-5
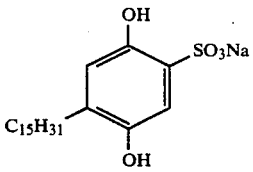

-continued
Cpd-6
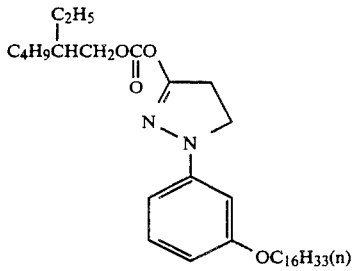
Cpd-7
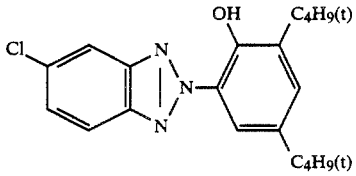
Cpd-8
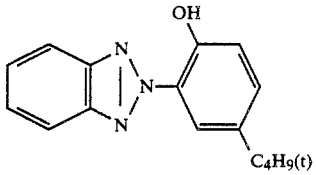
Cpd-9
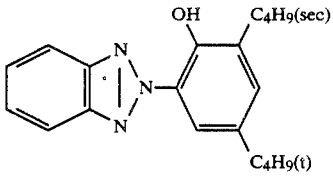
Cpd-10
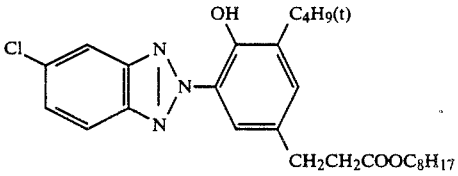
Cpd-11
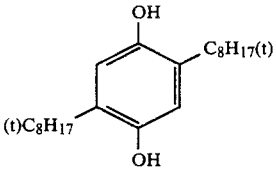
Cpd-12
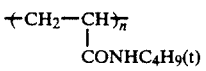
(molecular weight: ca. 60,000)
Cpd-13
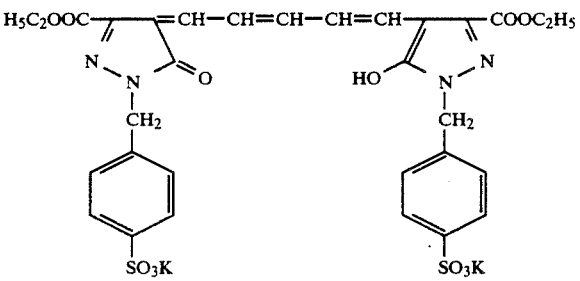

-continued

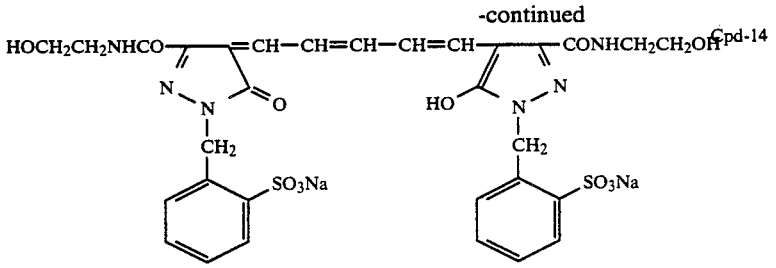

Cpd-14

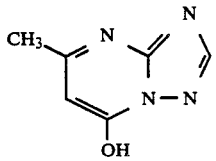

Cpd-15

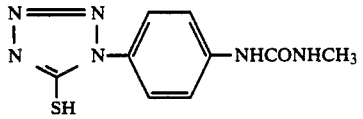

Cpd-16

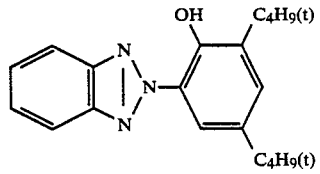

Cpd-17

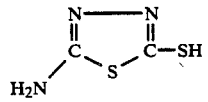

Cpd-18

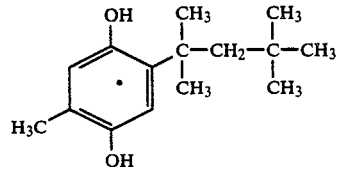

Cpd-19

| | |
|---|---|
| Dibutyl phthalate | Solv-1 |
| Tricresyl phosphate | Solv-2 |
| Trioctyl phosphate | Solv-3 |
| Trinonyl phosphate | Solv-4 |
| Diocyl sebacate | Solv-5 |

| Emulsion Name | Crystal Shape | Average Grain Diameter*1 (μm) | Br Content (mol %) | Coefficient of Fluctuation*2 |
|---|---|---|---|---|
| EM1 | Cube | 1.0 | 80 | 0.08 |
| EM2 | Cube | 0.75 | 80 | 0.07 |
| EM3 | Cube | 0.5 | 83 | 0.09 |
| EM4 | Cube | 0.4 | 83 | 0.10 |
| EM5 | Cube | 0.5 | 73 | 0.09 |
| EM6 | Cube | 0.4 | 73 | 0.10 |

*1Represented by average of side length as calculated in terms of projected area.
*2Represented by the ratio of standard deviation (S) to an average grain diameter (d) (S/d)

Preparation of Specimens 802 to 805

Specimens 802 to 805 were prepared in the same manner as Specimen 801 except that the dye stabilizer (Cpd-4) to be incorporated in the 3rd layer was replaced by the comparative compounds and the present compounds as shown in Table 9 (metal complex discoloration inhibitors) in amounts of 1/5 mol based on the amount of Cpd-4.

These specimens were then imagewise exposed to white light. These specimens were then processed in the undermentioned manner. These specimens were finally tested for light resistance.

The degree of resistance to light was determined by the percentage of the density reached after the test in the portion at which the color density was 2.0 before the test. The degree of resistance to light was also determined by the color density at background background stain).

In the test for resistance to light, the specimens were irradiated with light of illuminance of 85,000 lux for 200 hours through a Fuji Photo Film's ultraviolet absorbing filter adapted to cut wavelengths of 400 nm or less in a xenon tester.

The measurement was conducted by means of a Macbeth densitometer RD-514 (Status AA filter). The results are shown in Table 9.

TABLE 9

| Processing Step | Temperature | Time |
|---|---|---|
| Color development | 33° C. | 3 min. 30 sec. |
| Blix | 33° C. | 1 min. 30 sec. |
| Rinse | 24–34° C. | 3 min. |
| Drying | 70–80° C. | 1 min. |

| Color Developing Solution | |
|---|---|
| Water | 800 ml |
| Diethylenetriaminepentaacetic acid | 1.0 g |
| Nitrilotriacetic acid | 1.5 g |
| Benzyl alcohol | 15 ml |
| Diethylene glycol | 10 ml |
| Sodium sulfite | 2.0 g |
| Potassium bromide | 0.5 g |
| Potassium carbonate | 30 g |
| N-Ethyl N-(β-methanesulfonamidoethyl)-3-methyl-4-aminoaniline sulfate | 5.0 g |
| Hydroxylamine sulfate | 4.0 g |
| Fluorescent brightening agent (Whitex ® 4: made by Sumitomo Chemical Co., Ltd.) | 1.0 g |
| Water to make | 1,000 ml |
| pH (25° C.) | 10.20 |
| Blix Solution | |
| Water | 400 ml |
| Ammonium thiosulfate (70%) | 150 ml |
| Sodium sulfite | 18 g |
| Ferric ammonium ethylenediaminetetraacetate | 55 g |
| Disodium ethylenediaminetetraacetate | 5 g |
| Water to make | 1,000 ml |
| pH (25° C.) | 6.70 |

TABLE 9

| Specimen No. | Compound | Magenta Density (%) | Background Stain |
|---|---|---|---|
| 801 | Cpd-3 | 86 | 0.17 |
| 802 | Comparative compound C | 97 | 0.26 |
| 803 | Comparative compound D | 95 | 0.31 |
| 804 | Exemplary compound 30 (present compound) | 94 | 0.21 |
| 805 | Exemplary compound 31 (present compound) | 94 | 0.18 |

Comparative Compound C

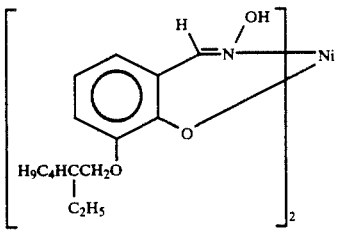

Comparative Compound D

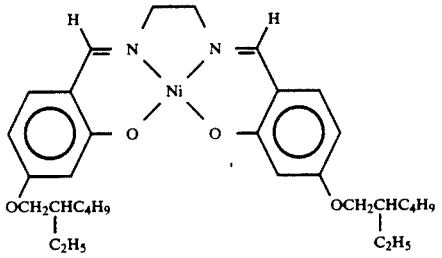

Table 9 shows that Specimens 802 to 805 provide more stable dyes than Comparative Specimen 801.

However, Specimens 802 and 803 showed background stain, probably because the color of the metal complex dye stabilizer itself remained.

On the other hand, it can be seen that Specimens 804 and 805 showed very low background stain because the undesired portion of the dye stabilizer was eluted from the system.

Specimens 801 to 805 were subjected to the undermentioned processing and then light resistance was determined as above. Almost the same results as in Table 9 were obtained.

| Processing Step | Temperature | Time |
|---|---|---|
| Color development | 38° C. | 1 min. 40 sec. |
| Blix | 30–34° C. | 1 min. 00 sec. |
| Rinse 1 | 30–34° C. | 20 sec. |
| Rinse 2 | 30–34° C. | 20 sec. |
| Rinse 3 | 30–34° C. | 20 sec. |
| Drying | 70–80° C. | 50 sec. |

(The rinse step was effected in a countercurrent process wherein the rinsing solution flowed from tank 3 (rinse 3) to tank 1 (rinse 1) through tank 2 (rinse 2).)

The composition of the processing solutions used is described hereinafter.

| Color Developing Solution | |
|---|---|
| Water | 800 ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| Triethylenediamine(1,4-diazabicyclo-[2,2,2] octane) | 5.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Diethylhydroxylamine | 4.0 g |
| Fluorescent brightening agent (Ciba-Geigy's UVITEX ®-CK) | 1.5 g |
| Water to make | 1,000 ml |
| pH (25° C.) | 10.25 |
| Blix Solution | |
| Water | 400 ml |
| Ammonium thiosulfate (70%) | 200 ml |
| Sodium sulfate | 20 g |
| Ferric ammonium ethylenediaminetetraacetate | 60 g |
| Disodium ethylenediaminetetraacetate | 10 g |
| Water to make | 1,000 ml |
| pH (25° C.) | 7.00 |

Rinsing Solution

Ion exchanged water (calcium and magnesium concentration: 3 ppm or less each)

EXAMPLE 9

Preparation of Emulsion A

An aqueous solution of silver nitrate and an aqueous solution of sodium chloride containing ammonium hexachlorinated rhodiumate (III) in an amount of $0.5\times10^{-4}$ mol per mol of silver were mixed in a gelatin solution kept at a temperature of 35° C. in a double jet process while the pH value of the gelatin solution was adjusted to 6.5. Thus, a monodisperse emulsion of particulate silver chloride with an average grain size of 0.07 μm was prepared.

After the formation of grains, soluble salts were removed from the emulsion by the flocculation process well known in the industry. 4-Hydroxy-6-methyl-1,3,3a,7-tetraazaindene and 1-phenyl-5-mercaptotetrazole were added to the emulsion as stabilizers. The gelatin content and the silver content of the emulsion were 55 g/kg and 105 g/kg, respectively. (Emulsion A)

Preparation of Light-sensitive Material

A nucleating agent, a nucleation accelerating agent and a dye for improving safelight safety as shown hereinafter were added to Emulsion A thus prepared in amounts described hereinafter.

| | Added amount ($mg/m^2$) |
|---|---|
| Nucleating agent 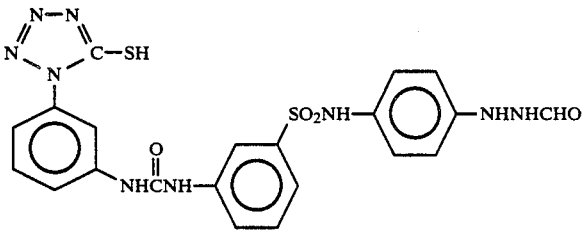 | 11.8 |
| 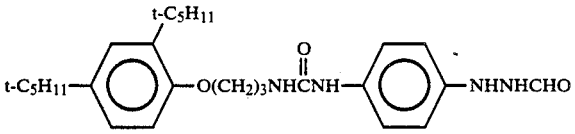 | 9.3 |
| Nucleation accelerating agent 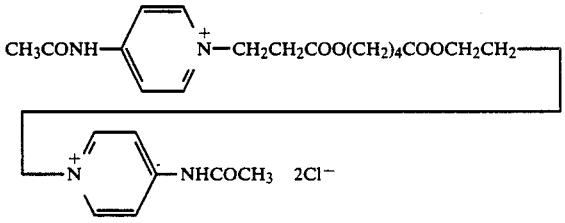 | 28.0 |
| 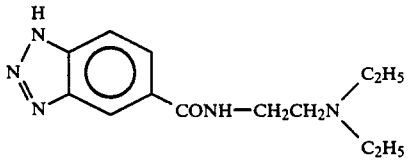 | 60.0 |
| Safelight dye 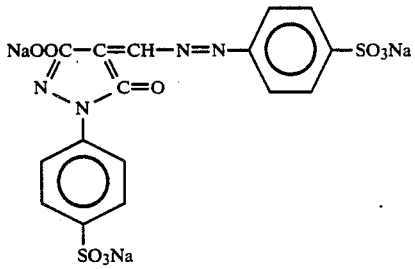 | 50.0 |

Polyethyl acrylate latex (14 $mg/m^2$) and sodium 2,4-dichloro-6-hydroxy-1,3,5-triazine were added as film hardeners to the emulsion. The silver halide emulsion thus prepared was then coated on a transparent polyethylene terephthalate support in an amount such that the coated amount of silver reached 3.5 $g/m^2$. A protective layer containing gelatin (1.3 $g/m^2$), the present compound 33 (0.1 $g/m^2$), the following three surface active agents as coating aids, a stabilizer, and a matting agent was coated on the silver halide emulsion layer, and dried. (Specimen 901)

| | Added amount ($mg/m^2$) |
|---|---|
| Surface active agent 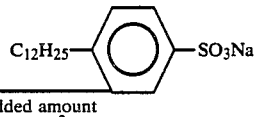 | 37 |

-continued

| | Added amount ($mg/m^2$) |
|---|---|
| $CH_2COOC_6H_{13}$<br>\|<br>$CHCOOC_6H_{13}$<br>\|<br>$SO_3Na$ | 37 |
| $C_8F_{17}SO_2NCH_2COOK$<br>\|<br>$C_3H_7$ | 2.5 |
| Stabilizer | |
| Thioctic Acid | |
| Matting Agent | |
| Polymethyl methacrylate<br>(average particle diameter: 2.5 μm) | 9.0 |

The present compound 33 was prepared by forming a dispersion in the following manner.

| | |
|---|---|
| Solution I | |
| Compound 33 | 0.8 g |
| Dimethylformamide | 3.0 ml |
| Citric acid | 0.05 g |
| $H_2O$ | 22 ml |
| Solution II | |
| Gelatin | 2.2 g |
| $H_2O$ | 20 ml |

Solution I was gradually added to Solution II with stirring at a temperature of 40° C. The pH value of the dispersion thus prepared was 5.4.

Specimens 902 to 905 were prepared in the same manner as in Specimen 901 except that Compound 33 was replaced by Compounds 34, 35, 36 and 37, respectively.

Preparation of Comparative Specimens (1) Comparative Specimen A was prepared in the same manner as Specimen 901 except that Compound 33 was not used.

(2) Comparative Specimen B was prepared in the same manner as in Specimen 901 except that Compound 33 was replaced by the following water-soluble ultraviolet absorbing dye in an amount of 0.05 $g/m^2$.

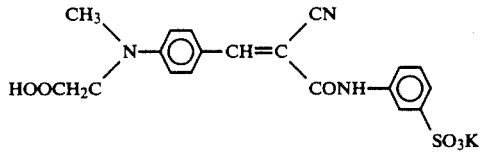

Evaluation of Properties (1) These seven specimens were then exposed to light through an optical wedge by means of Dainippon Screen Mfg. Co., Ltd.'s daylight printer P-607. These specimens were then developed with the undermentioned solution at a temperature of 38° C. for 20 seconds, fixed by an ordinary method, washed with water, and dried. As a result, Specimen B and Specimens 901 to 905 exhibited a UV optical density in the highlighted portion as low as that of Specimen A and were completely decolored.

| | |
|---|---|
| Developing Solution | |
| Hydroquinone | 35.0 g |
| N-Methyl-p-aminophenol ½ sulfate | 0.8 g |
| Sodium hydroxide | 13.0 g |
| Potassium tertiary phosphate | 74.0 g |
| Potassium sulfite | 90.0 g |
| Tetrasodium ethylenediaminetetraacetate | 1.0 g |
| Potassium bromide | 4.0 g |
| 5-Methylbenzotriazole | 0.6 g |
| 3-Diethylamino-1,2-propanediol | 15.0 g |
| Water to make | 1 l |
| pH | 11.5 |

Comparative Specimen B exhibited a sensitivity of 0.42 lower than Comparative Specimen A as calculated in terms of log E. Specimens 901 to 905 of the present invention exhibited sensitivities of 0.45, 0.43, 0.41, 0.46 and 0.45 lower than Comparative Specimen A, respectively. The sensitivity of Specimen B and Specimens 901 to 905 were in a practically proper range.

(2) Test for safelight safety

The seven specimens thus prepared were subjected to test for safe time under safelight of 400 lux from a UV cut fluorescent lamp (Toshiba Corp.'s FLR-40SW-DLX-NU/M). Comparative Specimen A exhibited a safe time of 11 minutes. On the other hand, Comparative Specimen B exhibited a safe time of 22 minutes. Specimens 901 to 905 of the present invention exhibited a safe time of 25 minutes, 23 minutes, 20 minutes, 27 minutes, and 24 minutes, respectively.

The results of Tests (1) and (2) show that the present compounds 33, 34, 35, 36, and 37 can lower the sensitivity to a proper range more effectively and improve the safelight safety.

(3) Test for tone variability

The seven specimens were exposed to light through a plain dot screen by means of the above described printer. These specimens were then developed in the same manner as in Test (1). For each specimen, the exposure time at which the net area can be reversed by 1:1 was determined. These specimens were exposed to light for twice the exposure time and for four times the exposure time. Thus, the extent of expansion of the dot area was examined. The more the expansion of the dot area is, the more excellent is the tone variability. The results are partially shown in Table 10. Table 10 shows that the present Specimen 902 exhibits a high tone variability while Comparative Specimen B exhibits a remarkable drop in the tone variability. In Specimen B, the dye used diffuses uniformly from the layer in which it has been incorporated to the light-sensitive emulsion layer during the storage due to its water-solubility and diffusibility. Therefore, even if the exposure time is increased, the antiirradiation effect of the dye inhibits the expansion of the dot area. On the other hand, the present compound 34 is fixed in the layer in which it has been incorporated. Thus, the present specimen exhibits a high tone variability.

TABLE 10

| Tone Variability (represented by the Increase in the Dot Area) | | |
|---|---|---|
| | Exposure Time | |
| Specimen No. | Twice | Four Times |
| Comparative Specimen A | +6% | +10% |

TABLE 10-continued

| Tone Variability (represented by the Increase in the Dot Area) | | |
|---|---|---|
| | Exposure Time | |
| Specimen No. | Twice | Four Times |
| Comparative Specimen B | +3% | +5% |
| Present Specimen 902 | +6% | +9% |

(4) Evaluation of stain by reducer

A strip of Present Specimen 902 which had been processed in Test (3) was immersed in the undermentioned Farmer's reducer at a temperature of 20° C. for 60 seconds, washed with water, and dried. As a result, the portion of 50% dot area was reduced to 33%. Furthermore, there no strain was found.

| Farmer's Reducer | |
|---|---|
| Solution I | |
| Water | 200 ml |
| Sodium thiosulfate | 20 g |
| Solution II | |
| Water | 100 ml |
| Red prussiate | 10 g |

Solution I, Solution II and water were mixed in a proportion of 100 parts:5 parts:100 parts before use.

EXAMPLE 10

The solid dispersion of a dye-providing substance will be described hereinafter.

200 ml of a 1% aqueous solution of gelatin was added to 10 g of dye-providing substance (1), (2) or (3), 7.2 g of an electron donor (ED-1), and 1.5 g of the undermentioned surface active agent (a). The mixture was then subjected to grinding for 20 minutes in a dyno mill with glass beads having an average particle diameter of about 0.6 mm. The glass beads were then filtered out to obtain an aqueous dispersion (average particle diameter: 0.6 μm).

Surface Active Agent (a)

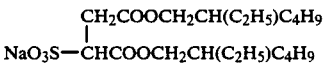

Light-sensitive material Specimen 1001 was prepared in the same manner as in Example 3 except that the gelatin dispersion of a dye-providing substance was replaced by the above described solid dispersion of a dye-providing substance.

After being stored at a temperature of 45° C. and a relative humidity of 60% for 1 week, Specimen 301 and Specimen 1001 were then processed in the same manner as in Example 3. As a result, Specimen 1001 exhibited a smaller increase in $D_{min}$ after storage than Specimen 301. Thus, it can be seen that the solid dispersion process can improve the preservability.

EXAMPLE 11

Specimen 301 in Example 3 was exposed to light. Water was supplied to the emulsion surface of the light-sensitive material in an amount of 15 ml/m$^2$. The light-sensitive material was then laminated with a dye-fixing material in such a manner that the film surface thereof was brought into contact with the dye-fixing material. The lamination was then allowed to stand at room temperature for 20 seconds. The lamination was then heated to a temperature of 85° C. for 20 seconds. The dye-fixing material was then peeled off the light-sensitive material (Processing B).

Another group of Specimen 301 was processed in the same manner as in Processing B except that after lamination, the light-sensitive material and the dye-fixing material were preheated while kept in close contact with each other over a heat block which had been temperature-controlled so that the temperature of the water-absorbed film reached 50° C. (Processing C).

In either processing, blue, green, red and grey images were provided on the dye-fixing material with an excellent discrimination of lower $D_{min}$ than processed in Example 3.

EXAMPLE 12

Light-sensitive material Specimens 1201, 1202, and 1203 were prepared in the same manner as in Example 3 except that in the preparation of the gelatin dispersion of a dye-providing substance, tricyclohexyl phosphate was replaced by an oil of the general formula (a-2), an oil of the general formula (a-5), an oil of the general formula (a-6), and an oil of the general formula (a-8) in the same amounts, respectively.

Specimen 310 and Specimens 1201 to 1203 were then stored at a temperature of 45° C. and a relative humidity of 60% for 1 week. These specimens were then processed in the same manner as in Example 3. As a result, it was found that Specimens 1201 to 1203 exhibit a smaller $D_{min}$ after storage than Specimen 301.

EXAMPLE 13

Light-sensitive material Specimen 1301 was prepared in the same manner as in Specimen 301 except that the electron donor ED-1 was replaced by the following compound (oxidation product of ED-1).

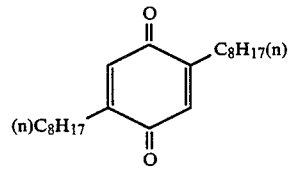

Specimen 301 and Specimen 1301 were then stored at a temperature of 45° C. and a relative humidity of 60% for 1 week. These specimens were then processed in the same manner as in Example 3. Specimen 1301 exhibited a far smaller increase in $D_{min}$ after storage than Specimen 301.

EXAMPLE 14

Light-sensitive material Specimen 1401 was prepared in the same manner as in Specimen 301 except that in the preparation of the gelatin dispersion of a dye-providing substance, 1 g of the present development inhibitor-releasing compound (15) was used in addition to 10 g of the present dye-providing substance (1), (2) or (3).

Specimen 1401 was processed in the same manner as in Example 3. As a result, it was found that Specimen 1401 exhibits a drop in $D_{min}$ and an improved image discrimination.

EXAMPLE 15

A light-sensitive material specimen was prepared in the same manner as in Specimen 301 except that the 1st layer, 3rd layer and 5th layer were each divided into two layers as shown in Table 11.

TABLE 11

| | |
|---|---|
| 6th layer | Protective layer |
| 5th-O layer | High sensitivity blue light-sensitive layer |
| 5th-U layer | Low sensitivity blue light-sensitive layer |
| 4th layer | Interlayer |
| 3rd-O layer | High sensitivity green light-sensitive layer |
| 3rd-U layer | Low sensitivity green light-sensitive layer |
| 2nd layer | Interlayer |
| 1st-O layer | High sensitivity red light-sensitive layer |
| 1st-U layer | Low sensitivity red light-sensitive layer |
| | Support |
| | Back layer |

The added amount of additives in each O and U layer of the 1st, 3rd and 5th layers are shown in Table 12.

TABLE 12

| | Added amount ($g/m^2$) | | | | | |
|---|---|---|---|---|---|---|
| Additive | 5th-O layer | 5th-U layer | 3rd-O layer | 3rd-U layer | 1st-O layer | 1st-U layer |
| Emulsion (silver amount) | 0.23 | 0.35 | 0.16 | 0.25 | 0.14 | 0.22 |
| Gelatin | 0.27 | 0.41 | 0.20 | 0.27 | 0.2 | 0.27 |
| Fog inhibitor (1) | $5.4 \times 10^{-4}$ | $8.2 \times 10^{-4}$ | $5.0 \times 10^{-4}$ | $7.5 \times 10^{-4}$ | $5.0 \times 10^{-4}$ | $7.5 \times 10^{-4}$ |
| Yellow dye-providing substance (1) | 0.13 | 0.37 | — | — | — | — |
| Magenta dye-providing substance (2) | — | — | 0.09 | 0.28 | — | — |
| Cyan dye providing substance (3) | — | — | — | — | 0.09 | 0.28 |
| High boiling organic solvent (1) | 0.06 | 0.19 | 0.05 | 0.14 | 0.05 | 0.13 |
| Electron donor (ED-1) | 0.06 | 0.19 | 0.04 | 0.10 | 0.04 | 0.10 |
| Surface active agent (3) | 0.01 | 0.04 | 0.01 | 0.02 | 0.01 | 0.02 |
| Electron transfer agent (X-2) | 0.01 | 0.02 | 0.01 | 0.02 | 0.01 | 0.02 |
| Film hardener (1) | 0.004 | 0.006 | 0.004 | 0.006 | 0.004 | 0.006 |
| Water-soluble polymer (2) | 0.01 | 0.01 | 0.01 | 0.01 | 0.01 | 0.01 |

The silver halide emulsions used in each emulsion layer are as follows:

TABLE 13

| | Used Emulsion | | | | | |
|---|---|---|---|---|---|---|
| Specimen No. | 5th-O layer | 5th-U layer | 3rd-O layer | 3rd-U layer | 1st-O layer | 1st-U layer |
| 1501 | 6a | 5a | 2a | 3a | 4a | 1a |
| 1502 | 6b | 5b | 2b | 3b | 4b | 1b |

The preparation of a silver halide emulsion will be described hereinafter.

Emulsion (1a)

The undermentioned Solution (I) was added to an aqueous solution of gelatin (obtained by dissolving 25 g of gelatin, 4 g of sodium chloride and 0.02 g of 1,3-dimethylimidazolidin-2-thione in 700 ml of water, kept at a temperature of 65° C.) with vigorous stirring in 30 minutes. 10 seconds after the beginning of the addition of the Solution (I), the Solution (II) was added to the gelatin solution in 30 minutes 10 minutes after the completion of the addition of the Solution (I), the undermentioned Solutions (III) and (IV) were simultaneously added to the system at the same flow rate in 30 minutes. Furthermore, 1 minute after the completion of the addition of the Solutions (III) and (IV), a solution of 0.2 g of the undermentioned sensitizing dye A in 100 ml of methanol and 100 ml of water was added to the system. After being washed with water and desalted, the emulsion was adjusted with 20 g of gelatin to a pH value of 6.1 and a pAg value of 7.2. The emulsion was then subjected to optimum chemical sensitization with triethyl thiourea, 4-hydroxy-6-methyl-1,3,3a,7-tetrazaindene and chloroauric acid. Thus, 600 g of a monodisperse emulsion of cubic particulate silver halide having an average grain size of 0.7 μm was obtained.

| | Solution (I) | Solution (II) | Solution (III) | Solution (IV) |
|---|---|---|---|---|
| $AgNO_3$ (g) | 50 g | — | 50 g | — |
| KBr (g) | — | 28 g | — | 21 g |
| NaCl (g) | — | 3.5 g | — | 6.8 g |
| Total liquid amount (water added) | 300 ml | 260 ml | 270 ml | 280 ml |
| Sensitizing Dye A | | | | |

-continued

| | Solution (I) | Solution (II) | Solution (III) | Solution (IV) |
|---|---|---|---|---|

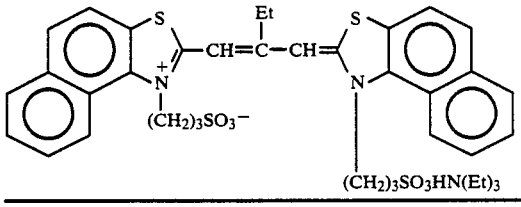

Emulsion (1b)

An emulsion was prepared in the same manner as in Emulsion (1a) except that 5 minutes after the completion of the addition of Solution (I), 3.4 ml of a 0.001% aqueous solution of potassium hexachloroiridiumate (III) was added to the system. Thus, 600 g of a monodisperse emulsion of particulate silver halide having an average grain size of 0.7 μm was obtained.

Emulsion 1(b))

Emulsion (2a)

The undermentioned Solution (I) was added to an aqueous solution of gelatin (obtained by dissolving 20 g of gelatin, 10 g of sodium chloride, 0.3 g of potassium bromide, and 0.03 g of 1,3-dimethylimidazolidin-2-thione in 800 ml of water, kept at a temperature of 60° C.) with vigorous stirring in 60 minutes Furthermore, 5 seconds after the beginning of the addition of the Solution (I), the undermentioned Solution (II) was added to the system in 60 minutes. Moreover, 15 minutes after the beginning of the addition of the Solution (I), a solution of 0.18 g of the undermentioned sensitizing dye B in 150 ml of methanol was added to the system. After being washed with water and desalted, the emulsion was then adjusted with 20 g of gelatin to a pH value of 6.4 and a pAg value of 7.3. The emulsion was then subjected to optimum chemical sensitization with triethyl thiourea and 4-hydroxy-6-methyl-1,3,3a,7-tetrazaindene at a temperature of 57° C. Thus, 640 g of a monodisperse emulsion of cubic particulate silver halide having an average grain size of 0.65 μm was obtained.

| | Solution (I) (water added to make 600 ml) | Solution (II) (water added to make 600 ml) |
|---|---|---|
| $AgNO_3$ (g) | 100 | — |
| KBr (g) | — | 45.5 |
| NaCl (g) | — | 11.7 |
| KI (g) | — | 0.97 |

Sensitizing Dye B

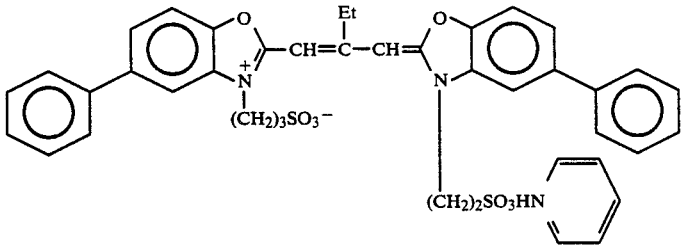

Emulsion (2b)

An emulsion was prepared in the same manner as in Emulsion (2a) except that 0.6 cc of a 0.0015% aqueous solution of ammonium hexachloroiridiumate (IV) was added to the sensitizing dye solution Thus, 645 g of a monodisperse emulsion of cubic particulate silver halide having an average grain size of 0.65 μm was obtained.

(Emulsion (2b))

Emulsion (3a)

The undermentioned Solution (I) and Solution (II) were simultaneously added to an aqueous solution of gelatin (obtained by dissolving 1,050 g of lime-treated ossein gelatin and 70 g of sodium chloride in 52 l of water, kept at a temperature of 75° C.) with vigorous stirring in 8 minutes. 5 minutes after the beginning of the addition of the Solutions (I) and (II), a solution of 2.6 g of sensitizing dye B (as used in Emulsion (2a)) and 2.8 g of the undermentioned sensitizing dye C in 5.2 l of methanol was added to the system in 45 minutes. Thereafter the Solution (III) and the Solution (IV) were simultaneously added to the system in 40 minutes. After being washed with water and desalted, the emulsion was then adjusted with 400 g of gelatin to a pH value of 6.0 and a pAg value of 8.0. The emulsion was then subjected to optimum chemical sensitization with triethyl thiourea, 4-hydroxy-6-methyl-1,3,3a,7-tetrazaindene and a decomposition product of a nucleic acid. Thus, 16.4 kg of an emulsion of cubic particulate silver halide having an average grain size of 0.6 μm was obtained.

| | Solution (I) | Solution (II) | Solution (III) | Solution (IV) |
|---|---|---|---|---|
| $AgNO_3$ (g) | 260 | — | 2,340 | — |
| KBr (g) | — | 110 | — | 1,310 |
| NaCl (g) | — | 35.8 | — | 162 |
| Total liquid amount (ml) (water added) | 1,900 | 2,100 | 17,080 | 15,000 |

Sensitizing Dye C

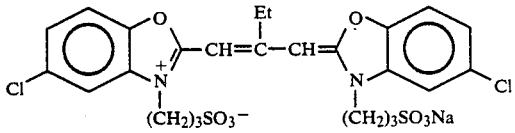

Emulsion (3b)

An emulsion was prepared in the same manner as in Emulsion (3a) except that a 0.001% aqueous solution of potassium hexachloroiridiumate (III) was added to Solution (II) and Solution (IV) in amounts of 26 ml and 16 ml, respectively. Thus, 16.4 kg of an emulsion of cubic particulate silver halide having an average grain size of 0.6 μm was obtained.

Emulsion (4a)

The undermentioned Solution (I) and the undermentioned Solution (II) were simultaneously added to an aqueous solution of gelatin (obtained by dissolving 20 g of gelatin, 6 g of sodium chloride, 0.1 g of potassium bromide, 4 ml of 1 N sulfuric acid, and 0.03 g of 1,3-dimethylimidazolidin-2-thione in 800 ml of water, kept at a temperature of 72° C.) in 30 minutes with vigorous stirring. The undermentioned Solution (V) was then added to the system in 2 minutes. Furthermore, the undermentioned Solution (III) and the undermentioned Solution (IV) were added to the system in 20 minutes. Shortly after the completion of the addition of Solutions (III) and (IV), a solution of 0.15 g of the undermentioned sensitizing dye D in 150 ml of methanol was added to the system. After being washed with water and desalted, the emulsion was adjusted with 20 g of gelatin to a pH value of 6.1 and a pAg value of 8.2. The emulsion was then subjected to optimum chemical sensitization with sodium thiosulfate, 4-hydroxy-6-methyl-1,3,3a,7-tetrazaindene, and 30 g of finely divided particulate silver halide emulsion A (see below) at a temperature of 62° C. Thus, a monodisperse emulsion of tetradecahedral particulate silver halide having an average grain size of 0.85 μm prepared in an amount of 640 g. (Emulsion (4a))

| | Solution (I) | Solution (II) | Solution (III) | Solution (IV) | Solution (V) |
|---|---|---|---|---|---|
| $AgNO_3$ | 50 g | — | 50 g | — | — |
| KBr | — | 31.5 g | — | 31.5 g | — |
| NaCl | — | 1.73 g | — | 3.4 g | — |
| KI | — | — | — | — | 0.93 g |
| Total liquid amount (water added) | 300 ml | 250 ml | 260 ml | 300 ml | 160 ml |

Sensitizing Dye D

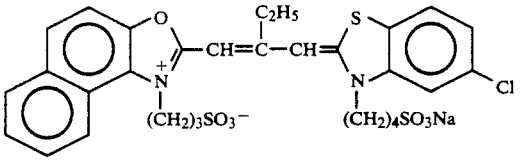

Preparation of Finely Divided Particle Emulsion A

The undermentioned Solution (VI) and the undermentioned Solution (VII) were simultaneously added to an aqueous solution of gelatin (obtained by dissolving 30 g of lime-treated ossein gelatin, 12 g of potassium bromide, and 8 g of sodium chloride in 800 ml of water, kept at a temperature of 35° C.) in 20 minutes with vigorous stirring After being washed with water and desalted, the emulsion was adjusted with 18 g of lime-treated ossein gelatin to a pH value of 6.4 and a pAg value of 7.5. Thus, 640 g of an emulsion of finely divided particulate silver halide having an average grain size of 0.9 μm was obtained.

| | Solution (VI) | Solution (VII) |
|---|---|---|
| $AgNO_3$ (g) | 100 g | — |
| KBr (g) | — | 72 g |
| Total amount (water added) | 500 ml | 460 ml |

Emulsion (4b)

An emulsion was prepared in the same manner as in Emulsion (4a) except that a finely divided particulate emulsion B obtained by adding 30 ml of a 0.001% aqueous solution of ammonium hexachloroiridiumate (IV) to Solution (VII) was used. Thus, 640 g of a monodisperse emulsion of tetradecahedral particulate silver halide having an average grain size of 0.85 μm was obtained.

(Emulsion 4b))

Emulsion (5a)

The undermentioned Solution (I) and the undermentioned Solution (II) were simultaneously added to an aqueous solution of gelatin (obtained by dissolving 20 g of lime-treated ossein gelatin, 12 g of potassium bromide, and 0.03 g of the undermentioned compound in 670 ml of water, kept at a temperature of 70° C.) with vigorous stirring in 60 minutes.

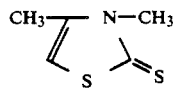

After being washed with water and desalted, the emulsion was then adjusted with 7 g of lime-treated ossein gelatin to a pH value of 6.7 and a pAg value of 8.2. The emulsion was then subjected to optimum chemical sensitization with sodium thiosulfate and chloroauric acid at a temperature of 60° C. for 70 minutes. 71 minutes after the addition of sodium thiosulfate, a gelatin dispersion containing 0.13 g of the undermentioned sensitizing dye E was added to the emulsion. Thus, 690 g of a monodisperse emulsion of octahedral particulate silver halide having an average grain size of 1.0 μm was obtained. (Emulsion (5a))

| | Solution (I) (water added to make 600 ml) | Solution (II) (water added to make 580 ml) |
|---|---|---|
| $AgNO_3$ | 100 g | — |
| KBr | — | 68.6 g |
| KI | — | 1.95 g |

Sensitizing Dye E

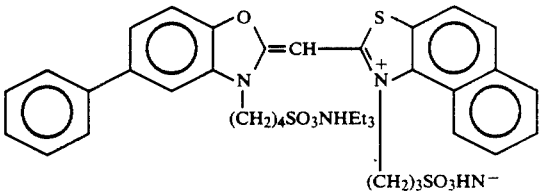

Emulsion (5b)

An emulsion was prepared in the same manner as in Emulsion (5a) except that 1.2 ml of a 0.001% aqueous solution of potassium hexachloroiridiumate (III) was added to Solution (II). Thus, 690 g of a monodisperse emulsion of particulate silver halide having an average grain size of 1.0 μm was obtained. (Emulsion (5b))

Emulsion (6a)

The undermentioned Solution (I) and the undermentioned Solution (II) were simultaneously added to an aqueous solution of gelatin (obtained by dissolving 20 g of lime-treated deionized gelatin, 1 g of potassium bromide, and 7 cc of 25% ammonia in 800 ml of water, kept at a temperature of 50° C.) with vigorous stirring in 50 minutes while the pAg value thereof was kept constant. A solution of 0.15 g of the sensitizing dye E (same as used in Emulsion (5a)) in 100 ml of methanol was then added to the system. After being washed with water and desalted, the emulsion was adjusted with 28 g of gelatin to a pH value of 6.5 and a pAg value of 8.5. The emulsion was then subjected to optimum chemical sensitization with sodium thiosulfate, chloroauric acid, and 4-hydroxy-6-methyl-1,3,3a,7-tetrazaindene. Thus, 640 g of a monodisperse emulsion of octahedral particulate silver halide having an average grain size of 1.2 μm was obtained (Emulsion (6a))

| | Solution (I) | Solution (II) |
|---|---|---|
| $AgNO_3$ (g) | 100 g | — |
| KBr (g) | — | 70 g |
| Total amount (water added) | 600 ml | 600 ml |

Emulsion (6b)

An emulsion was prepared in the same manner as in Emulsion (6a) except that 10 minutes after the beginning of the addition of the Solutions (I) and (II), 0.8 cc of a 0.001% aqueous solution of potassium hexachloroiridiumate (III) was added to the system. Thus, 640 g of a monodisperse emulsion of octahedral particulate silver halide having an average grain size of 1.2 μm was obtained.

Specimens 1501 and 1502 were then exposed to light of 5000 lux from a tungsten lamp through a filter having a continuous density gradation for 1/10 second.

These specimens thus exposed were then supplied with water on the emulsion surface thereof in an amount of 15 ml/m$^2$ from a wire bar while being delivered at a line speed of 20 mm/sec. These specimens were then laminated with an image receiving material in such a manner that the film surface thereof was brought into contact with the image receiving material.

The laminations were then heated for 20 seconds by means of a heat roller which had been temperature-controlled so that the temperature of the water-absorbed film reached 85° C. When the image receiving material was then peeled off the light-sensitive material specimens, sharp positive dye images were obtained on both the specimens. However, Specimen 1502 exhibited a higher $D_{max}$ in yellow, magenta and cyan dye images than Specimen 1501.

Another group of these specimens were exposed to light of 50 lux for 10 seconds Specimen 1502 comprising an emulsion containing iridium exhibited less of a difference in sensitivity between the two exposure conditions than Specimen 1501. Thus, it can be seen that Specimen 1502 exhibits an improved reciprocity law property.

EXAMPLE 16

A light-sensitive material specimen 1601 was prepared by coating the following layers on a transparent polyethylene terephthalate support.

Layer I; Light-sensitive layer containing:

(a) light-sensitive silver bromoiodide emulsion (0.36 g Ag/m$^2$);

(b) benzotriazole silver emulsion (0.18 g Ag/m$^2$);

(c) gelatin dispersion of the present compound 51 (0.27 mmol/m$^2$) and tricresyl phosphate (0.3 g/m$^2$);

(d) gelatin dispersion of 1-phenyl-4-methyl-4-stearoyloxymethyl-3-pyrazolidone (0.27 mmol) and tricresyl phosphate (0.1 g/m$^2$);

(e) base precursor of the general formula (0.22 g/m$^2$):

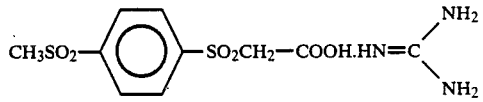

(f) compound of general formula (0.1 g/m$^2$):

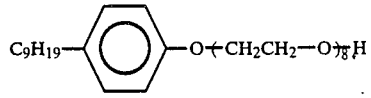

and gelatin (1.2 g/m$^2$, including gelatin contained in the components (a) to (d))

Layer II: Protective layer containing:

(a') the same base precursor as used in Layer I (0.35 g/m$^2$); and gelatin (1 g/m$^2$)

A light-sensitive material Specimen 1602 was prepared in the same manner as described above except that the present compound 51 was replaced by the present compound 52. Specimen 1602 was then exposed to light of 2,000 lux from a tungsten lamp for 1 second. The specimen was then heated for 45 seconds over a heating plate which had been heated to a temperature of 160° C. When the emulsion layer was then physically peeled off, a positive image was obtained on the polyethylene terephthalate film. The positive image was then measured for density. The results are shown in Table 14.

TABLE 14

| Light-sensitive Material Specimen No. | Compound | Color | Maximum Density | Minimum Density |
|---|---|---|---|---|
| 1601 | 51 | Yellow | 0.79 | 0.04 |
| 1602 | 52 | Magenta | 0.95 | 0.05 |

The specimens were then stored at a temperature of 40° C. and a relative humidity of 80% for 1 week. As a result, no increase in fading, color running, and stain were observed Thus, it can be seen that the present process provides an extremely stable image.

EXAMPLE 17

Preparation of Silver Halide Emulsion 600 ml of an aqueous solution containing sodium chloride and potassium bromide and an aqueous solution containing 600 ml of water and 0.59 mol of silver nitrate were simultaneously added to an aqueous solution of gelatin (obtained by dissolving 20 g of gelatin and 3 g of sodium chloride in 1,000 ml of water, kept at a temperature of 60° C.) at the same flow rate in 40 minutes. Thus, a monodisperse emulsion of cubic particulate silver bromochloride having an average grain size of 0.20 μm (bromine content: 80 mol %) was prepared.

After being washed with water and desalted, the emulsion was then subjected to chemical sensitization with 5 mg of sodium thiosulfate and 20 mg of 4-hydroxy-6-methyl-1,3,3a,7-tetrazaindene at a temperature of 60° C. The yield of the emulsion was 600 g.

Preparation of Light-sensitive Composition 0.40 g of the undermentioned copolymer and 2.5 g of a reducing agent ED-1 were dissolved in 100 g of tricresyl phosphate. 40 g of a silver halide emulsion was added to the solution thus prepared. The mixture was then subjected to stirring at 15,000 rpm in a homogenizer for 5 minutes to obtain a light-sensitive composition.

Copolymer

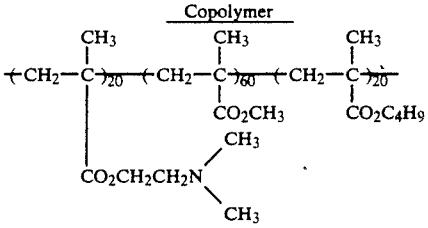

Preparation of Microcapsule Solution

A solution of 50 g of an addition product of xylylene diisocyanate and trimethylolpropane (Takeda Chemical Industries, Ltd.'s TAKENATE® D110N) in the above described light-sensitive composition was added to 250 g of a 4.0% aqueous solution of methyl cellulose (The Shin Etsu Chemical Industry Co., Ltd.). The mixture was then subjected to emulsification at 5,000 rpm in a homogenizer for 1 minute. The emulsion was then allowed to react at 1,000 rpm at a temperature of 60° C. for 2 hours to obtain polyurea resin capsules having an average grain diameter of 10 μm.

Preparation of Gelatin Dispersion of Dye-providing Substance 3.3 g of a cyan dye-providing substance of present compound (3) and 1.7 g of tricresyl phosphate were dissolved in 8 ml of cyclohexanone at a temperature of about 60° C. to obtain a uniform solution. The solution, 20 g of a 10% solution of lime-treated gelatin, 0.3 g of sodium dodecylbenzenesulfonate and 12 ml of water were then added and mixed with stirring The mixture was subjected to dispersion at 10,000 rpm for 10 minutes in a homogenizer. Thus, a dispersion of a cyan dye-providing substance was obtained.

Preparation of Light-sensitive Material 6 g of water was added to 6.5 g of the above described gelatin dispersion of a cyan dye-providing substance (3). The mixture was then heated to a temperature of 40° C. 88 g of the above described microcapsule solution was added to the solution. The solution was then coated on a 100-μm thick polyethylene terephthalate support to a wet film thickness of 70 μm, and then dried.

Furthermore, the undermentioned composition was coated on the coat thus formed as protective layer to a wet film thickness of 30 μm, and dried to obtain a light-sensitive material.

| | | |
|---|---|---|
| (a) | Gelatin (10% aqueous solution) | 30 g |
| (b) | Zinc oxide (10% aqueous dispersion; average particle diameter: 0.2 μm) | 9 g |
| (c) | 2% Aqueous solution of 1,2-bis-(vinylsulfonylacetamido)ethane | 5 ml |
| (d) | Water | 60 ml |

Preparation of Dye Fixing Material 63 g of gelatin, 130 g of the undermentioned mordant and 40 g of guanidine picrate were dissolved in 1,300 ml of water. The solution was then coated on a polyethylene-laminated paper support to a wet film thickness of 45 μm, and then dried.

Mordant

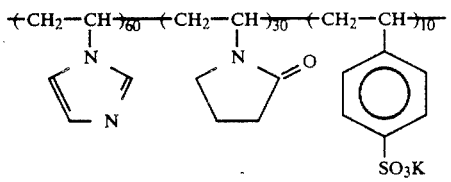

Furthermore, a solution of 35 g of gelatin and 1.05 g of 1,2-bis(vinylsulfonylacetamido)ethane in 800 ml of water was then coated on the coat thus formed to a wet film thickness of 17 μm, and then dried to obtain a dye fixing material.

The light-sensitive material thus prepared was then imagewise exposed to light. The light-sensitive material was supplied with water on the emulsion surface thereof in an amount of 10 ml/m$^2$ from a wire bar. The light-sensitive material was then laminated with the dye fixing material above described in such a manner that the film surface thereof was brought into contact with the dye fixing material.

The lamination was then heated for 20 seconds by means of a heat roller which had been temperature-controlled so that the temperature of the water-absorbed film reached 90° C. When the dye fixing material was peeled off the light-sensitive material, a sharp positive image was obtained on the dye fixing material with a maximum density ($D_{max}$) of 1.60 and a minimum density ($D_{min}$) of 0.24.

Furthermore, the light-sensitive material was stored at a temperature of 40° C. and a relative humidity of 80% for 1 week and then processed in the same manner as ,described above. As a result, almost the same $D_{max}$ and $D_{min}$ values as obtained above were given.

EXAMPLE 18

A light-sensitive material Specimen 1801 having the following layer structure was prepared.

For additives with * mark, the same ones as used in Example 3 were used unless otherwise provided.

TABLE 15

| Layer No. | Layer Name | Additive | Added Amount (g/m$^2$) |
|---|---|---|---|
| 9th layer | Protective layer | Gelatin | 0.80 |
| | | Matting agent (silica) | 0.08 |

TABLE 15-continued

| Layer No. | Layer Name | Additive | Added Amount ($g/m^2$) |
|---|---|---|---|
| | | Water-soluble polymer (1)* | 0.25 |
| | | Surface active agent (1)* | 0.30 |
| | | Film hardener (1)* | 0.15 |
| 8th layer | Blue-sensitive emulsion layer | Emulsion (III) (as calculated in terms of silver) | 0.58 |
| | | Gelatin | 0.40 |
| | | Electron donor (ED-1) | 0.06 |
| | | Surface active agent (2)* | 0.06 |
| | | Fog inhibitor (1)* | $1.30 \times 10^{-3}$ |
| | | Water-soluble polymer (2)* | 0.02 |
| 7th layer | Yellow dye-providing layer | Yellow dye-providing substance (1)* | 0.50 |
| | | High boiling organic solvent (2)* | 0.25 |
| | | Surface active agent (3)* | 0.05 |
| | | Gelatin | 0.35 |
| | | Water-soluble polymer (2)* | 0.02 |
| 6th layer | Interlayer | Gelatin | 0.75 |
| | | $Zn(OH)_2$ | 0.45 |
| | | Reducing agent (1)* | 0.20 |
| | | Electron transfer agent (X-2) | 0.09 |
| | | Surface active agent (1)* | 0.20 |
| | | Water-soluble polymer (2)* | 0.02 |
| 5th layer | Green-sensitive emulsion layer | Emulsion (II) (as calculated in terms of silver) | 0.41 |
| | | Gelatin | 0.40 |
| | | Electron donor (ED-1) | 0.36 |
| | | Surface active agent (2)* | 0.05 |
| | | Fog inhibitor (1)* | $1.10 \times 10^{-3}$ |
| | | Water-soluble polymer (2)* | 0.02 |
| 4th layer | Magenta dye-providing layer | Magnet dye-providing substance (2) | 0.37 |
| | | High boiling organic solvent (2)* | 0.18 |
| | | Surface active agent (3)* | 0.05 |
| | | Gelatin | 0.35 |
| | | Water-soluble polymer (2)* | 0.02 |
| 3rd layer | Interlayer | Gelatin | 0.75 |
| | | $Zn(OH)_2$ | 0.45 |
| | | Reducing agent (1)* | 0.20 |
| | | Electron transfer agent (X-2) | 0.09 |
| | | Surface active agent (1)* | 0.20 |
| | | Water-soluble polymer (2)* | 0.02 |
| 2nd layer | Red-sensitive emulsion layer | Emulsion (I) (as calculated in terms of silver) | 0.36 |
| | | Gelatin | 0.40 |
| | | Electron donor (ED-1) | 0.30 |
| | | Surface active agent (2)* | 0.06 |
| | | Fog inhibitor (1)* | $1.10 \times 10^{-3}$ |
| | | Water-soluble polymer (2)* | 0.02 |

TABLE 15-continued

| Layer No. | Layer Name | Additive | Added Amount ($g/m^2$) |
|---|---|---|---|
| 1st layer | Cyan dye-providing layer | Cyan dye-providing substance (3) | 0.37 |
| | | High boiling organic solvent (2)* | 0.18 |
| | | Surface active agent (3)* | 0.05 |
| | | Gelatin | 0.35 |
| | | Water-soluble polymer (2)* | 0.02 |
| Support | | (Polyethylene terephthalate comprising the same back layer as used in Specimen 301; thickness: 160 μm) | |

*High boiling organic solvent (2): Trinonyl phosphate.

Specimen 1801 thus prepared was then processed together with the image receiving material as used in Example 3 in the same manner as in Example 3. As a result, a color image was obtained with no unevenness.

EXAMPLE 19

A color photographic light-sensitive material Specimen 1901 was prepared by coating the following 1st to 14th layers on a subbed cellulose triacetate film support.

Composition of Light-sensitive Layer

The coated amount is represented in $g/m^2$. The coated amount of silver halide is represented in terms of amount of silver.

| | |
|---|---|
| 1st layer (antihalation layer) | |
| Black colloidal silver | 0.30 |
| Gelatin | 2.50 |
| UV-1 | 0.05 |
| UV-2 | 0.10 |
| UV-3 | 0.10 |
| Solv-1 | 0.10 |
| 2nd layer (interlayer) | |
| Gelatin | 0.50 |
| 3rd layer (low sensitivity red-sensitive layer) | |
| Monodisperse silver bromoiodide emulsion (AgI content: 4 mol %; cubic grain; average grain size: 0.3 μm; S/r: 0.15) | 0.50 |
| ExS-1 | $1.40 \times 10^{-3}$ |
| ExS-2 | $6.00 \times 10^{-5}$ |
| Gelatin | 0.80 |
| ExC-1 | 0.20 |
| ExC-2 | 0.10 |
| Solv-2 | 0.10 |
| 4th layer (middle sensitivity red-sensitive layer) | |
| Monodisperse silver bromoiodide emulsion (AgI content: 2.5 mol %; tetradecahedral grain; average grain size: 0.45 μm; S/r: 0.15) | 0.50 |
| ExS-1 | $1.60 \times 10^{-3}$ |
| ExS-2 | $6.00 \times 10^{-5}$ |
| Gelatin | 1.00 |
| ExC-1 | 0.30 |
| ExC-2 | 0.15 |
| Solv-2 | 0.20 |
| 5th layer (high sensitivity red-sensitive layer) | |
| Monodisperse silver bromoiodide emulsion (AgI content: 2.5 mol %; tetradecahedral grain; average grain size: 0.60 μm; S/r: 0.15) | 0.30 |
| ExS-1 | $1.60 \times 10^{-3}$ |
| ExS-2 | $6.00 \times 10^{-5}$ |
| Gelatin | 0.70 |
| ExC-1 | 0.20 |
| ExC-2 | 0.10 |
| Solv-2 | 0.12 |
| 6th layer (interlayer) | |

-continued

| | |
|---|---|
| Gelatin | 1.00 |
| Cpd-1 | 0.1 |
| Solv-1 | 0.03 |
| Solv-2 | 0.08 |
| Solv-3 | 0.12 |
| Cpd-2 | 0.25 |
| 7th layer (low sensitivity green-sensitive layer) | |
| Silver bromoiodide emulsion (AgI content: 3.0 mol %; mixture of regular crystal and twin; average grain size: 0.3 μm) | 0.65 |
| ExS-3 | $3.30 \times 10^{-3}$ |
| ExS-4 | $1.50 \times 10^{-3}$ |
| Gelatin | 1.50 |
| ExM-1 | 0.10 |
| ExM-2 | 0.25 |
| Solv-2 | 0.30 |
| 8th layer (high sensitivity green-sensitive layer) | |
| Emulsion of tabular particulate silver bromoiodide (AgI content: 2.5 mol %; grains having a diameter/thickness ratio of 5 or more account for 50% of the total grains as calculated in terms of projected area; average grain thickness: 0.15 μm) | 0.70 |
| ExS-3 | $1.30 \times 10^{-3}$ |
| ExS-4 | $5.00 \times 10^{-4}$ |
| Gelatin | 1.00 |
| ExM-3 | 0.25 |
| Cpd-3 | 0.10 |
| Cpd-4 | 0.05 |
| Solv-2 | 0.05 |
| 9th layer (interlayer) | |
| Gelatin | 0.50 |
| 10th layer (yellow filter layer) | |
| Yellow colloidal silver | 0.10 |
| Gelatin | 1.00 |
| Cpd-1 | 0.05 |
| Solv-1 | 0.03 |

-continued

| | |
|---|---|
| Solv-2 | 0.07 |
| Cpd-2 | 0.10 |
| 11th layer (low sensitivity blue-sensitive layer) | |
| Silver bromoiodide emulsion (AgI content: 2.5 mol %; mixture of regular crystal and twin; average grain size: 0.7 μm) | 0.55 |
| ExS-5 | $1.00 \times 10^{-3}$ |
| Gelatin | 0.90 |
| ExY-1 | 0.50 |
| Solv-2 | 0.10 |
| 12th layer (high sensitivity blue-sensitive layer) | |
| Emulsion of tabular particulate silver bromoiodide (AgI content: 2.5 mol %; grains having a diameter/thickness ratio of 5 or more account for 50% of the total grains as calculated in terms of projected area; average grain thickness: 0.13 μm) | 1.00 |
| ExS-5 | $1.70 \times 10^{-3}$ |
| Gelatin | 2.00 |
| ExY-1 | 1.00 |
| Solv-2 | 0.20 |
| 13th layer (ultraviolet absorbing layer) | |
| Gelatin | 1.50 |
| UV-1 | 0.02 |
| UV-2 | 0.04 |
| UV-3 | 0.04 |
| Cpd-5 | 0.30 |
| Solv-1 | 0.30 |
| Cpd-6 | 0.10 |
| 14th layer (protective layer) | |
| Emulsion of finely divided particulate silver bromoiodide (AgI content: 1 mol %; average grain size: 0.05 μm) | 0.10 |
| Gelatin | 2.00 |
| H-1 | 0.30 |

ExS-1

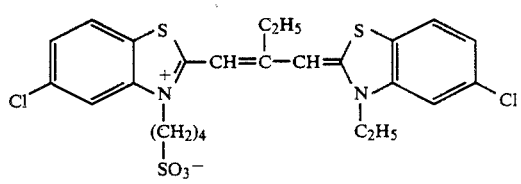

ExS-2

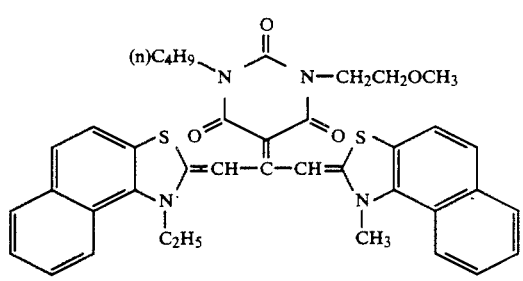

ExS-3

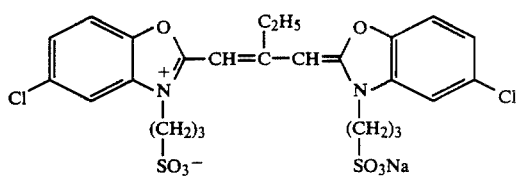

ExS-4

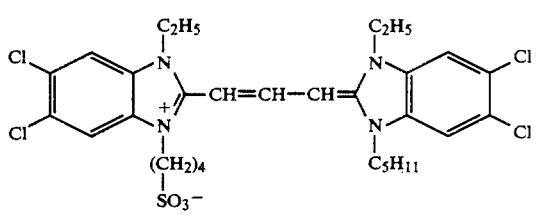

-continued
ExS-5
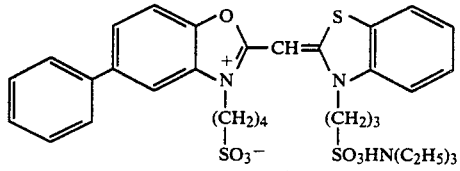
UV-1
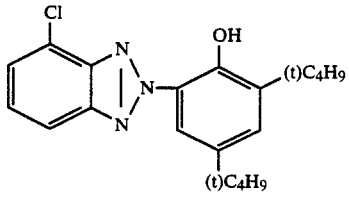
UV-2
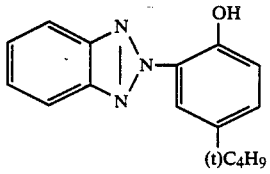
UV-3
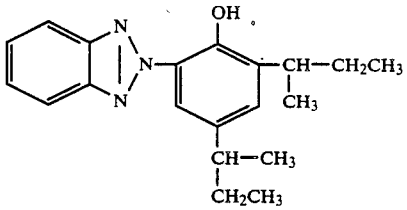
Cpd-1
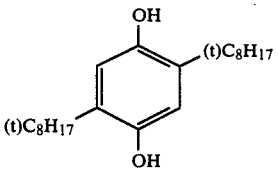
Polyethyl Acrylate Cpd-2
Cpd-3
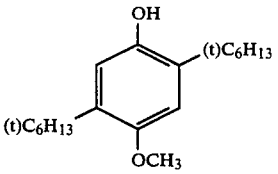
Cpd-4
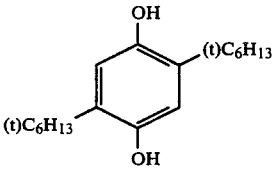
Cpd-5
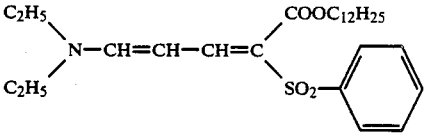

-continued
Cpd-6
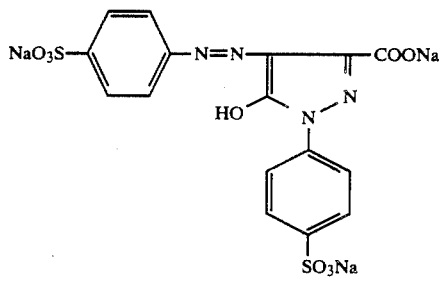
ExC-1
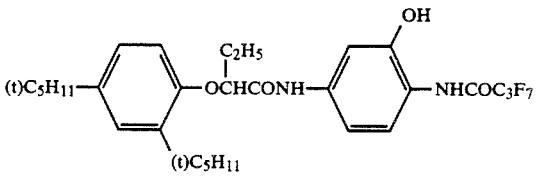
ExY-1
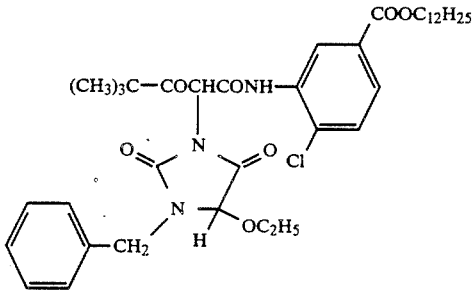
Dibutyl phthalate — Solv-1
Tricresyl phosphate — Solv-2
Trinonyl phosphate — Solv-3
1,2-Bis(vinylsulfonylacetamido)ethane — H-1
ExM-2
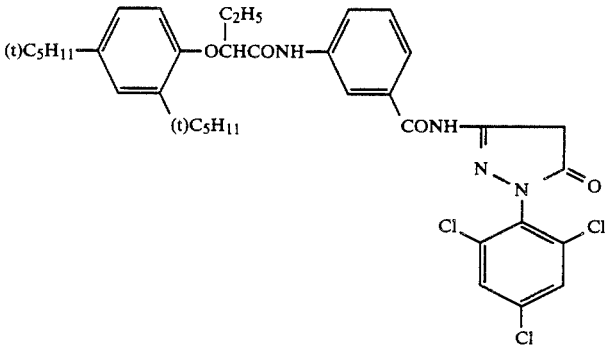
ExM-3
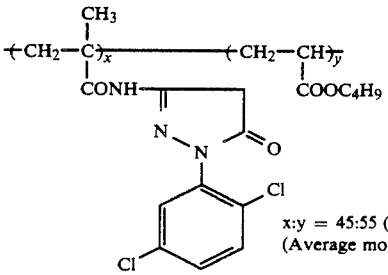
x:y = 45:55 (weight ratio)
(Average molecular weight: ca. 20,000)

-continued

ExC-2

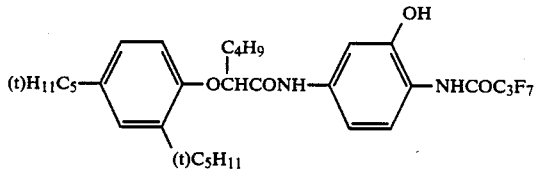

ExM-1

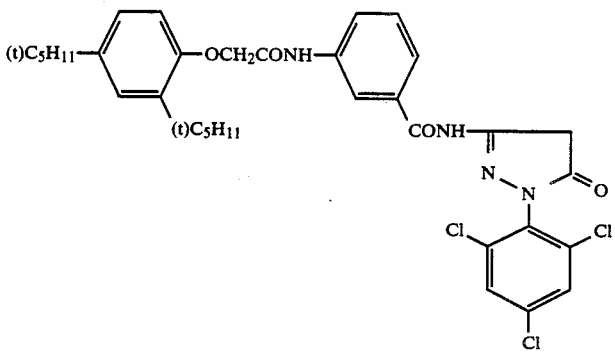

Preparation of Specimen 1902

Specimen 1902 was prepared in the same manner as in Specimen 1901 except the yellow colloidal silver to be incorporated in the 10th layer was replaced by Comparative Compound A in an amount of 0.2 g.

Comparative Compound A

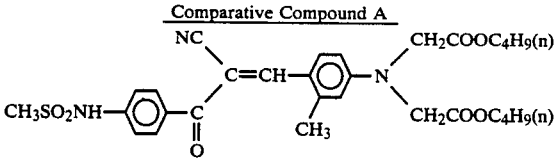

(Yellow dye described in JP-A-61-205934)

Preparation of Specimen 1903

Specimen 1903 was prepared in the same manner as in Specimen 1902 except that Comparative Compound A to be incorporated in the 10th layer was replaced by the present compound 1 in the same equimolecular amount and ED-7 was used as reducing agent in an amount of 0.30 g together with Cpd 1.

Specimens 1901 to 1903 thus prepared were exposed to white light through an optical wedge, and then processed in the following manner.

| Processing Step | Time | Temperature |
|---|---|---|
| 1st development | 6 min. | 38° C. |
| Rinse | 2 min. | 38° C. |
| Reversal | 2 min. | 38° C. |
| Color development | 6 min. | 38° C. |
| Compensation | 2 min. | 38° C. |
| Bleach | 6 min. | 38° C. |
| Fixing | 4 min. | 38° C. |
| Rinse | 4 min. | 38° C. |
| Stabilizing | 1 min. | 25° C. |

The composition of the processing solutions used will be described hereinafter.

| | |
|---|---|
| 1st Developing Solution | |
| Pentasodium nitrilo-N,N,N-trimethylene-phosphonate | 2.0 g |
| Sodium sulfite | 30 g |
| Potassium hydroquinone monosulfonate | 20 g |
| Potassium carbonate | 33 g |
| 1-Phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water to make | 1,000 ml |
| pH (adjusted with hydrochloric acid or potassium hydroxide) | 9.60 |
| Reversing Solution | |
| Pentasodium nitrilo-N,N,N-trimethylenephosphonate | 3.0 g |
| Stannous chloride (dihydrate) | 1.0 g |
| p-Aminophenol | 0.1 g |
| Sodium hydroxide | 8 g |
| Glacial acetic acid | 15 ml |
| Water to make | 1,000 ml |
| pH (adjusted with hydrochloric acid or sodium hydroxide) | 6.00 |
| Color Developing Solution | |
| Pentasodium nitrilo-N,N,N-trimethylenephosphonate | 2.0 g |
| Sodium sulfite | 7.0 g |
| Trisodium phosphate (dodecahydrate) | 36 g |
| Potassium bromide | 1.0 g |
| Potassium iodide | 90 mg |
| Sodium hydroxide | 3.0 g |
| Citrazinic acid | 1.5 g |
| N-Ethyl-N-(β-methanesulfonamidoethyl)-3-methyl-4-aminoaniline sulfate | 11 g |
| 3,6-Dithiaoctane-2,8-diol | 1.0 g |
| Water to make | 1,000 ml |
| pH (adjusted with hydrochloric acid or potassium hydroxide) | 11.80 |
| Compensating Solution | |
| Disodium ethylenediaminetetraacetate (dihydrate) | 8.0 g |
| Sodium sulfite | 12 g |
| 1-Thioglycerin | 0.4 g |
| Water to make | 1,000 ml |
| pH (adjusted with hydrochloric acid or sodium hydroxide) | 6.20 |
| Bleaching Solution | |
| Disodium ethylenediaminetetraacetate (dihydrate) | 2.0 g |
| Ferric ammonium ethylenediamine-tetraacetate (dihydrate) | 120 g |
| Potassium bromide | 100 g |
| Ammonium nitrate | 10 g |

-continued

| | |
|---|---|
| pH (adjusted with hydrochloric acid or sodium hydroxide) | 5.70 |
| Fixing Solution | |
| Ammonium thiosulfate | 80 g |
| Sodium sulfite | 5.0 g |
| Sodium bisulfite | 5.0 g |
| Water to make | 1,000 ml |
| pH (adjusted with hydrochloric acid or aqueous ammonia) | 6.60 |
| Stabilizing Solution | |
| Formalin (37%) | 5.0 ml |
| Polyoxyethylene-p-monononylphenyl ether (average polymerization degree: 10) | 0.5 ml |
| Water to make | 1,000 ml |
| pH | not adjusted |

The specimens thus prepared were measured for yellow and magenta densities. The present Specimen 1903 exhibited a higher sensitivity of the green-sensitive layer and a lower $D_{min}$ of yellow dye image than Specimens 1901 and 1902. This is probably because that the present compounds exhibit a sharp absorption in the long wavelength range as compared to colloidal silver and a better decolorability in the development process than Compound A, leaving less color remaining.

While the invention has been described in detail and with reference to specific embodiments thereof, it will be apparent to one skilled in the art that various changes and modifications can be made therein without departing from the spirit and scope thereof.

What is claimed is:

1. A silver halide light-sensitive material, comprising a compound represented by the general formula (I):

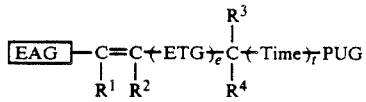

(I)

wherein EAG represents an aromatic group which receives electrons from a reducing substance; $R^1$ represents a group represented by $—Y^1—Y^2—R^6$ in which $Y^1$ and $Y^2$ each represents a hetero atom or a hetero atomic group and $Y^1$ and $Y^2$ may be the same or different and $R^6$ represents a hydrogen atom, an aliphatic group, an aromatic group or a heterocyclic group; $R^2$ represents an acyl group, a carbamoyl group, an alkoxycarbonyl group, a cyano group, a sulfonyl group or a nitro group, with the proviso that $R^1$ and $R^2$ may be in the position of cis or trans to each other; $R^3$ and $R^4$ each represents a hydrogen atom or a hydrocarbon group; ETG represents a group capable of transferring electrons; e represents an integer of 0 or 1; Time represents a group which undergoes reaction triggered by the cleavage from the carbon carrying $R^3$ and $R^4$ to release PUG; t represents an integer 0 or 1; and PUG represents a photographically useful group.

2. A silver halide light-sensitive material as claimed in claim 1, wherein the aromatic group of EAG contains a nitro group as a substituent.

* * * * *